US010442591B2

(12) United States Patent
Rognard et al.

(10) Patent No.: US 10,442,591 B2
(45) Date of Patent: Oct. 15, 2019

(54) OR RELATING TO CLOSURES

(71) Applicant: Obrist Closures Switzerland GmbH, Reinach (CH)

(72) Inventors: Jean-Yves Rognard, Marcy-sur-Anse (FR); Claude Benoit-Gonin, Odenas (FR)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 771 days.

(21) Appl. No.: 14/766,533

(22) PCT Filed: Feb. 10, 2014

(86) PCT No.: PCT/EP2014/052569

§ 371 (c)(1),
(2) Date: Aug. 7, 2015

(87) PCT Pub. No.: WO2014/122314

PCT Pub. Date: Aug. 14, 2014

(65) Prior Publication Data

US 2015/0375908 A1 Dec. 31, 2015

(30) Foreign Application Priority Data

Feb. 8, 2013 (GB) ..... 1302287.6
Apr. 18, 2013 (GB) ..... 1307021.4
May 3, 2013 (GB) ..... 1308042.9

(51) Int. Cl.
*B65D 57/00* (2006.01)
*B65D 55/02* (2006.01)
(Continued)

(52) U.S. Cl.
CPC ..... *B65D 55/024* (2013.01); *B65D 47/0828* (2013.01); *B65D 47/0838* (2013.01);
(Continued)

(58) Field of Classification Search
CPC ..... B65D 55/024; B65D 47/0828; B65D 47/0838; B65D 47/2031; B65D 47/205;
(Continued)

(56) References Cited

U.S. PATENT DOCUMENTS 4,699,283 A 10/1987 Dubach
4,911,337 A 3/1990 Rosenthal
(Continued)

FOREIGN PATENT DOCUMENTS

EP 1086024 B1 5/2003
EP 1582475 A1 10/2005
(Continued)

OTHER PUBLICATIONS

State Intellectual Property Office of the People's Republic of China, First Office Action Issued in Chinese Patent Application No. 20148008238.7, dated Jun. 22, 2016, 4 pages.
(Continued)

*Primary Examiner* — Ernesto A Grano
(74) *Attorney, Agent, or Firm* — Hauptman Ham, LLP

(57) ABSTRACT

A closure (910) comprising a base (912) and a lid (914), the base and lid being joined by a hinge arrangement (932) so that the lid is movable between a closed position and an open position, the hinge arrangement comprising a main hinge (981) and a separate auxiliary hinge (995), in which the lateral extent of the main hinge is greater than the lateral extent of the auxiliary hinge.

19 Claims, 51 Drawing Sheets

(51) Int. Cl.
*B65D 47/08* (2006.01)
*B65D 47/20* (2006.01)
*B65D 47/24* (2006.01)

(52) U.S. Cl.
CPC ..... *B65D 47/205* (2013.01); *B65D 47/2031* (2013.01); *B65D 47/24* (2013.01); *B65D 2101/00* (2013.01); *B65D 2101/0046* (2013.01); *B65D 2101/0069* (2013.01)

(58) Field of Classification Search
CPC ..... B65D 47/24; B65D 2101/00; B65D 2101/0046; B65D 2101/0069
USPC ..... 215/235
See application file for complete search history.

(56) References Cited

U.S. PATENT DOCUMENTS 5,207,783 A * 5/1993 Burton ..... B65D 41/3442 215/235
5,335,802 A * 8/1994 Brach ..... B29C 45/26 215/235
5,540,343 A * 7/1996 Schumacher ..... B65D 47/0814 215/235
5,794,308 A 8/1998 Rentsch et al.
5,913,435 A * 6/1999 Fuchs ..... B65D 47/0814 215/235
6,041,477 A * 3/2000 Rentsch ..... B65D 47/0814 16/225
6,253,938 B1 7/2001 Zaksenberg et al.
6,439,410 B1 * 8/2002 Dubach ..... B65D 47/0809 215/235
6,578,744 B2 * 6/2003 Hierzer ..... B65D 47/0814 215/237
6,634,060 B1 * 10/2003 Lagler ..... B65D 47/0809 16/225
6,971,531 B1 * 12/2005 Dubach ..... B65D 47/0861 215/235
7,510,095 B2 * 3/2009 Comeau ..... B65D 35/08 215/235
7,611,025 B2 * 11/2009 Nusbaum ..... B65D 47/0838 215/235
7,959,025 B2 * 6/2011 Salice ..... B65D 43/162 220/4.01
8,608,001 B2 * 12/2013 Stoneberg ..... B65D 47/0819 215/235
9,415,909 B2 * 8/2016 Druitt ..... B65D 47/0809
9,932,158 B2 * 4/2018 Rognard ..... B65D 47/0828
2001/0052531 A1 * 12/2001 Randall ..... B65D 47/0809 222/521
2002/0079282 A1 * 6/2002 Harrold ..... B65D 47/0809 215/237
2003/0057209 A1 * 3/2003 Seelhofer ..... B65D 47/123 220/259.1
2005/0087550 A1 4/2005 Skillin
2006/0016776 A1 1/2006 Barre et al.
2006/0037976 A1 * 2/2006 Eimer ..... B65D 47/0823 222/491
2006/0163188 A1 * 7/2006 Lagler ..... B65D 47/0809 215/235
2008/0011703 A1 1/2008 Schmeisser et al.
2008/0035681 A1 * 2/2008 Skillin ..... B65D 47/0819 222/556
2008/0083758 A1 * 4/2008 Blendell ..... B65D 15/04 220/522
2008/0110933 A1 * 5/2008 Goncalves ..... B65D 47/0809 222/153.05
2009/0321379 A1 * 12/2009 Lilienthal ..... B65D 35/12 215/235
2010/0005641 A1 * 1/2010 Druitt ..... B65D 47/0809 29/426.4
2010/0065589 A1 * 3/2010 Skillin ..... B65D 47/0819 222/556
2010/0102021 A1 * 4/2010 Guglielmini ..... B65D 47/0833 215/228
2010/0102022 A1 4/2010 Kuwahara et al.
2014/0263436 A1 * 9/2014 Gelov ..... B65D 47/2031 222/92
2016/0016706 A1 1/2016 Rognard et al.
2016/0023818 A1 * 1/2016 Gelov ..... B65D 47/0838 220/254.1

FOREIGN PATENT DOCUMENTS

EP 1892194 A1 2/2008
EP 1902972 A1 3/2008
EP 2213584 A1 8/2010
FR 2842176 A1 1/2004
GB 1521290 A 8/1978
GB 2442227 A 4/2008
GB 2445149 A 7/2008
JP 2006206062 A 8/2006
JP 4007521 B2 11/2007
WO 9855371 A1 12/1998
WO 2006021509 A1 3/2006
WO 2009122118 A1 10/2009

OTHER PUBLICATIONS

State Intellectual Property Office of the People's Republic of China, First Office Action Issued in Chinese Patent Application No. 201480008239.1, dated Mar. 22, 2016, 4 pages.
Intellectual Property Office of Great Britain, Search Report Issued in Application No. GB1302287.6, Search Performed Jul. 8, 2013, South Wales, 1 page.
Intellectual Property Office of Great Britain, Search Report Issued in Application No. GB1308042.9, dated Aug. 22, 2013, South Wales, 4 pages.
Intellectual Property Office of Great Britain, Search Report Issued in Application No. GB1307021.4, dated Oct. 11, 2013, South Wales, 5 pages.
ISA European Patent Office, Invitation to Pay Additional Fees and, Where Applicable, Protest Fee Issued in Application No. PCT/EP2014/052569, dated Jun. 2, 2014, WIPO, 6 pages.
ISA European Patent Office, International Search Report and Written Opinion Issued in Application No. PCT/EP2014/052569, dated Oct. 17, 2014, WIPO, 17 pages.
ISA European Patent Office, Invitation to Pay Additional Fees and, Where Applicable, Protest Fee Issued in Application No. PCT/GB2014/050387, dated Jun. 2, 2014, WIPO, 5 pages.
ISR and Written Opinion in European Application No. PCT/GB2014/050387, dated Oct. 17, 2014, WIPO, 18 pages.

* cited by examiner

OR RELATING TO CLOSURES

CROSS REFERENCE TO RELATED APPLICATIONS

The present application is a U.S. National Phase of International Patent Application Serial No. PCT/EP2014/052569, entitled "IMPROVEMENTS IN OR RELATING TO CLOSURES," filed on Feb. 10, 2014, which claims priority to United Kingdom Patent Application No. 1302287.6, filed on Feb. 8, 2013, United Kingdom Patent Application No. 1307021.4, filed on Apr. 18, 2013, and United Kingdom Patent Application No. 1308042.9, filed on May 3, 2013, the entire contents of each of which are hereby incorporated by reference for all purposes.

TECHNICAL FIELD

The present invention relates generally to closures, for example dispensing closures. In some aspects and embodiments the invention relates to a dispensing closure, such as a "sportscap", in which a user may directly drink through part of the closure.

BACKGROUND AND SUMMARY

It is known to provide dispensing closures for use in conjunction, for example, with beverages such as mineral water, sports drinks and the like. Often these closures are provided as a base with a spout, and a lid which is hinged to the base so that it can be flipped from a closed position in which the spout is protected to an open position in which the spout can be accessed so that a user may drink from the spout.

One consideration for such closures is ensuring that it is as easy as possible for the user to drink from the spout. For example, in many known closures when the lid is moved to the open position the hinge arrangement has a tendency to pull the lid back towards the closed position and thus interfere with the user's mouth during drinking.

The present invention seeks to provide improvement over known closures.

A closure comprising a base and a lid, the base and lid being joined by a hinge arrangement so that the lid is movable between a closed position and an open position, the hinge arrangement comprising a main hinge and a separate auxiliary hinge, in which the lateral extent of the main hinge is greater than the lateral extent of the auxiliary hinge.

The main hinge may be connected to the base.

The main and auxiliary hinges may be joined by a link member, such as a strap, panel or the like. The link member may be a generally truncated triangular shape.

The main hinge and/or auxiliary hinge may be a butterfly hinge.

The auxiliary hinge and/or main hinge may be a living hinge.

The main hinge and the auxiliary hinge may operate independently. Alternatively, at least some degree of interaction between the hinges may occur.

The auxiliary hinge may, for example, be curved or linear.

The closure may comprise a deformable section which is deformed when the lid is moved to the open position and which exerts a force to hold the lid stably in the open position.

According to a further aspect of the present invention there is provided a closure comprising a base and a lid, the base and lid being joined by a hinge arrangement so that the lid is moveable between a closed position and an open position, the hinge arrangement comprising one or more links for connecting the base and the lid, the closure comprising a deformable section which is deformed when the lid is moved to the open position and exerts a force on the link so that it is stressed and holds the lid stably in the open position.

This aspect of the present invention therefore provides a stable open position which prevents the lid from passively returning to the closed position and thus prevents it from interfering with any activities occurring in or around the base.

The deformable section may be provided on or by the lid.

The hinge may include a plurality of links and the deformable section may act intermediate links of the hinge. For example, two links may be provided and the deformable section acts in the middle of the two links. Embodiments in which more than three links are provided are possible and embodiments in which more than one deformable section, each for example acting on one or more links, are possible.

The deformable section may be deformed by the base. In other words, as the lid moves towards the open position, the deformable section is contacted by the base and deformed so as to apply stress to the links when the open position is reached.

The deformable section may form part of the hinge arrangement. Alternatively the section may be separate from, but adapted to interact with, the hinge.

The hinge arrangement may comprise two or more mutually spaced links. As discussed above, arrangements in which three or more links are provided are possible.

The or each link may be generally strap like. A relatively thin panel-like strap is useful for providing articulation and is relatively easy to put under stress.

The link may be stretched in the open position. In other embodiments tension or torsion forces may be applied to place the link under stress when in the open position.

The deformable section may be adjacent the base. In some embodiments the deformable section is integral with the base; however in other embodiments there is a disconnect between the deformable section and the base, for example, a gap or a material thinning.

The deformable section may move between a generally convex and concave configuration in the closed and open position. For example, the section may "flip" between two such curved configurations.

The deformable section may form part of the lid side wall. For example, the section may be provided at or around the free end of a skirt.

The closure may be formed as a dispensing closure, such as a flip-top dispensing closure. For example, the closure may comprise a spout which may, for example, form part of the base or may be formed as a separate part which is engageable with the base. The lid may include a spigot for engaging the spout.

The base may comprise engagement means for connecting the closure to a container. For example, screw thread formations and/or snap-engagement means may be provided. Additionally or alternatively, tamper-evidence means may be provided. For example, a tamper-evident band may be provided at the open end of the base.

When the lid is in the open position it may be at least 180 degrees displaced from the base. For example, the lid may move through at least 180 degrees between the closed and open positions, or the lid may be oriented with respect to the base so that following a movement (which may be less than 180 degrees) the open position provides at least 180 degrees of clearance between the base and the lid.

The closure may further comprise a second hinge for articulating the lid with respect to the base. The second hinge may operate independently of the first hinge; alternatively the first and second hinges may operate co-operatively. The second hinge may be curved, or may be linear.

The lid may have a generally frustoconical shape, with a tapering side skirt.

The present invention additionally or alternatively relates to a closure for a container and particularly to a closure which can provide some indication that the closure has been opened at least once.

It is known to provide container closures with tamper-evident drop bands which are released from the open end of a closure side wall upon first opening. Although drop bands provide some indication that the closure has been opened, because they are physically separated there is no clear indication of opening on the remaining part of the closure. It is also known to provide tear-off bands which are removed from a closure body upon first opening. However, the tear-off bands present a litter problem and a potential choking hazard because they are generally small tabs which are separated from the closure body.

The present invention seeks to address the problems with known tamper-evident closures.

In a further aspect, the invention provides a tamper-evident closure comprising a base, a lid, a dispensing member, and a tamper-evident member which is visible prior to first opening of the closure in use, and upon first opening of the closure becomes at least partly hidden from view wherein prior to first opening of the closure in use, the tamper-evident member masks at least part of the dispensing member, and upon first opening of the closure reveals at least part of the dispensing member whereby to indicate the closure has been opened at least once.

In one embodiment the base may at least partly define a void and the tamper-evident member may move at least partly into the void upon first opening of the closure.

The base and lid may be integrally hinged to one another in that they are manufactured as one piece. For instance, the closure may be manufactured from plastics and the base and lid may be moulded in one, connected together via the hinge. The hinge may be a snap type hinge and may include at least one strap.

The dispensing member may be a separate member from the lid and/or base. For instance, it may be moulded separately, as opposed to being integral with the lid and/or base. The dispensing member may then be assembled with the lid and/or base. The dispensing member may be a spout for drinking from directly or for pouring from. Alternatively, the dispensing member may be integral with the lid or base.

The tamper-evident member may be movable from an unready position to a primed position. This movement may occur upon assembly of the dispensing member and base.

The tamper-evident member may be frangibly connected to either the base and/or the lid, and the frangible connection (s) may be breakable upon first opening of the closure. For instance, the tamper-evident member may, at one end, be frangibly connected to the lid. At the opposite end a projection may be provided. This projection may engage with the base and/or dispensing member such that when the closure is first opened the tamper-evident member cannot follow the relative movement of the lid such that the frangible connection(s) break. Alternatively, or additionally, the tamper-evident member may be frangibly connected at one end to the base and the projection may engage with the lid such that the action of opening the lid for the first time effects breakage of the frangible connection(s).

The tamper-evident member may be separate from the base, lid and dispensing member, and the closure and tamper-evident member may include corresponding means for limiting their relative movement upon first opening. For example, the tamper-evident member may be in the form of two rings connected together by frangible connection(s). This ring may fit between the lid and the base and surround the dispensing member. The lid and the spout or base may include projections which engage with corresponding projections on the tamper-evident member such that on first opening of the closure the tamper-evident band is pulled apart so that one ring is pulled by the lid and the other ring is pulled by the base or spout. The frangible connection(s) may then break such that the tamper-evident member splits into two parts. The lower ring of the tamper-evident member may fall into a pocket or void provided in the base so as to become at least partly hidden from view and to at least partly reveal the dispensing member.

The dispensing member may be of a different colour from the lid and/or base to be more clearly visible when the tamper-evident member has moved upon first opening.

There may be more than one tamper-evident member.

In a further aspect, the invention provides a tamper-evident closure comprising a closure body and a tamper-evident member which is visible prior to first opening of the closure in use, wherein upon first opening of the closure the tamper-evident member becomes at least partly hidden from view, whereby to indicate the closure has been opened at least once.

The tamper-evident member of the closure is therefore retained upon first opening but becomes at least partly hidden from view as an indicator that the closure has been opened at least once. In some embodiments the tamper-evident member may become completely hidden from view.

In a further aspect, the invention provides a tamper-evident closure comprising a closure body defining a void, and a tamper-evident member which is visible prior to first opening of the closure in use, wherein upon first opening of the closure the tamper-evident member moves at least partly into the void, whereby to indicate the closure has been opened at least once.

Tamper-evident members formed in accordance with the present invention may be frangibly connected to a closure body. Upon first opening of the closure the tamper-evident member can thereby be released from the body.

The closure body may comprise an open-indicative section and the tamper-evident member may comprise a mask which reveals the opening-indicative section upon first opening of the closure.

The open-indicative section may comprise a further section or part of the closure, such as a spout.

The opening-indicative section may be formed so as to be highly visible so that once the tamper-evident member is moved there is clear evidence that the closure has been opened at least once.

The opening-indicative section may be formed in a contrasting colour and/or texture to other parts of the closure to increase visibility.

The closure may comprise a window in which or through which the tamper-evident member is visible prior to first opening the window. Accordingly, upon first opening of the closure the tamper-evident member can fall out of or out of register with the window.

The tamper-evident member may be moveable from an unready position to a primed position. For example, the closure may comprise a plurality of components and the tamper-evident member is moved to the primed position only upon assembly of the closure component parts together. In other words, the tamper-evident system is only activated upon assembly.

The closure body may comprise a plurality of parts. For example, the closure body may comprise a first part and a second part such as a base and a lid which may be hingedly connected together.

The closure may comprise a spout part through which the contents of an associated container can be dispensed. In one embodiment the closure comprises a base part connected to a lid by a hinge and a spout part which is internally received by the base/lid.

The closure may be formed from any suitable material, such as a plastics or metallic material. Different components of the closure may be formed from different materials.

In a further aspect the present invention relates generally to a closure and particularly to a closure including a body part and an insert part.

It is known to provide closures having two or more components, such as a body and a spout. In many cases it is necessary for extraneous fluid to be applied to such closures. For example, cooling or cleaning fluid is sprayed onto closures during the manufacturing process.

It is difficult to produce closures which can reliably prevent the ingress of water between various parts of a body and an insert. The result is that the fluid can become trapped within the closure which is undesirable.

The present invention seeks to address the problems with known closures.

According to a further aspect of the present invention there is provided a closure comprising a body and an insert, and having a drainage system for allowing fluid applied to the closure to pass between the exterior of the insert and the interior of the body to allow removal thereof.

The drainage system may comprise one or more drainage paths formed at the interface between the insert and the body.

The drainage paths may be formed wholly or partly in either or both of the body and the insert.

The or each drainage path may comprise one or more slots formed at the periphery of the insert.

The insert may comprise a plurality of ribs or radial projections at its periphery. The slots may be formed between the ribs.

The slot/s may comprise an inclined drainage face to assist drainage.

The insert may comprise a plurality of mutually spaced retention spokes. The spokes may define, at least in part, the drainage paths.

The insert may comprise a spout. For example, a drinking spout would require sterilisation with a cleaning fluid and thereafter the fluid needs to be removed so as not to affect the user's taste.

The body may comprise a base and a lid. The base and lid may be joined by a hinge, such as a snap-hinge. The interface between the lid and the base is a likely point at which fluid will enter.

According to a further aspect there is provided an insert for a closure body, comprising one or more drainage paths for allowing fluid applied to the closure to pass between the exterior of the insert and the interior of the body to allow removal thereof.

In a further aspect the present invention relates generally to a closure and particularly to a closure of the type known as a sport cap.

In recent times the use of so-called sport caps has increased. Sport caps differ from the more traditional so-called single caps in that they have two areas of sealing: i) between the closure and the container neck (which single caps have); and ii) between two parts of the closure. The two parts of the closure may include, for example, a spout and a lid or a push-pull spout and a base.

Hotfill is a filling technique in which containers are filled with product at process temperature, hot, to ensure continued sterility of the container and the product during and after the fill process. When such containers are capped the closure must be suitable for application.

It is known to provide closures having two or more components, such as a body and a spout. In many cases it is necessary for extraneous fluid to be applied to such closures. For example, cooling or cleaning fluid is sprayed onto closures during the manufacturing process. It is difficult to produce closures which can reliably prevent the ingress of water between various parts of a body and an insert. The result is that the fluid can become trapped within the closure which is undesirable.

The present invention seeks to address the problems with known sports cap closures.

According to a further aspect of the present invention there is provided a linerless, hotfill, sports cap closure.

According to a further aspect of the present invention there is provided a hotfill sports cap closure comprising a body having two or more parts and two or more sealing areas, the first sealing area being sealable to a container neck and the second sealing area being between two body parts.

According to a further aspect of the present invention there is provided a hotfill sports cap closure comprising a body formed with an absence of a sealing liner, and having a base with a spout, and a lid for sealing the spout.

The closure may be a single piece closure. For example a base may be formed with an integral spout and an integrally formed lid may be provided.

Alternatively the closure may be formed from two or more separate components. For example, the closure may comprise a body and an insert. Such closure may have a drainage system for allowing fluid applied to the closure to pass between the exterior of the insert and the interior of the body to allow removal thereof.

The closure may comprise a body and an insert, and having a drainage system for allowing fluid applied to the closure to pass between the exterior of the insert and the interior of the body to allow removal thereof.

By providing a drainage system the closure is particularly, although not exclusively, suitable for hot-fill applications in which spraying of the closure following capping for cooling and/or sterilisation purposes is common.

Aspects and embodiments of the present invention may include one or more of the following features:

a closure body which is moulded in a closed position
an ergonomic and comfortable spout design
a modern aesthetic design
single click opening and closing actions
a translucent, transparent or opaque body
one, two, three, four or more components
drop band tamper evidence
a stable open position
at least 180° opening
a double hinge
a lid which opens to a 'snap' back stable position
suitability for aseptic filling
aseptic drainage system
a self-closing valve a flow enhancer design
a traditional orifice
high specification sealing >3 bars
one hand opening and closing.

The present invention also provides a closure as described herein in combination with a container.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

BRIEF DESCRIPTION OF FIGURES

The present invention will now be more particularly described, by way of example, with reference to the accompanying drawings, in which:—

DETAILED DESCRIPTION

Figure 1:
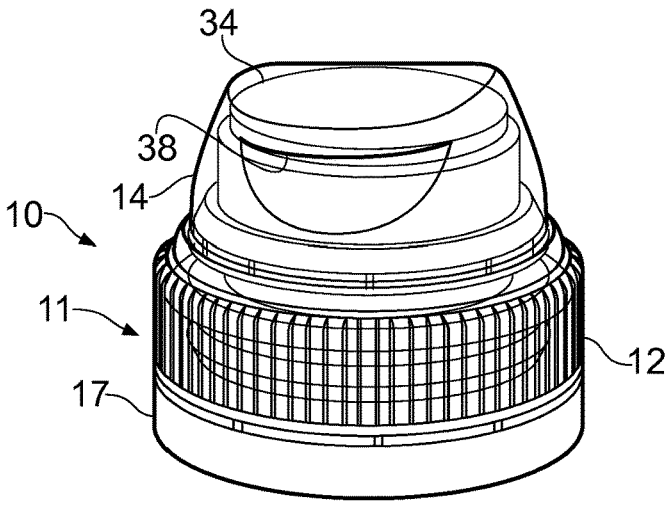
FIG. 1 is a front perspective view of a closure formed according to the present invention and shown in an unopened condition.
Figure 2:
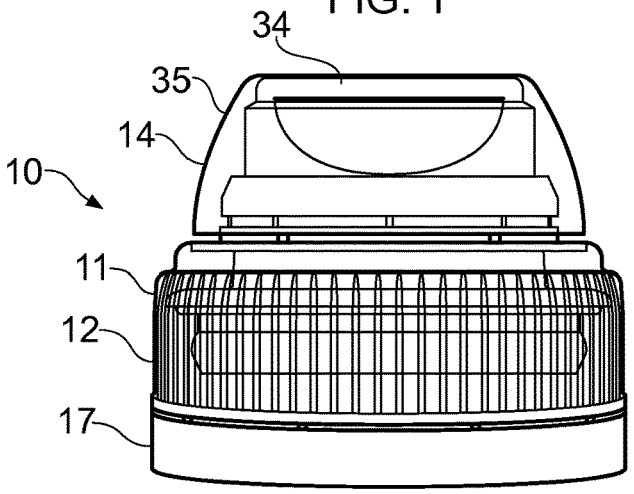
FIG. 2 is a front elevation of the closure of FIG. 1.
Figure 3:
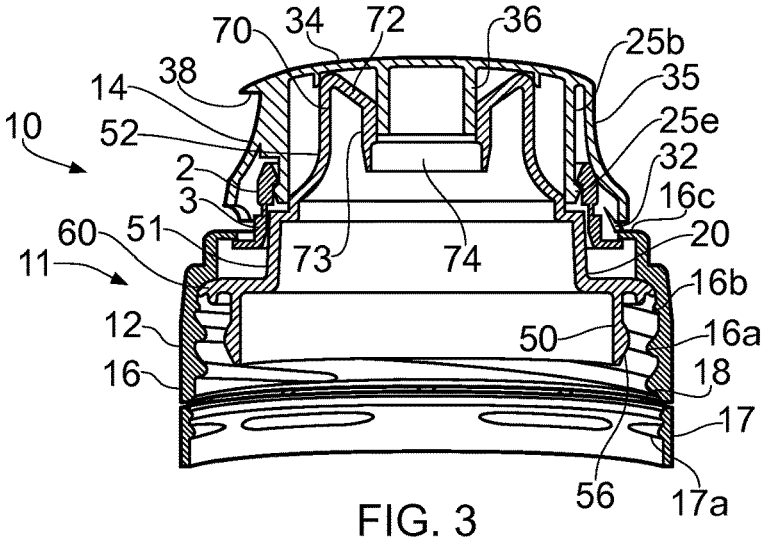
FIG. 3 is a section of the closure of FIGS. 1 and 2.

Referring first to FIGS. 1 to 3 there is shown a closure generally indicated 10 which is connectable to a container neck finish (not shown). The closure 10 comprises a translucent body 11 and a spout insert 20.

The body 11 comprises a base 12 and a lid 14.

The base 12 comprises a generally cylindrical side wall 16 having at one end a tamper-evident annular band 17 connected thereto by a plurality of frangible bridges 18.

The side wall 16 terminates at its end opposite the band 17 with an annular shoulder 16*c* which extends radially inwards.

The generally turret-like lid 14 is connected to the free end of the shoulder 16*c* via a hinge arrangement generally indicated 32.

The interior of the base side wall 16 comprises internal screw thread formations 16*a* for engaging corresponding external screw thread formations on a container neck. The interior of the side wall 16 further comprises an annular retention bead 16*b*.

The interior of the band 17 comprises a segmented retention bead 17*a* for engagement under a locking bead on a container neck so that if the closure is unscrewed the band 17 will remain on a container neck.

The lid 14 comprises a top plate 34 from which depends a lid sidewall 35; a spigot 36 depends from the underside of the centre of the lid.

Opposite the hinge 32 the lid 14 includes a small peak 38 used to lift the lid and flip it open with respect to the base 12.

The spout 20 comprises a generally cylindrical lower portion 50, a generally cylindrical central portion 51 and a generally frusto conical upper portion 52.

The lower portion 50 comprises an annular external sealing bead 56. In use, the portion 50 enters the bore of the container neck such that the sealing bead 56 seals against its inner surface.

The central retention portion 51 comprises a plurality of radially outwardly extending retention spokes 60.

The upper portion 52 comprises a curved, generally frusto conical outer surface defining a spout. At the end of the spout side wall opposite the central portion 51 is a cylindrical terminal portion 70. An inclined annular orifice wall 72 extends inwards from the free end of the portion 70 and from it an annular wall 73 depends; the wall 73 defines an orifice 74.

The spout 20 is received into the body 11. The retention spokes 60 engage over the retention bead 16*b* so that the spout is held firmly in position. The spigot 36 enters through the wall 73 to close the orifice 74.

Figure 9:
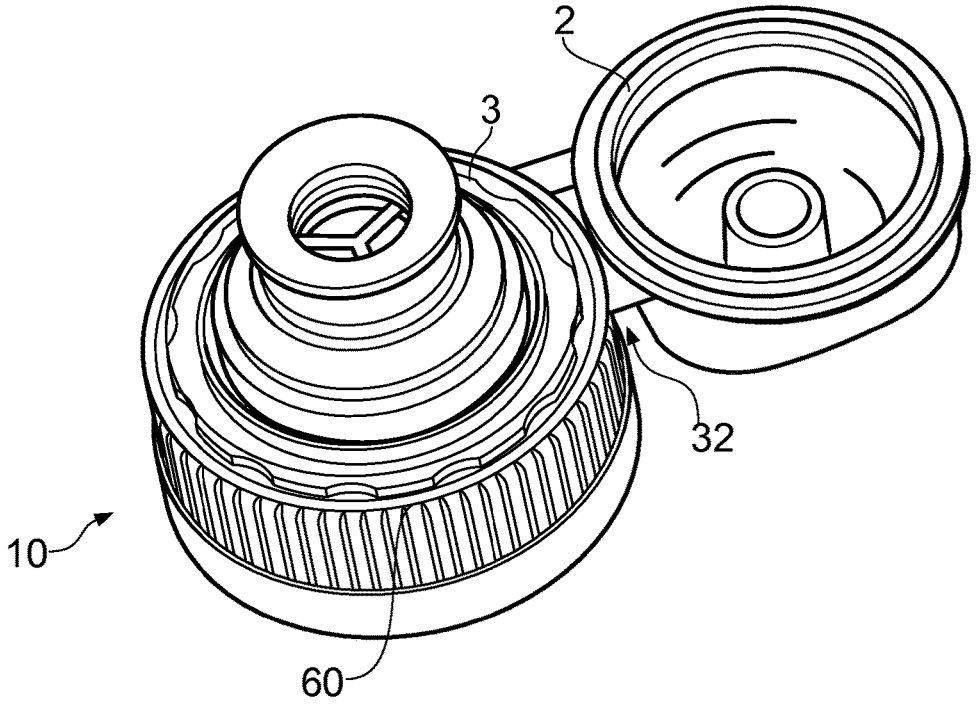
FIG. 9 is a perspective view of the closure of FIGS. 1 to 6 shown in an open position.

With the insert 20 in position slots are formed between the spokes 60 of the central portion 51 and the side wall 16, as shown in FIG. 9.

Figure 8:
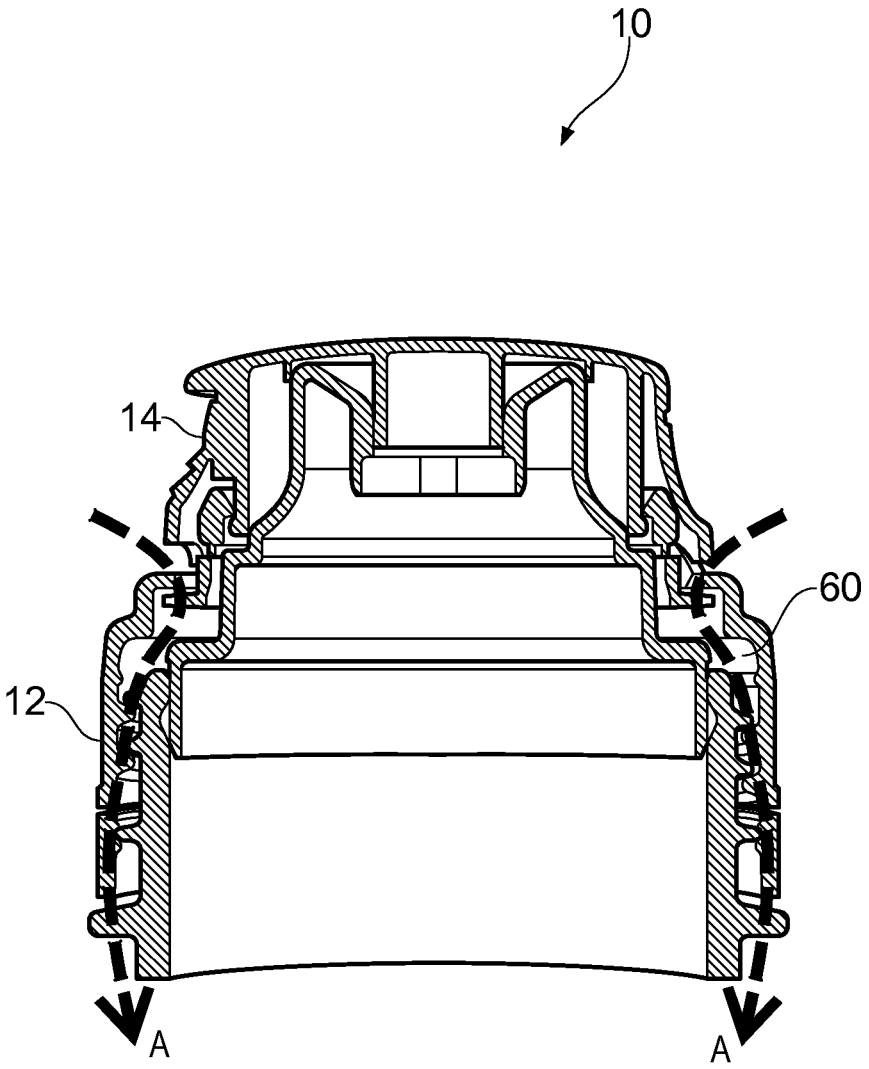
FIG. 8 is a section of the closure of FIGS. 1 to 6 in an unopened condition illustrating a drainage system.

As illustrated in FIG. 8, if fluid is sprayed at the closure 10, it may enter the interior of the closure via the hinge line interface between the lid 14 and the base 12. If this happens, the fluid can pass between the spokes 60 and then between the closure and container screw threads and out at the bottom of the side wall 16. This means that there is an unobstructed drainage path A for fluid to follow if it enters the closure. It may be necessary to force fluid through the drainage path, for example by blowing air at the closure.

In a further embodiment the hinge arrangement 32 may be of the type described in more detail below with reference to FIGS. 13 to 36. The hinge 32 may therefore allow the lid 14 to be held stably in an open position which is approximately 180 degrees from the closed position.

Figure 7:
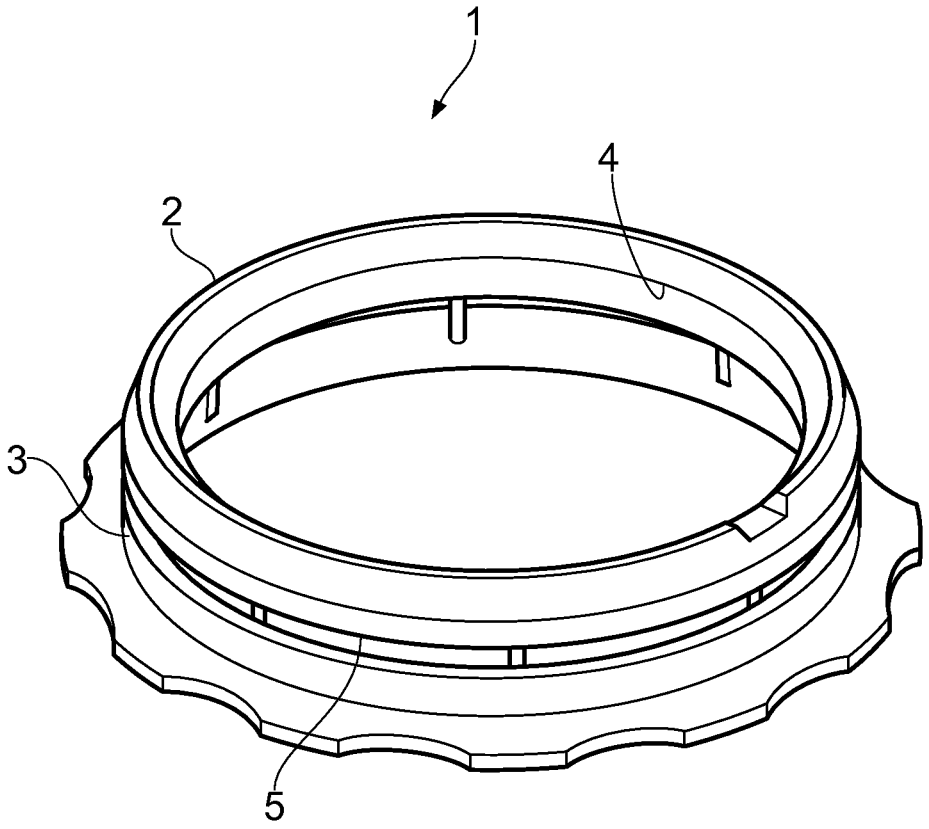
FIG. 7 is a perspective view of a tamper-evidencing double ring forming part of the closure of FIGS. 1 to 6.

A tamper-evident member 1 is provided for the closure and is shown in more detail in FIG. 7.

The member 1 takes the form of a separate element having an upper ring 2 and a lower ring 3 connected together by frangible connections and is assembled with the closure 10. Upon assembly, the tamper-evident member 1 fits between the base and the lid and radially outward of the spout 20. The tamper-evident member 1 includes an upper projection 4 on the upper ring 2 which projects radially inwardly and a lower flange 5 on the lower ring which projects radially outwardly.

When the tamper-evident member 1 is assembled with the closure 10 the upper projection 4 engages with a projection 25*e* provided on the radially inner surface of the side skirt 25*b* of the lid. Further, the flange 5 engages with the underside of the shoulder 16*c* on the spout 20. In this manner, when the lid is initially closed it cannot be opened without breaking the frangible connections. The member 1 therefore splits into the two rings 2, 3 as shown in FIGS. 4 to 6, 9 and 10 and the lower ring 3 is no longer visible through the lid window, having dropped into the void 7 above the spout ledge 21.

In FIGS. 1 to 3 the closure 10 is shown in the closed position. When a user desires to drink from the spout they grasp the lid and flip it open using the peak.

The user can now access the spout freely and unencumbered by the lid. With the lid in the open position the ring 3 is retained in the lid by the projection 25*e* and is clearly visible.

Figure 4:
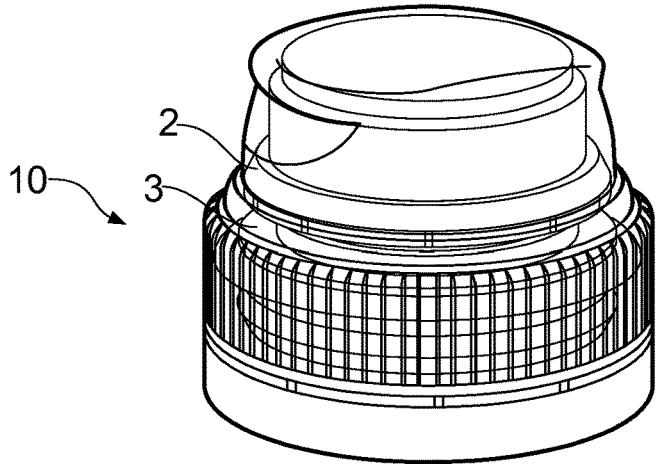
FIG. 4 is a front perspective view of the closure of FIGS. 1 to 3 shown following opening and re-closure.
Figure 5:
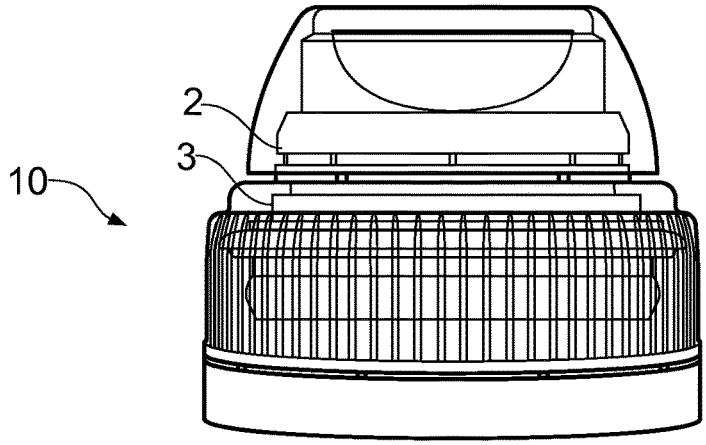
FIG. 5 is a front elevation of the closure of FIG. 4.
Figure 6:
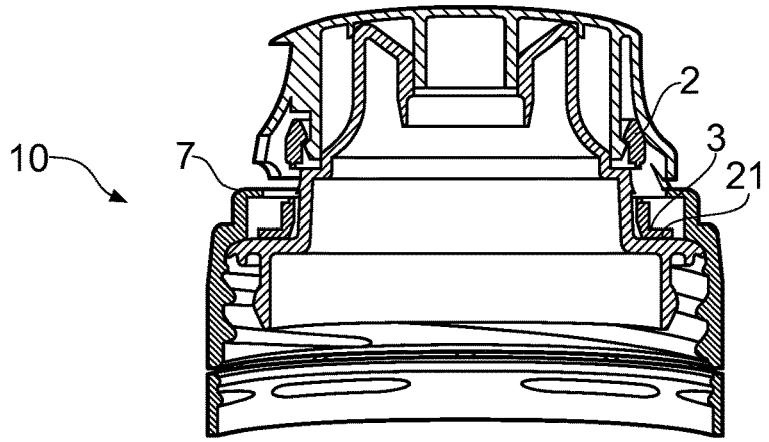
FIG. 6 is a section of the closure of FIGS. 4 and 5.

The lid can be returned to the closed position by overcoming the forces present in the panel section and the links (see below). The hinge arrangement returns to its original, unstressed state, ready to be opened once again when required. The separated rings 2, 3 show that the closure has been opened at least once, as shown in FIGS. 4 to 6.

Figure 10:
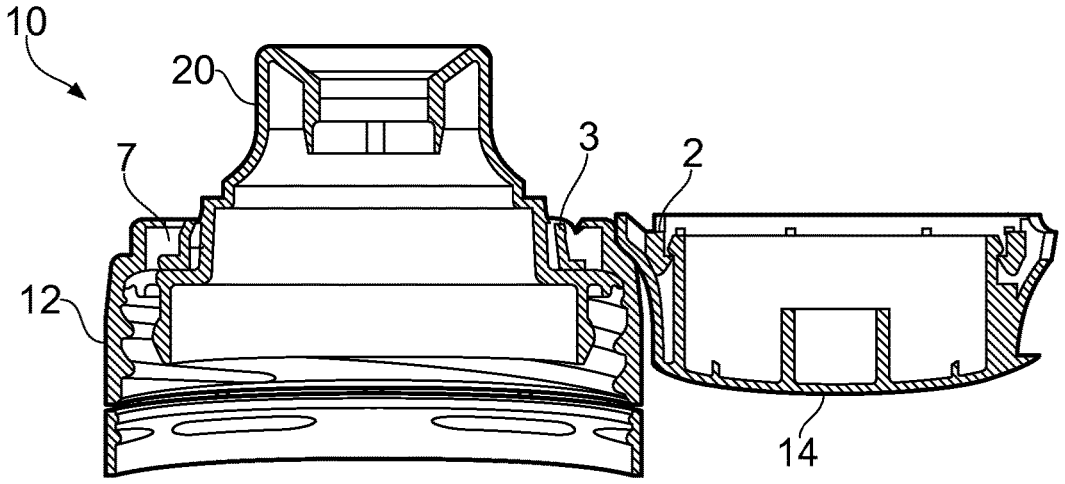
FIG. 10 is a section of the closure of FIG. 9.
Figure 11:
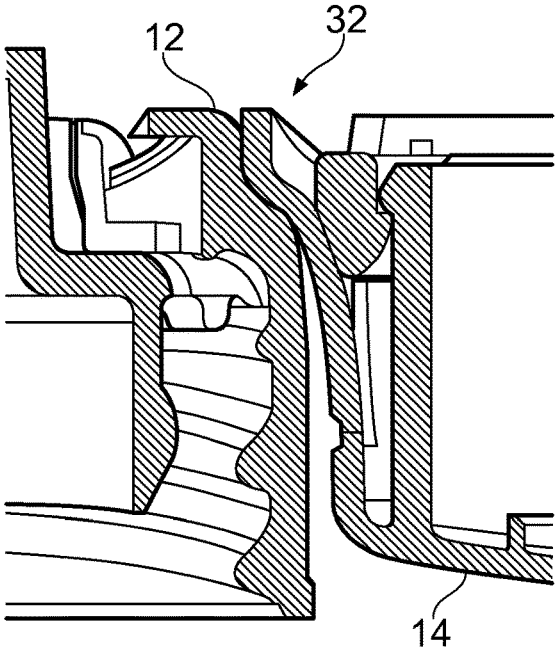
FIG. 11 is a magnified sectional view showing the hinge of the closure of FIG. 10.
Figure 12:
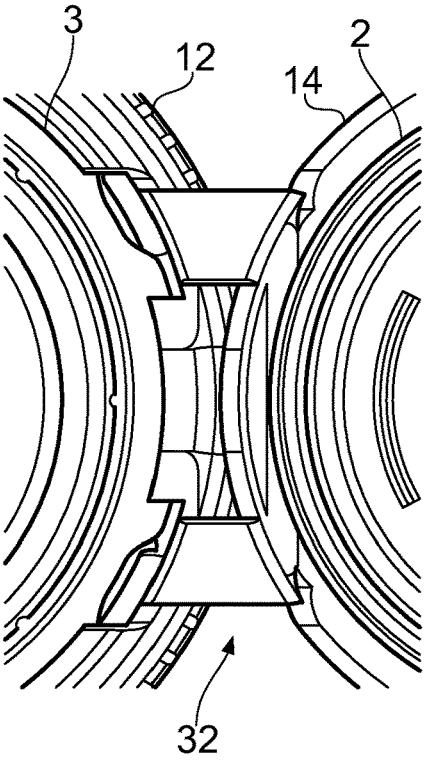
FIG. 12 is a plan view of the hinge region of FIG. 11.
Figure 15:
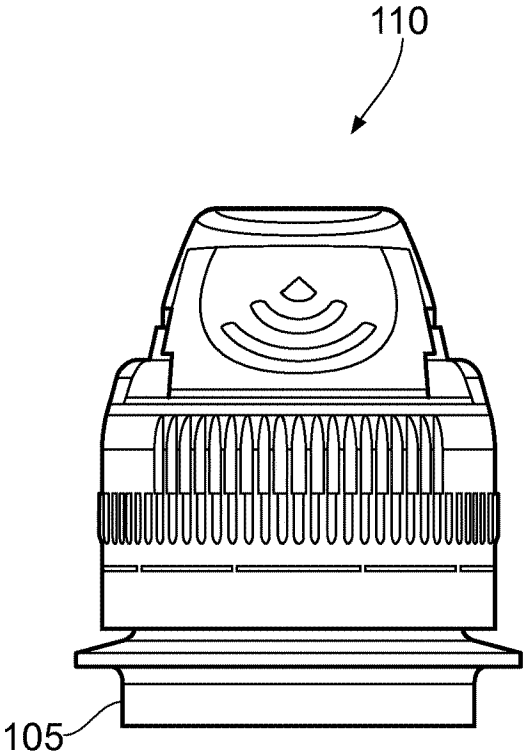
FIG. 15 is a front elevation of the closure of FIG. 13.
Figure 14:
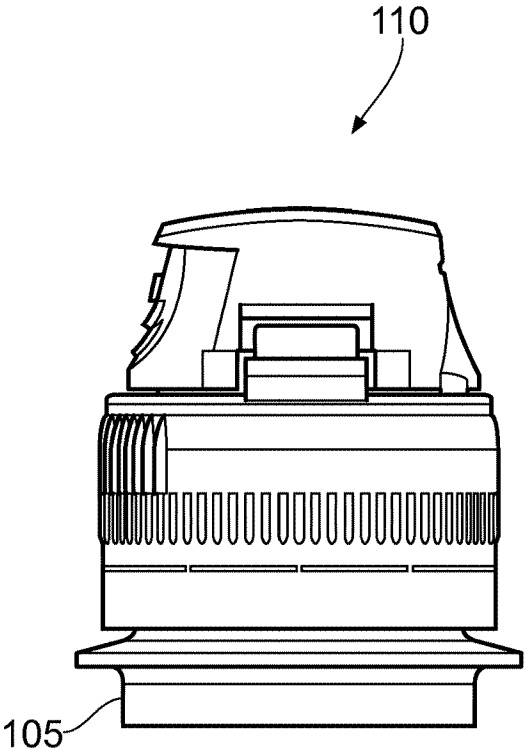
FIG. 14 is a side elevation of the closure of FIG. 13.
Figure 13:
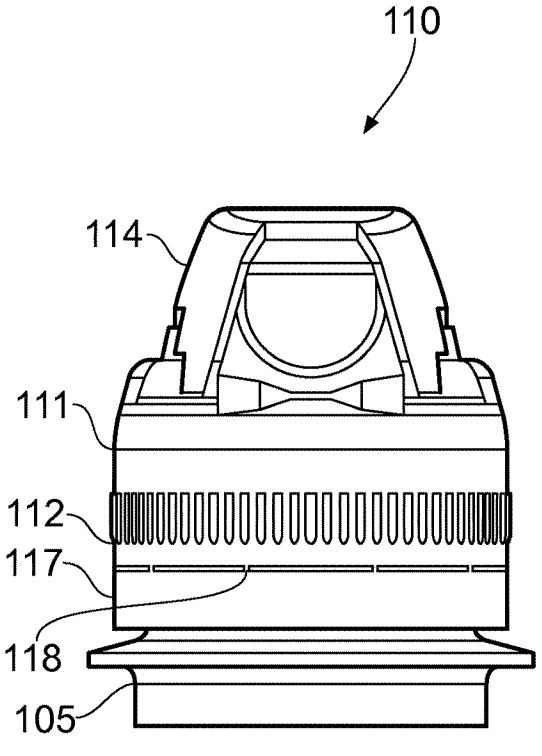
FIG. 13 is a rear elevation of a closure formed according to an aspect of the present invention.
Figure 16:
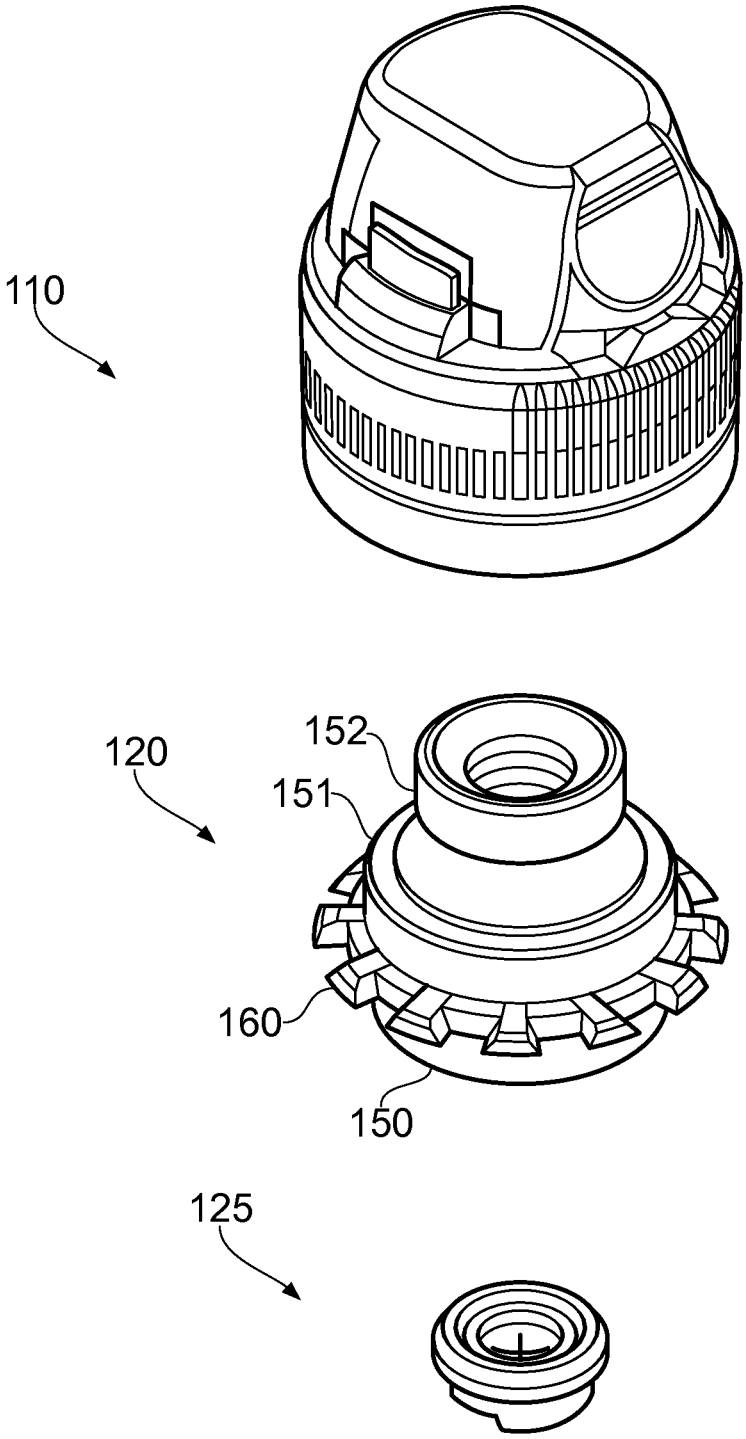
FIG. 16 is an exploded perspective view of the closure of FIG. 13.
Figure 17:
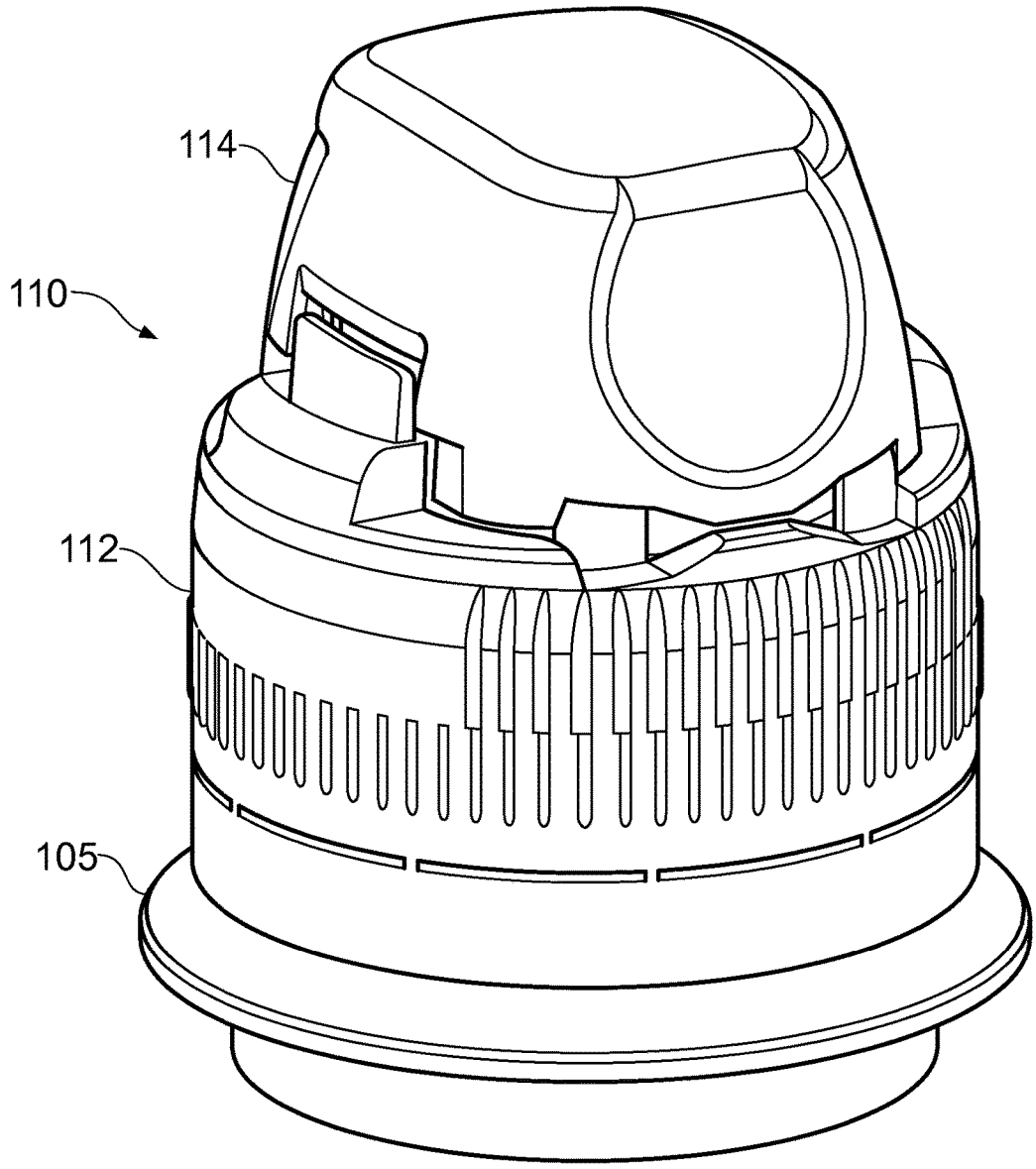
FIG. 17 is a rear perspective view of the closure of FIG. 13.
Figure 18:
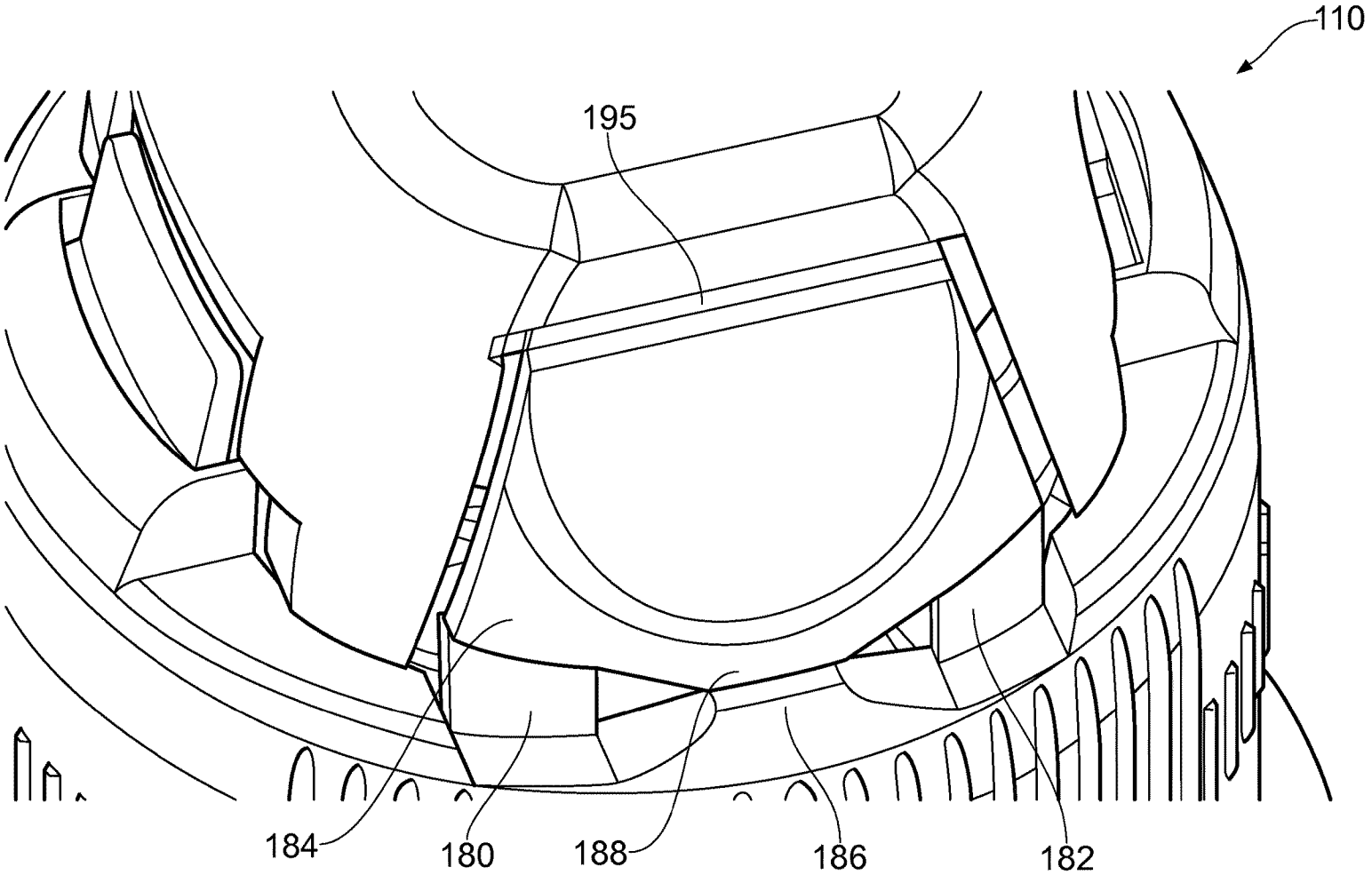
FIG. 18 is a magnified view of a hinge region of the closure of FIG. 17.
Figure 19:
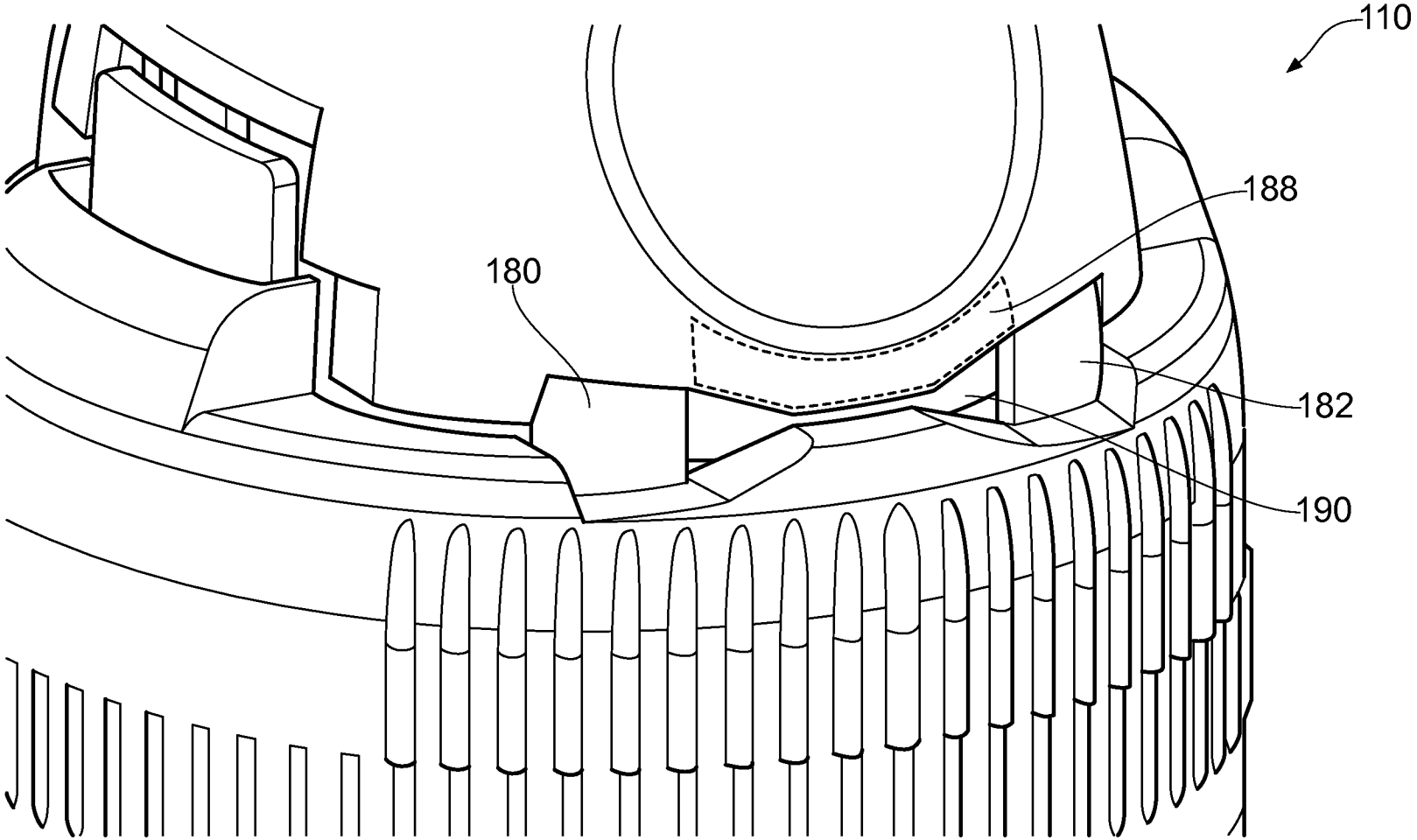
FIG. 19 is a magnified view of a first hinge forming part of the hinge arrangement of FIG. 18.
Figure 20:
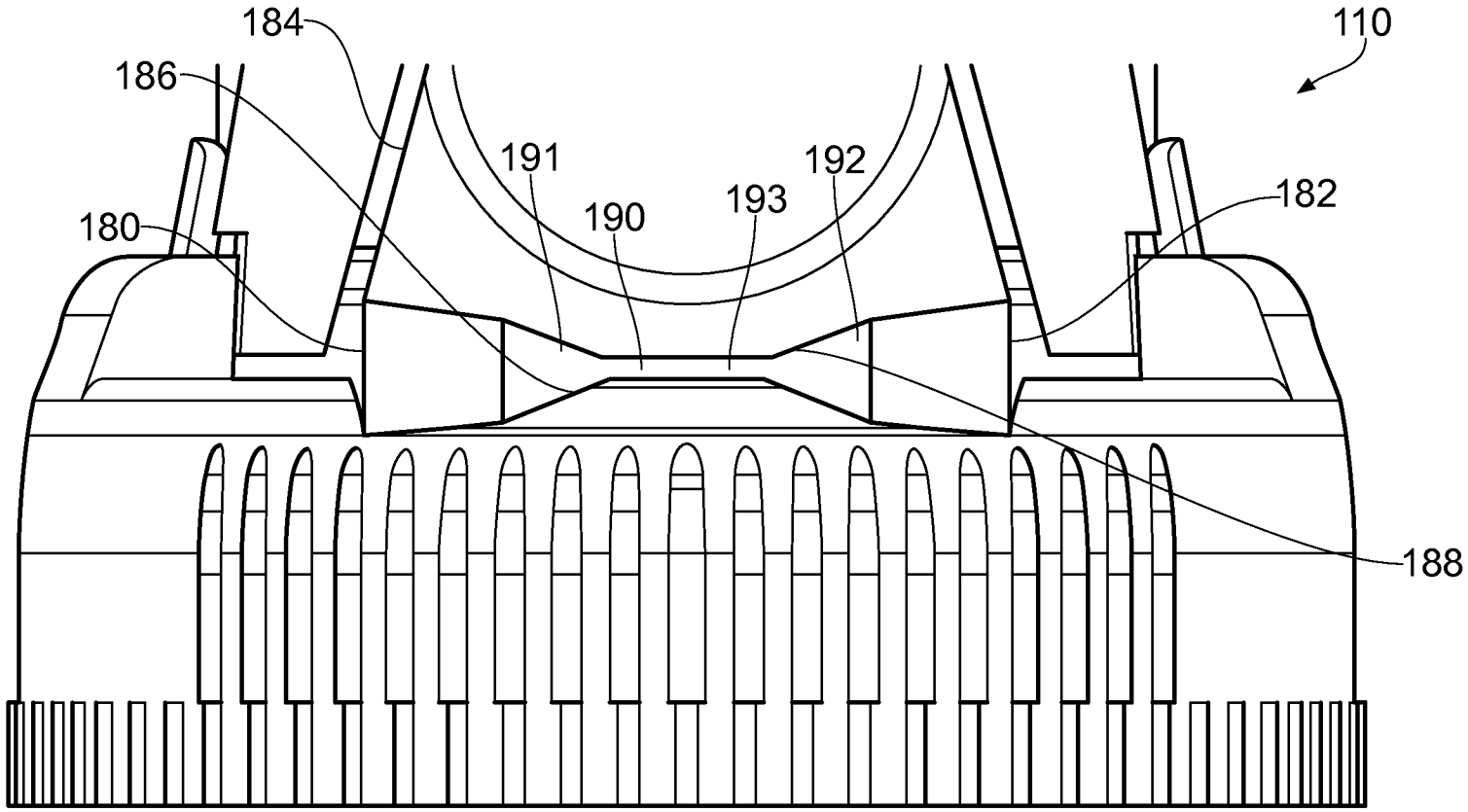
FIG. 20 is a rear view of the hinge of FIG. 19.

Referring now to FIGS. 13 to 23 there is shown a closure generally indicated 110 connected to a container neck finish 105. As illustrated in FIGS. 4, 10 and 11 the closure 10 comprises a body 111, a spout insert 120 and a self-closing valve assembly 125.

The body 111 comprises a base 112 and a lid 114.

The base 112 comprises a generally cylindrical side wall 116 having at one end a tamper-evident annular ring 117 connected thereto by a plurality of frangible bridges 118.

The side wall 116 terminates at its end opposite the band 117 with an annular shoulder 116*c* which extends radially inwards.

The generally turret-like lid 114 is connected to the free end of the shoulder 116*c* via a hinge arrangement generally indicated 132.

The interior of the base side wall 116 comprises internal screw thread formations 116*a* for engaging corresponding external screw thread formations on a container neck. The interior of the side wall 116 further comprises an annular retention bead 116*b*.

The interior of the band 117 comprises an annular retention bead 117*a* for engagement under a locking bead 106 on the container neck 105 so that if the closure is unscrewed the band will remain on a container neck.

The lid 114 comprises a top plate 134 from which depends a lid sidewall 135; a spigot 136 depends from the underside of the centre of the lid.

Opposite the hinge 132 the lid 114 includes a small peak 138 used to lift the lid and flip it open with respect to the base 112.

The spout 120 comprises a generally cylindrical lower portion 150, a generally cylindrical central portion 151 and a generally frusto conical upper portion 152.

The lower portion 150 comprises an annular external sealing bead 156. In use, the sealing part 154 enters the bore of the container neck such that the sealing bead 156 seals against its inner surface.

The central retention portion 151 comprises a plurality of radially outwardly extending retention spokes 160.

The upper portion 152 comprises a curved, generally frusto conical outer surface defining a spout. At the end of the spout side wall opposite the central portion 151 is a cylindrical terminal portion 170. An annular orifice wall 172 extends inwards from the free end of the portion 170 and defines an orifice 174. The wall 172 includes a depending annular projection 173. An annular retention bead 176 depends internally from the base of the terminal portion.

The self-closing valve assembly 125 comprises a body 126 and a valve 127. This structure is itself known from the Applicant's International Patent Application No PCT/EP2005/053917. The valve body 125 includes a retention bead 128 which clips over the spout retention bead. The valve assembly 125 is received between the retention bead 176 and the annular wall projection 173.

The spout 120 is received into the body 115. The retention spokes 160 engage over the retention bead 116*b* so that the spout is held firmly in position. The spigot 136 enters the orifice 174.

With the insert 120 in position slots are formed between the spokes 160 of the central portion 151 and the side wall 116.

If fluid is sprayed at the closure 110, it may enter the interior of the closure via the hinge line interface between the lid 114 and the base 112. If this happens, the fluid can pass between the spokes/ribs 160 and then between the closure and container screw threads and out at the bottom of the side wall 116. This means that there is an unobstructed drainage path for fluid to follow if it enters the closure. It may be necessary to force fluid through the drainage path, for example by blowing air at the closure.

The hinge arrangement 132 comprises a pair of generally trapezoidal straps 180, 182 which link the base to a generally trapezoidal hinge panel 184. Between the straps 180, 182 the base includes an elongated trapezoidal upstand 186 and the panel 184 includes a mirror image deformable projection/region/section 188. The projections 186, 188 are separated by a gap 190 which has a resultant generally dumbbell-shape configuration having two generally triangular openings 191, 192 joined by a thin rectangular opening 193.

At the opposite end of the hinge panel 184 a generally linear material thinning line 195 provides a secondary hinge line 195.

Figure 22:
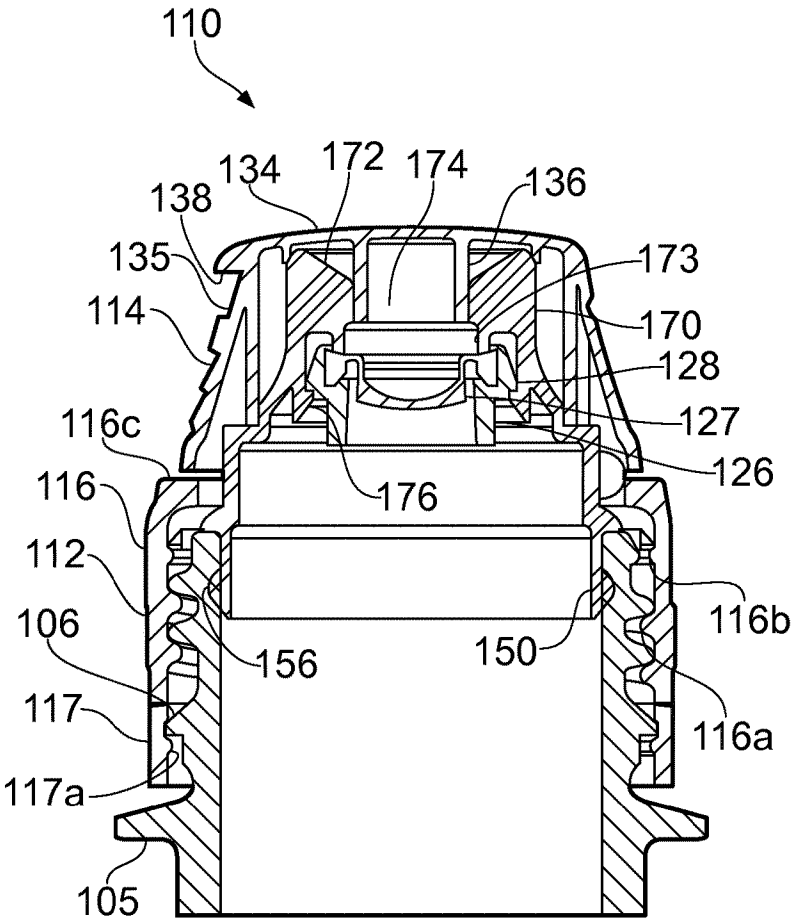
FIG. 22 is a section of the closure of FIG. 21 taking along Line A-A.
Figure 21:
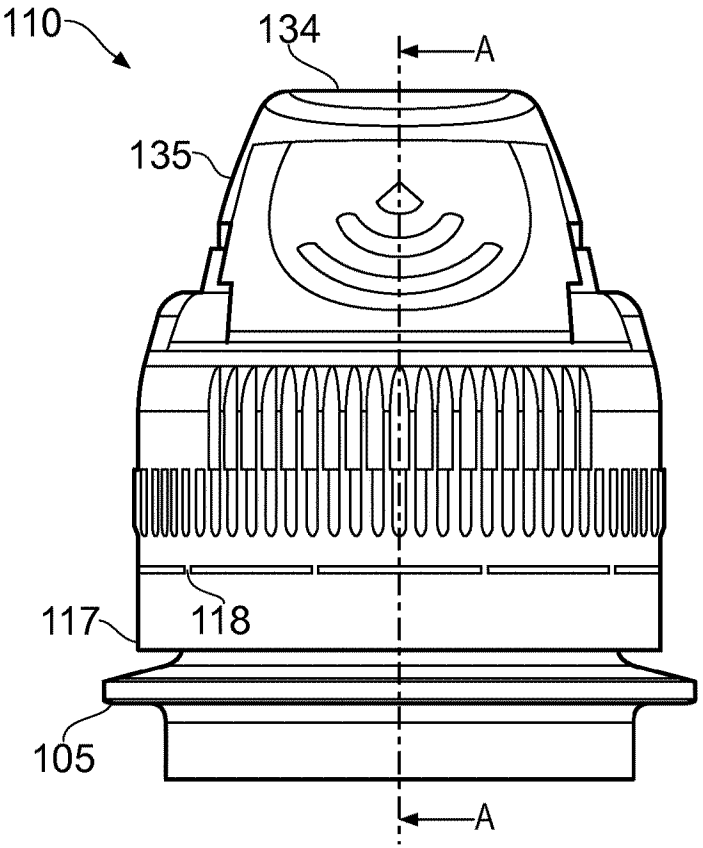
FIG. 21 is a front elevation of the closure of FIG. 13.
Figure 23:
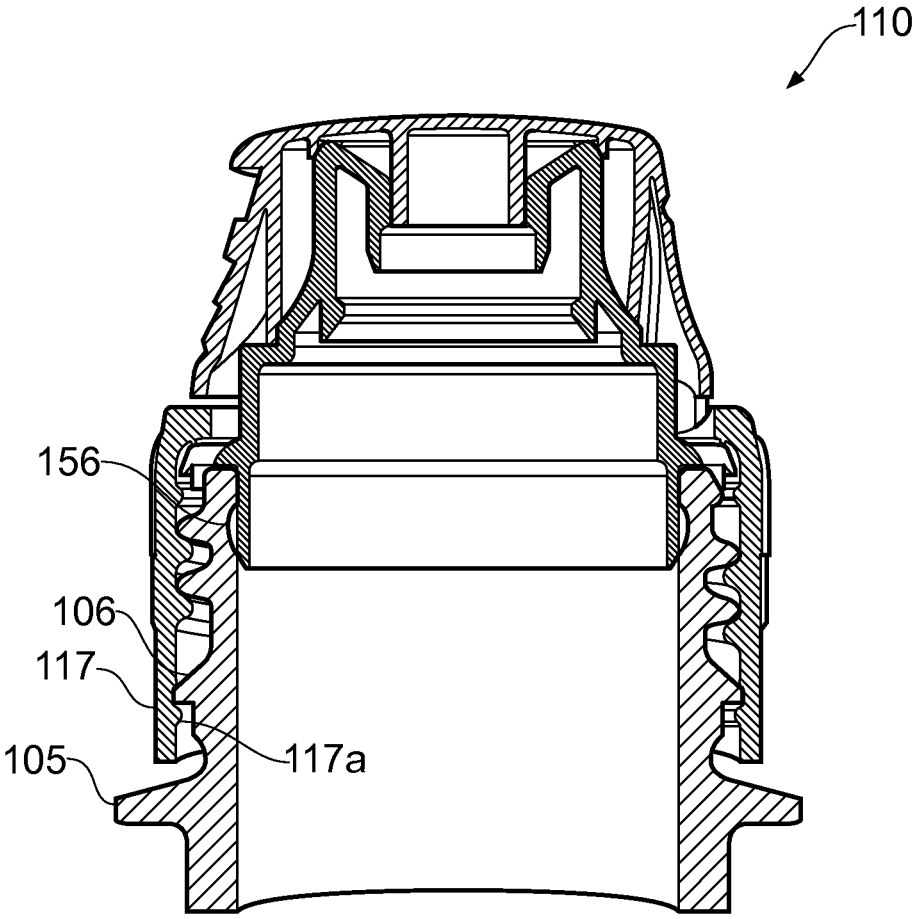
FIG. 23 is a solid section of the closure of FIG. 22.
Figure 24:
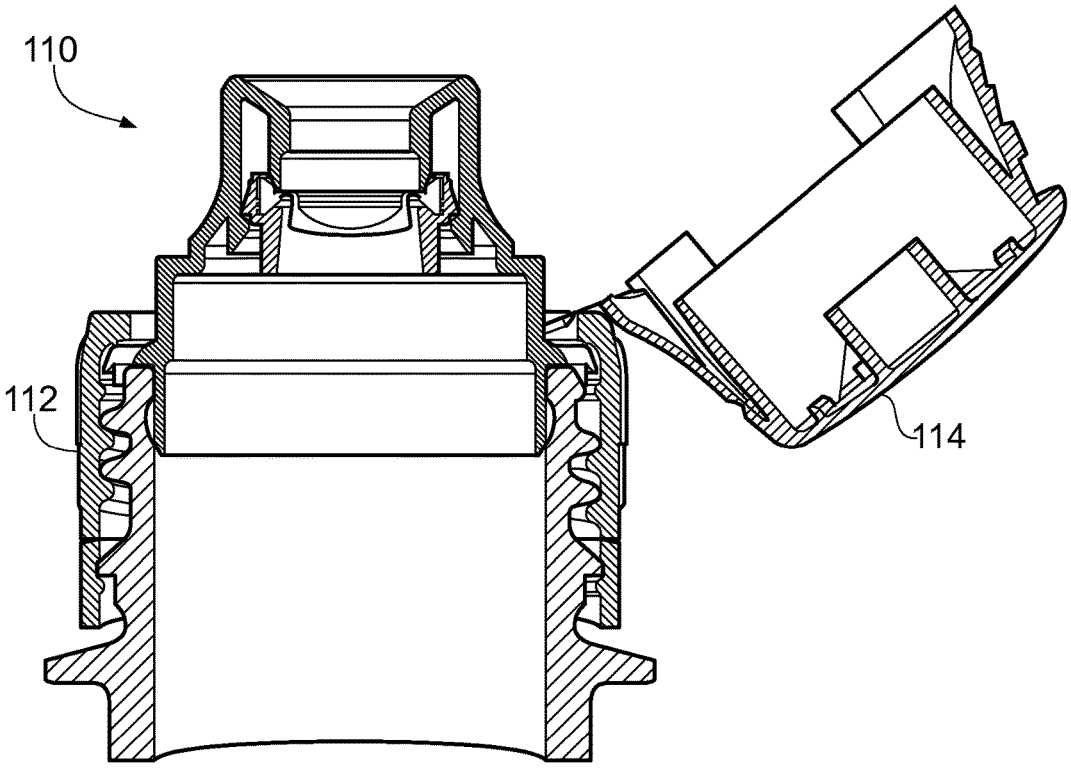
FIG. 24 is a section of the closure of FIG. 23 with the lid open approximately 140 degrees.
Figure 25:
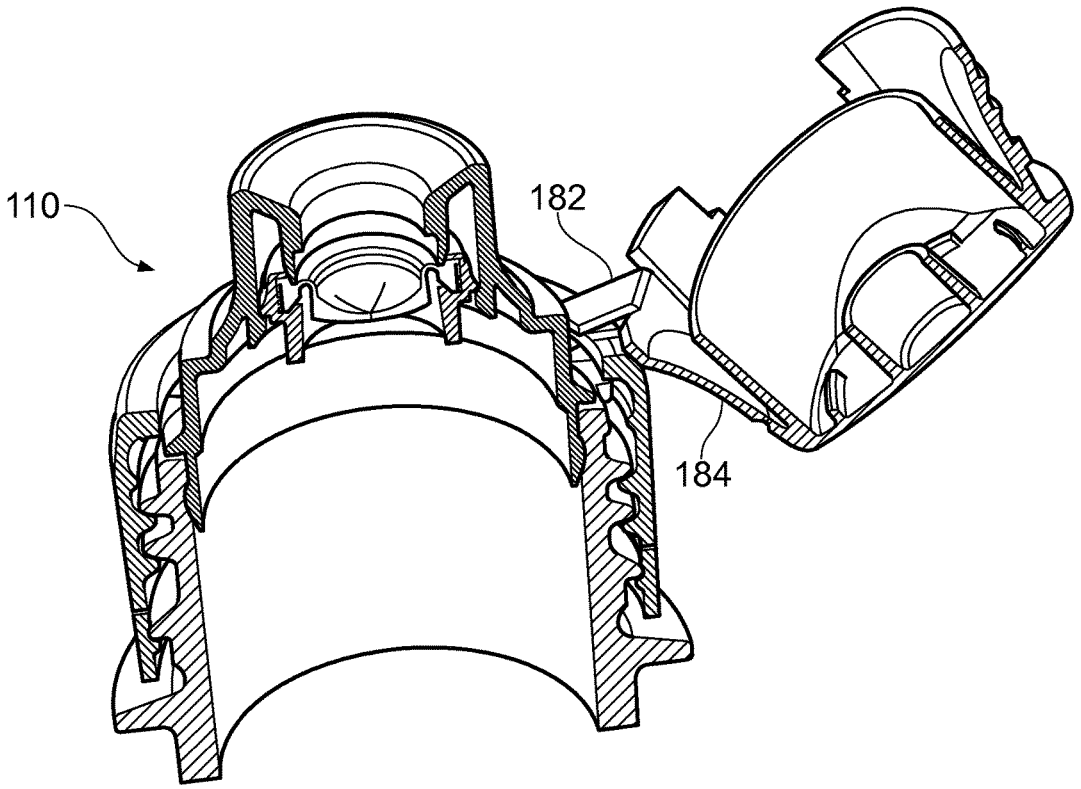
FIG. 25 is a perspective sectional view of FIG. 24.
Figure 26:
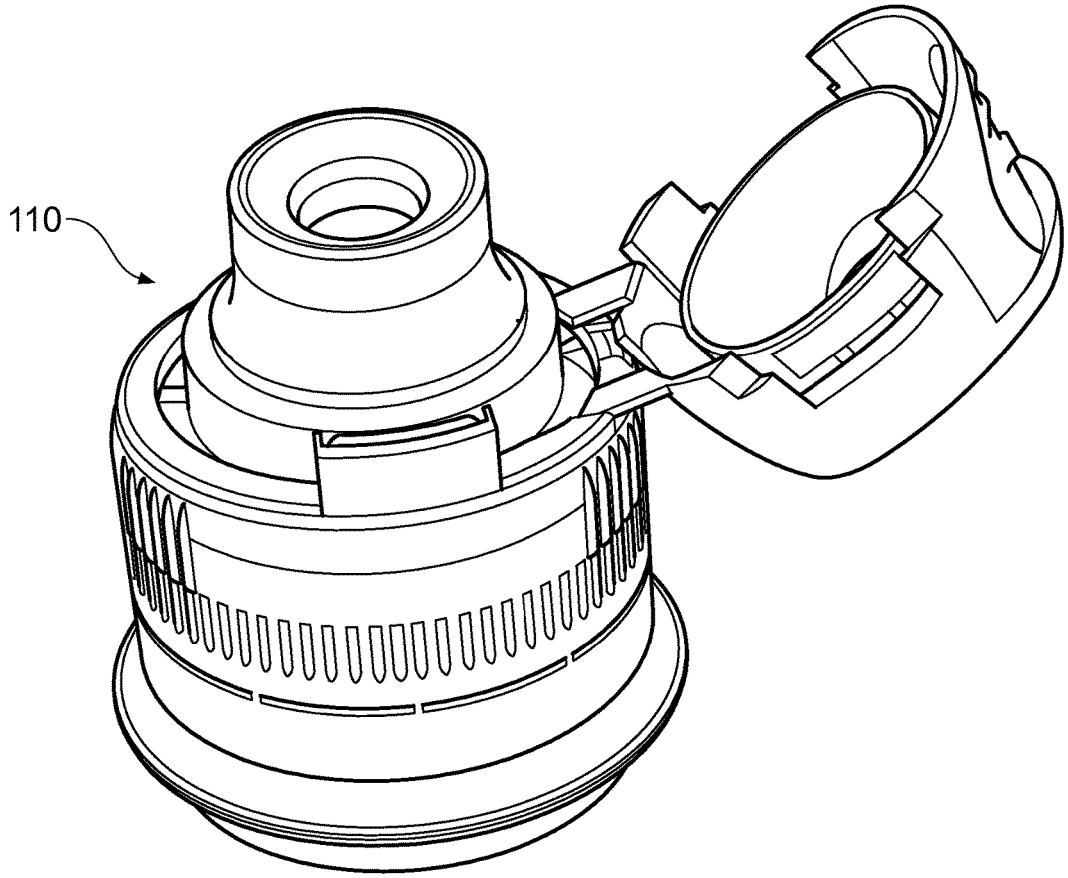
FIG. 26 is a perspective view of the closure of FIGS. 24 and 25.
Figure 27:
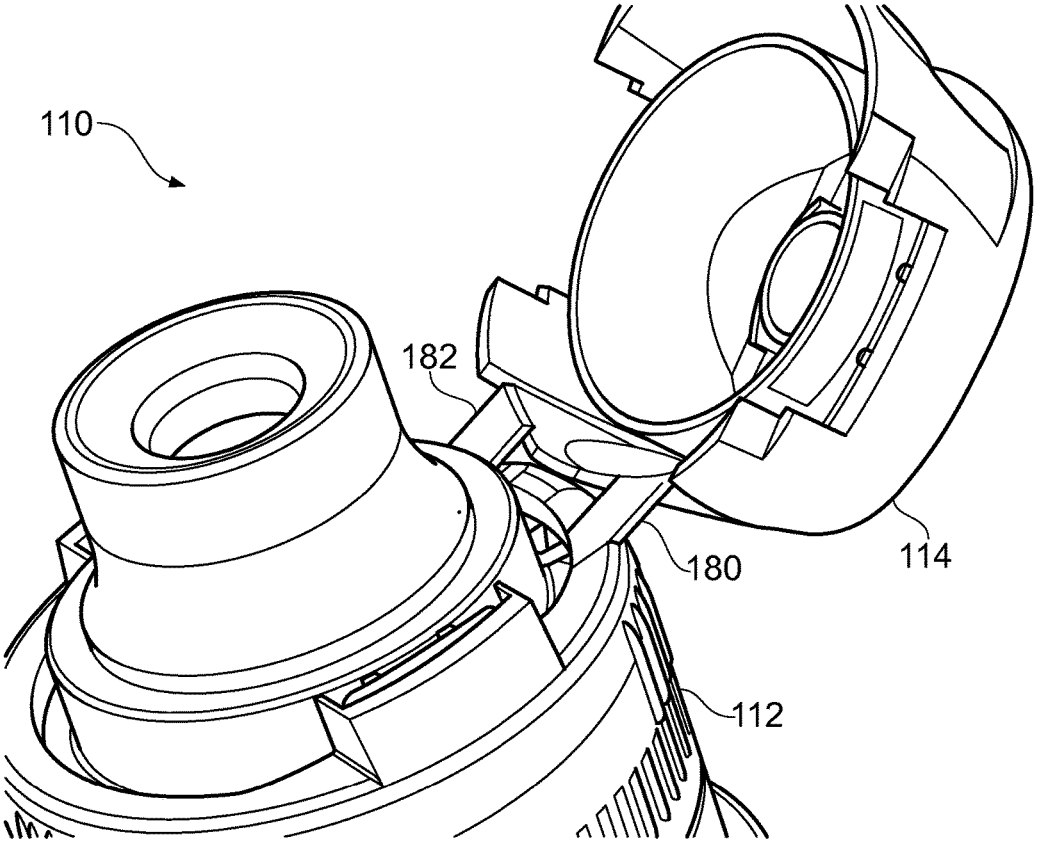
FIG. 27 is a magnified view of the hinge region of the closure of FIG. 26.
Figure 28:
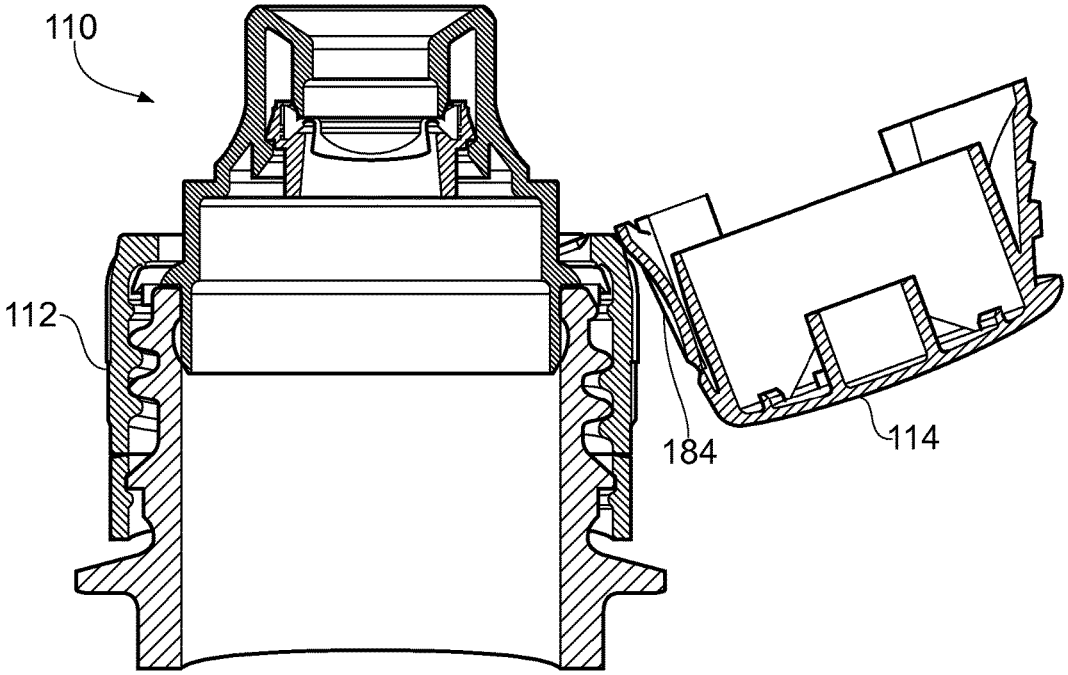
FIG. 28 is a section of the closure of FIG. 23 with the lid shown open approximately 160 degrees.
Figure 29:
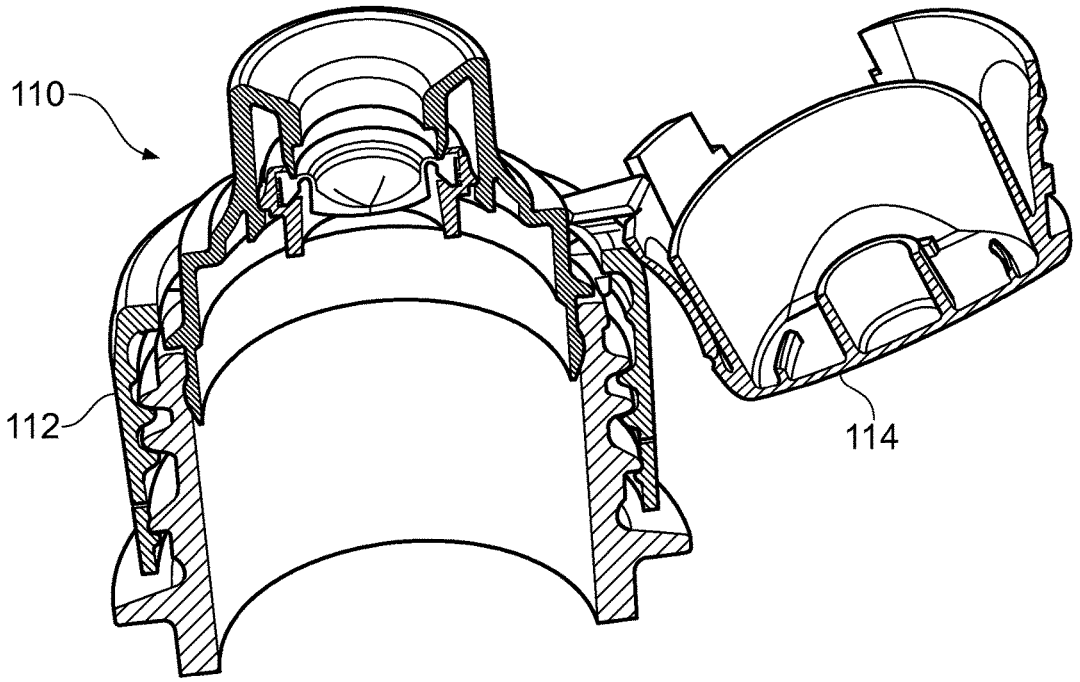
FIG. 29 is a perspective sectional view of the closure of FIG. 28.
Figure 30:
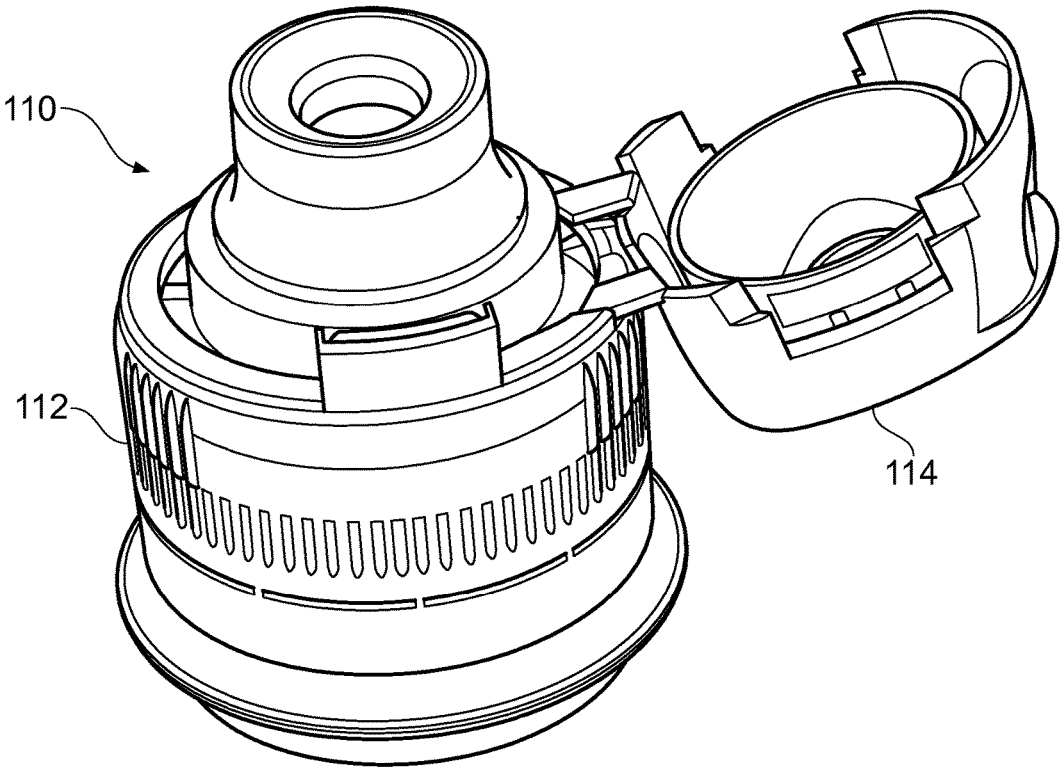
FIG. 30 is a perspective view of the closure of FIGS. 28 and 29.
Figure 31:
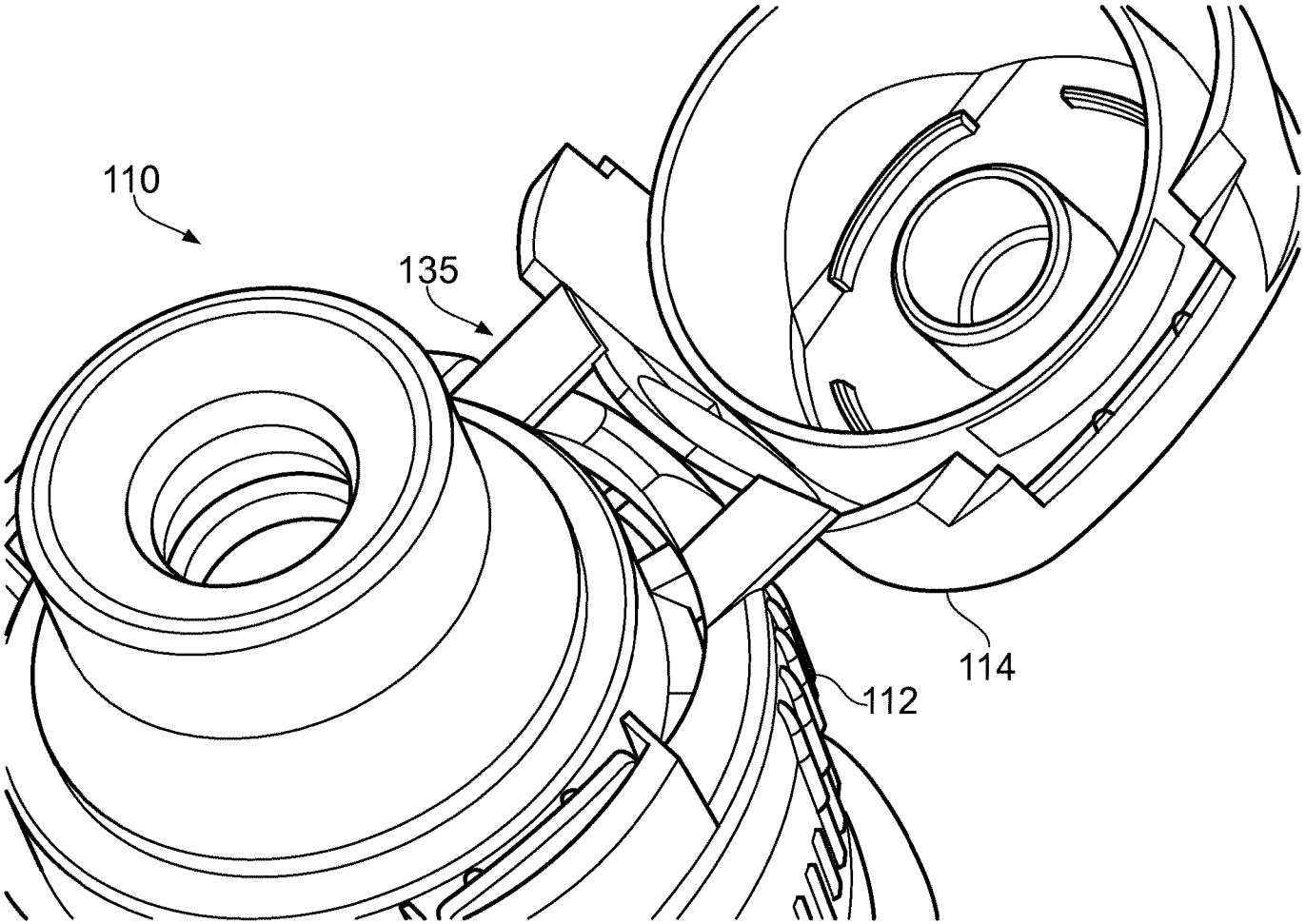
FIG. 31 is a magnified view of the hinge region of the closure of FIG. 30.
Figure 32:
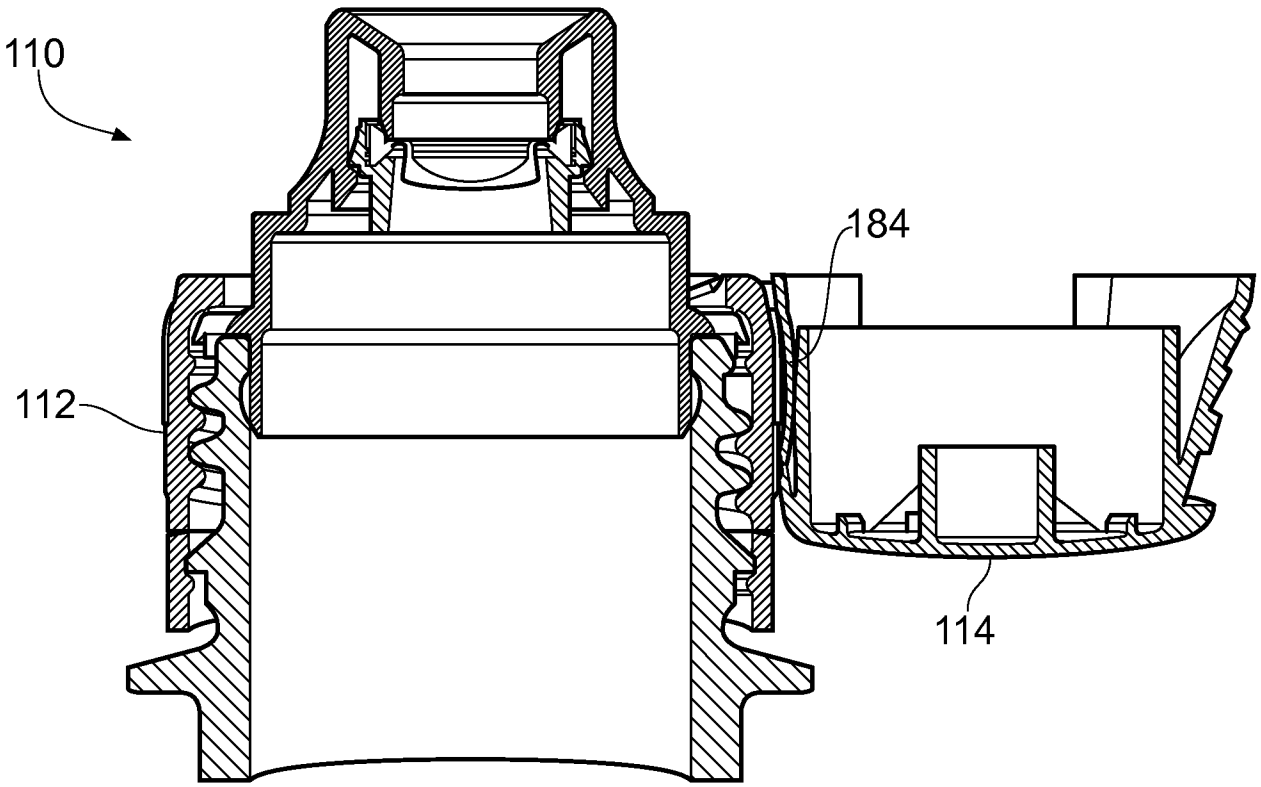
FIG. 32 is a section of the closure of FIG. 23 with the lid shown open at approximately 180 degrees.
Figure 33:
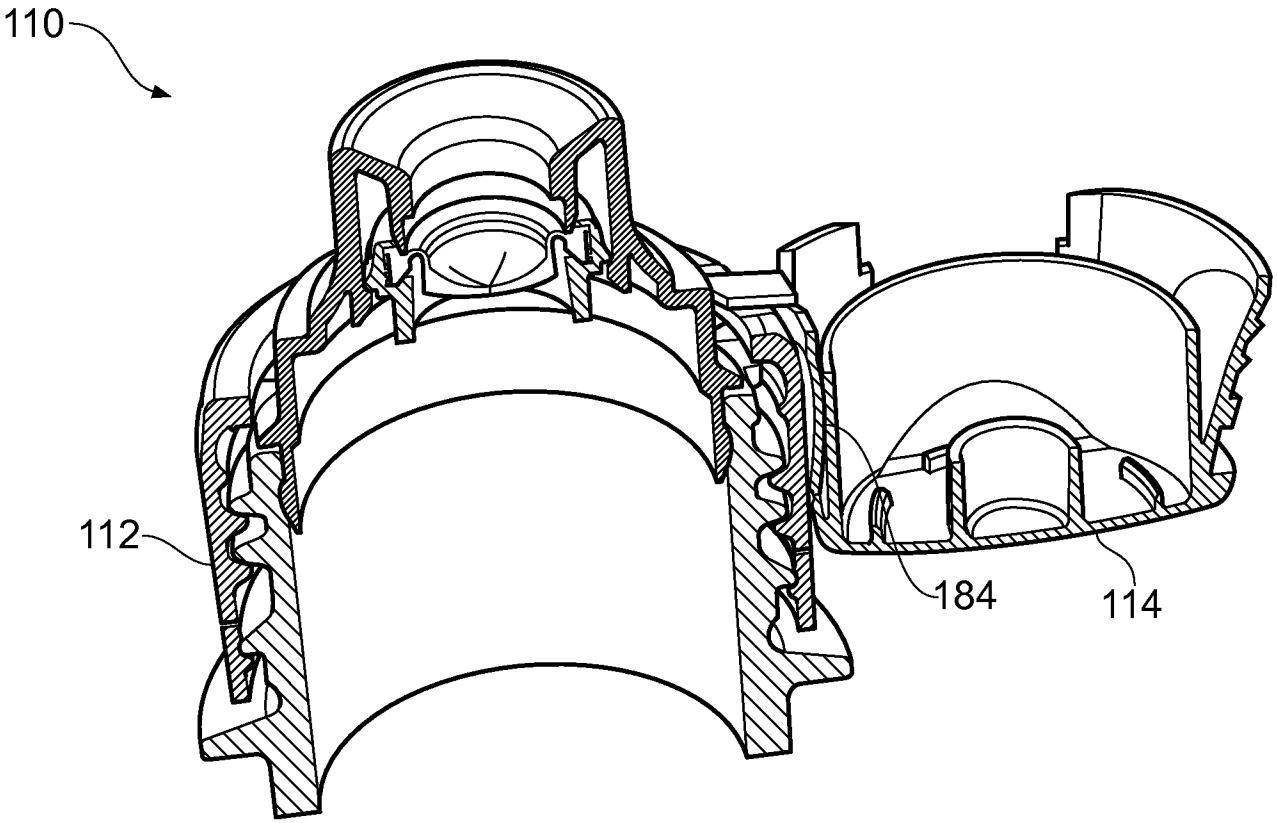
FIG. 33 is a perspective sectional view of the closure of FIG. 32.
Figure 34:
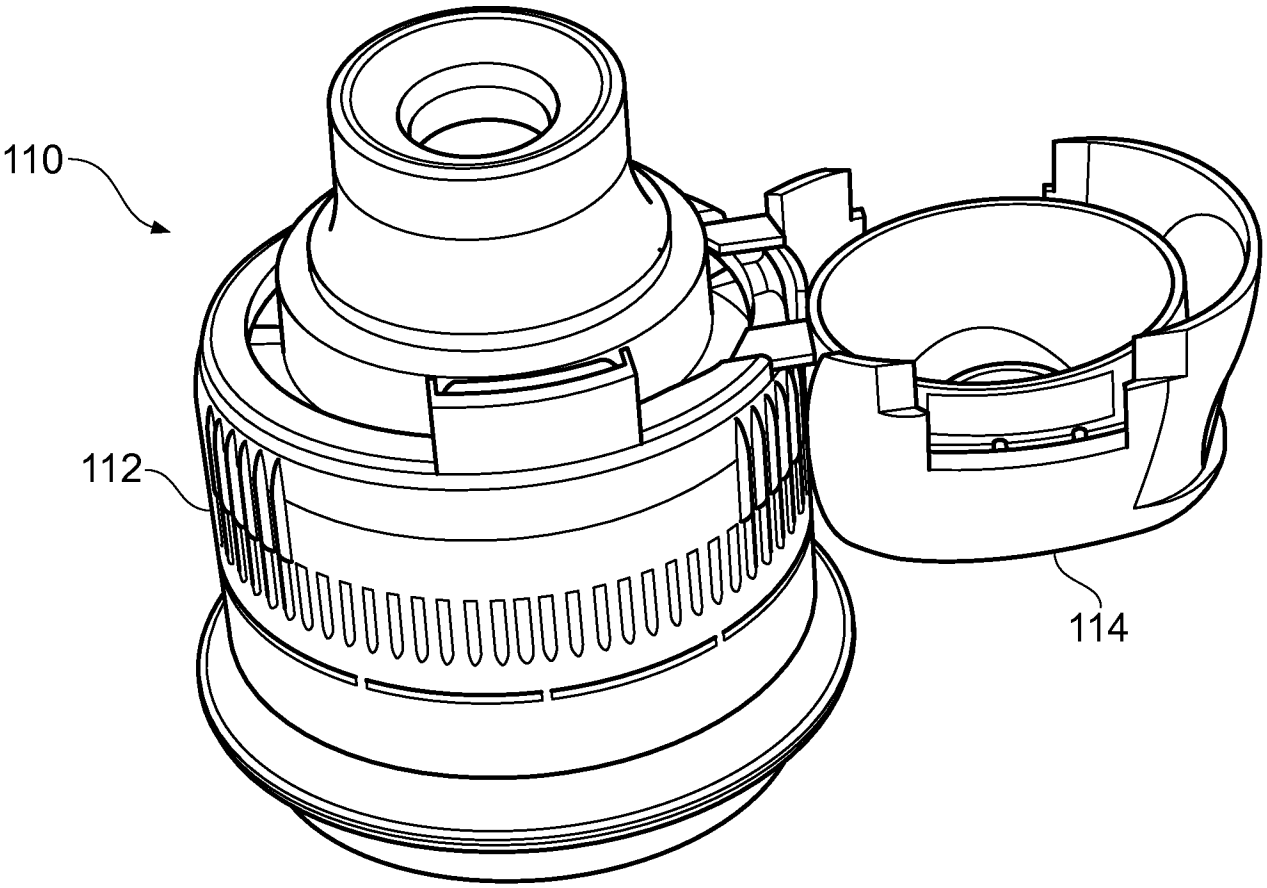
FIG. 34 is a perspective view of the closure of FIGS. 32 and 33.
Figure 35:
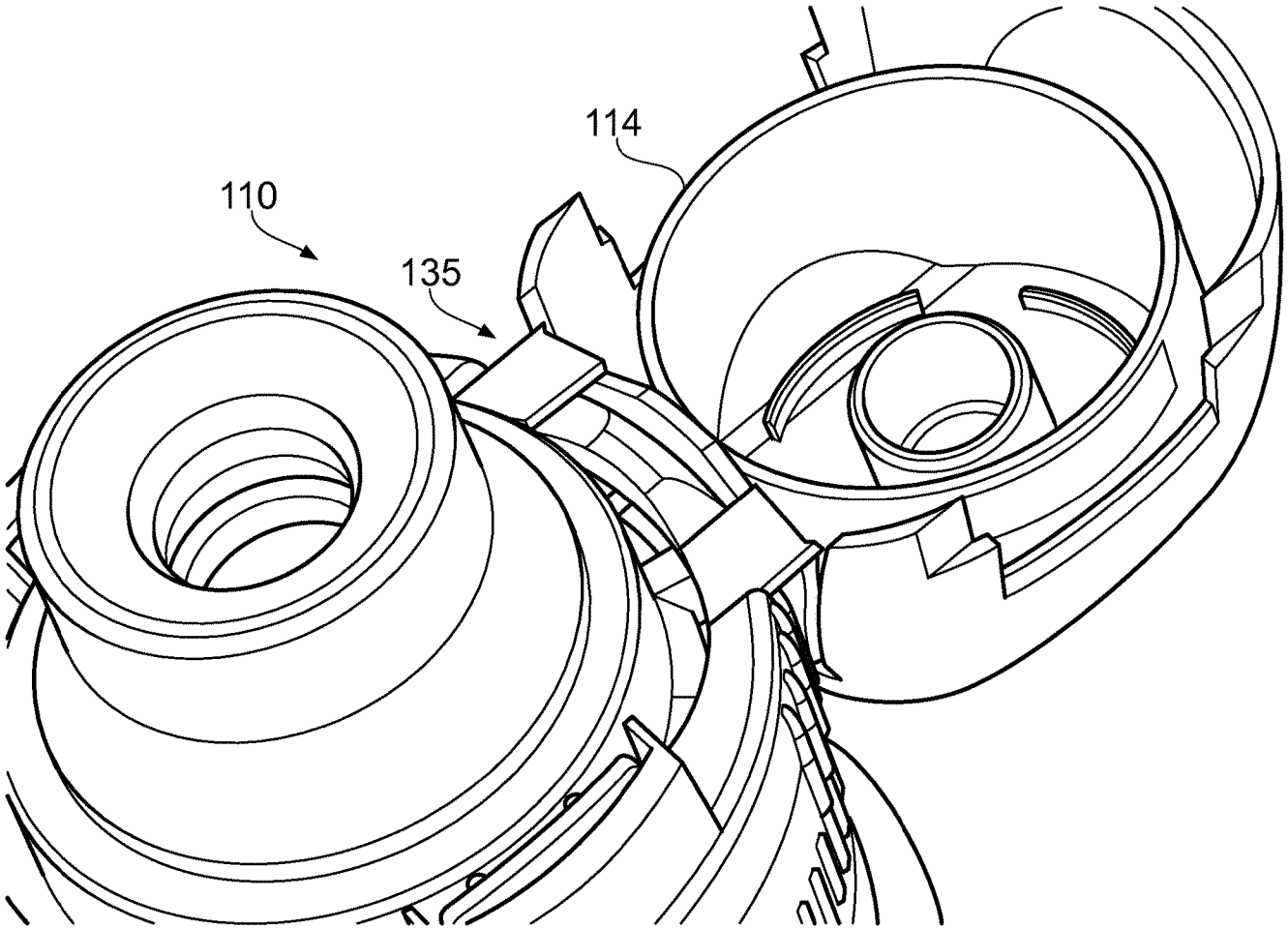
FIG. 35 is a magnified view of the hinge region of the closure of FIG. 34.
Figure 36:
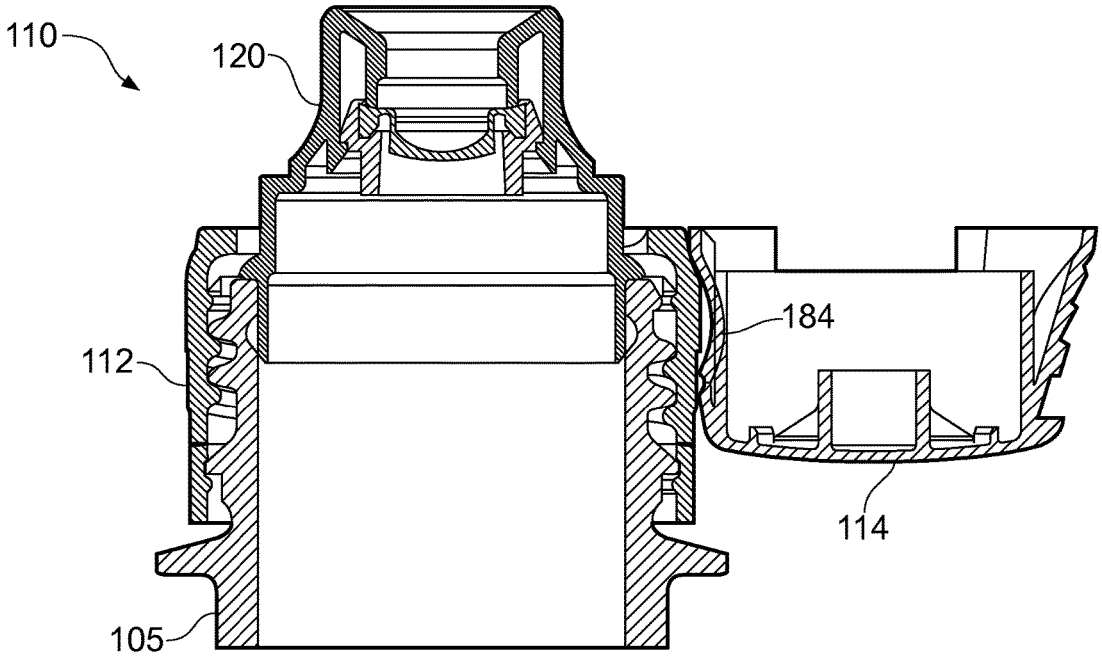
FIG. 36 is a sectional line drawing of the closure of FIGS. 32 to 35.

In FIGS. 21 to 23 the closure 110 is shown in the closed position. When a user desires to drink from the spout they grasp the lid and flip it open using the peak.

In FIGS. 24 to 27 the lid is shown in an intermediate position in which the lid has been rotated approximately 140 degrees away from the base. The lid articulates with respect to the base by the links 180, 182. In the position shown the hinge panel projection 188 region (shown best in FIG. 19) begins to contact the shoulder of the lid.

In FIGS. 28 to 31 the lid is shown rotated further, to approximately 160 degrees. The panel 184 starts to roll onto the shoulder.

At approximately 170 degrees the panel projection 188 is deformed by the base, with a clicking sound accompanying the flip/snap from the generally convex to a concave configuration.

In FIGS. 32 to 36, the closure is shown fully open. The panel projection 188 has been deformed and passes from a generally convex to a generally concave configuration. The deformation of the panel section 188 places the straps 180, 182 under stress and this holds the lid in the open position. It is noted that the fully open position is facilitated by the secondary hinge 195, which allows the lid to articulate further than if only the straps 180, 182 were present.

The user can now access the spout freely and unencumbered by the lid.

The lid can be returned to the closed position by overcoming the forces present in the panel section and the links. The hinge arrangement returns to its original, unstressed state, ready to be opened once again when required.

Tamper-evident features suitable for use with closures of the present invention, for example in FIGS. 1 to 12 and FIGS. 13 to 36, are now described in more detail in relation to different closures.

Figure 37:
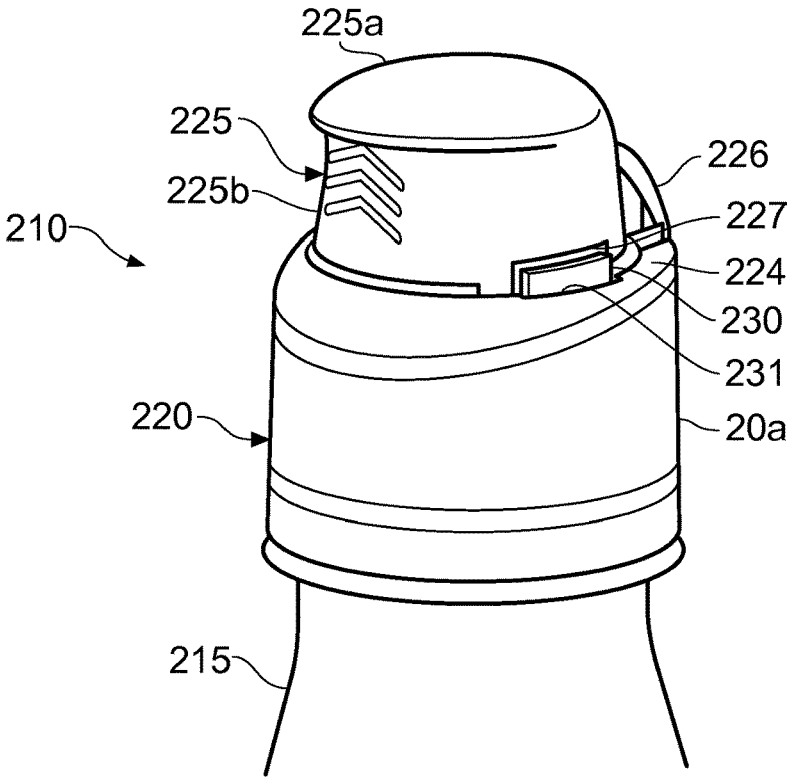
FIG. 37 is a perspective view of a closure formed according to a first embodiment of an aspect of the present invention and shown in an unopened state.

Referring first to FIG. 37 there is shown a tamper-evident closure generally indicated 210. The closure 210 is intended for attachment to the neck 215 of a container.

The closure 210 comprises a base 220 and a lid 225 which together comprise a closure body. The lid 225 is connected to the base 220 by a hinge 226.

The base 220 comprises a cylindrical skirt 220*a* which is open at both ends. At the end of the skirt 220*a* adjacent the lid 225 a flange 224, or top or upper surface 224 of the base 220 extends radially inward.

The lid 225 comprises an upturned cup-shape body having a top plate 225*a* and a side skirt 225*b* depending from the periphery of the top plate 225*a*.

The skirt 225*b* is co-axial and concentric with the base skirt 220*a*. The flange 224 reduces the diameter of the base 220 to match the lid. Accordingly the flange 224 comprises an inward step.

The base 220 is provided with a tamper-evident tab 230. The tab 230 is shown in an upstanding position in which it is in register with a window 227 formed as a cut-out at the base of the lid skirt 225*b*.

The tab 230 is positioned at the mouth of a pocket 231 formed in the flange 224. The tab 230 is held in place by two frangible bridges (not shown). One bridge connects the tab 230 to the base 220 and the other connects the tab to the lid 225.

Figure 38:
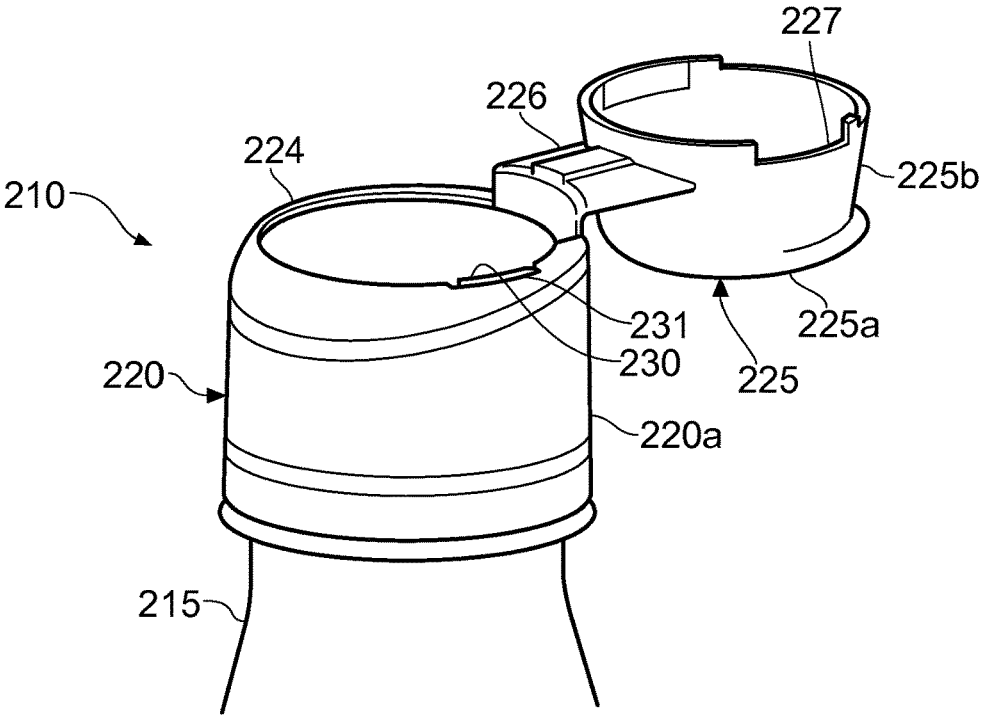
FIG. 38 is a perspective view of the closure of FIG. 37 shown in an opened position.

In order to open the closure 210 the lid 225 is hinged to the position shown in FIG. 38 away from the base 220. When the lid is moved both of the frangible bridges are broken. The tab 230 is released into the pocket 231 where it is retained as shown in FIG. 38.

Figure 39:
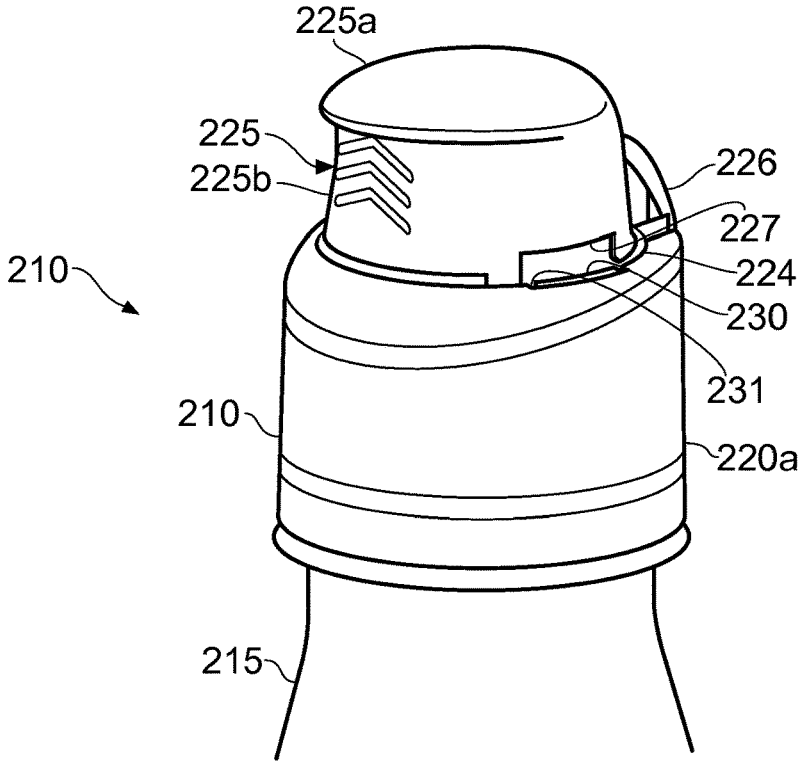
FIG. 39 is a perspective view of the closure of FIG. 38 shown re-closed.
Figure 40:
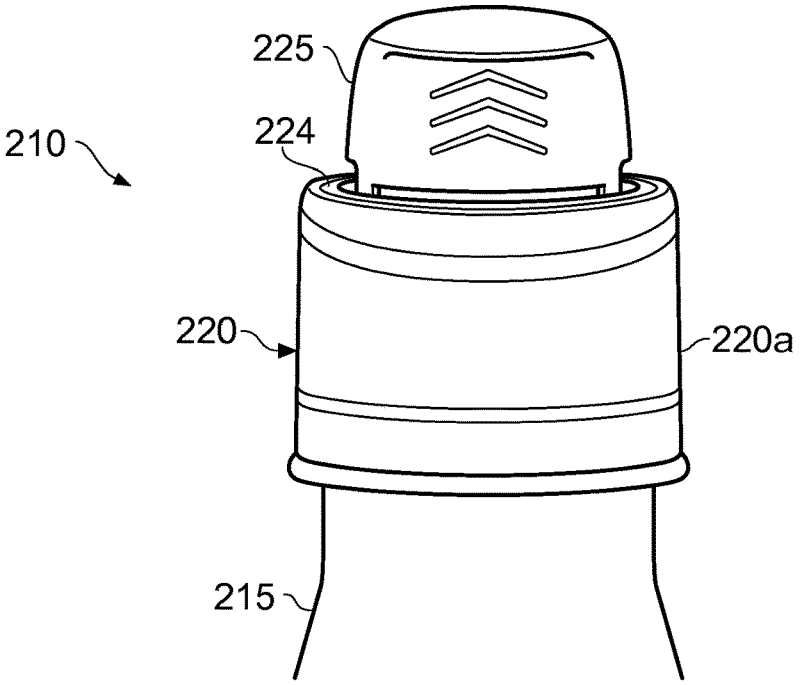
FIG. 40 is a front elevation of the closure of FIG. 39.

When the lid 225 is returned to the closed position as shown in FIGS. 39 and 40 the window 227 of the lid 225 is no longer masked by the tab 230 because the tab is hidden from sight and so provides visible evidence that the closure has been opened.

The closure 210 may include a dispensing member (not shown) which would be visible through the window 227.

Figure 41:
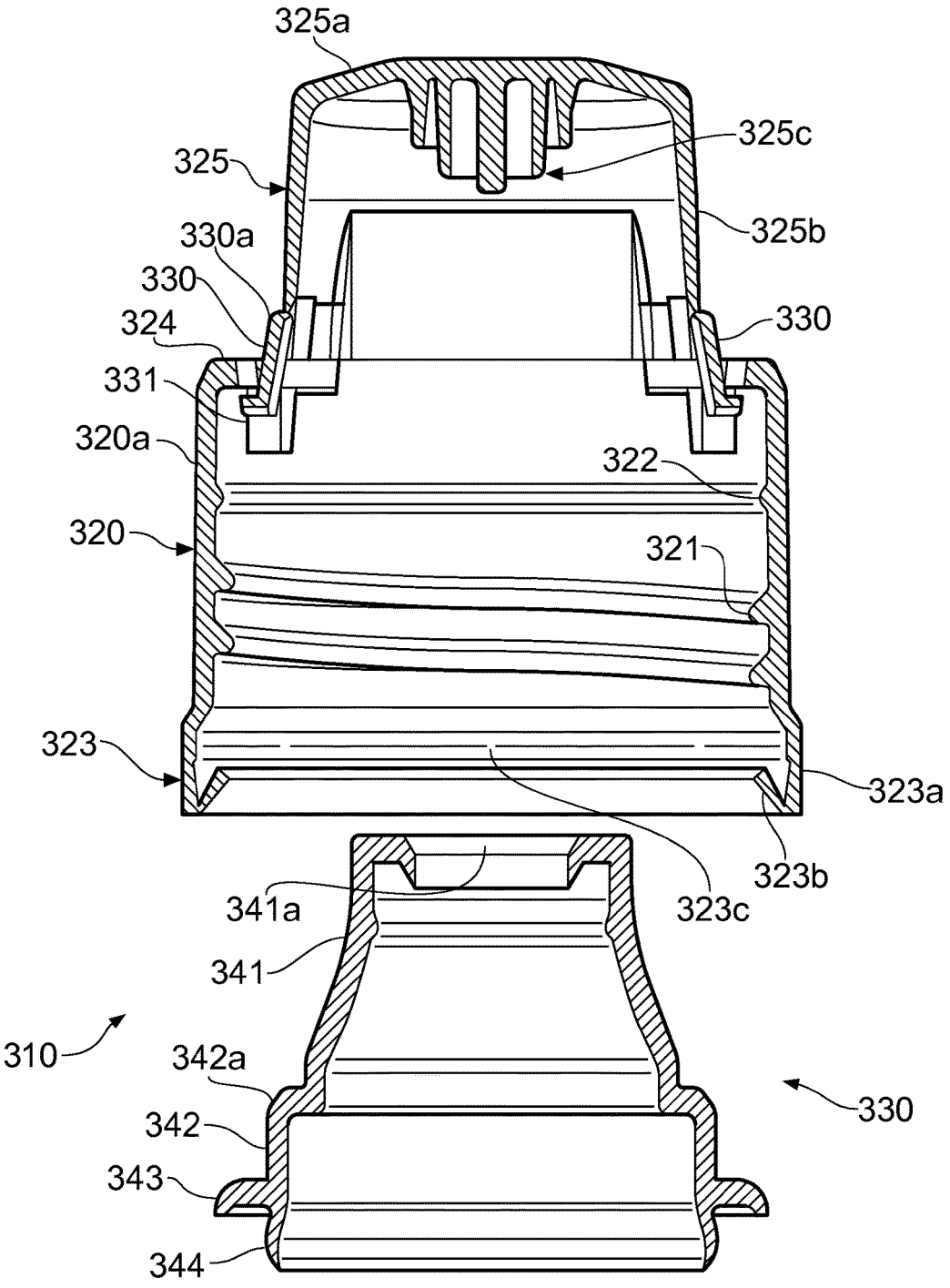
FIG. 41 is a section of a closure formed according to an alternative embodiment and illustrating a closure body and a spout prior to assembly.

Referring now to FIG. 41 there is shown a closure 310 according to a second embodiment.

Figure 47:
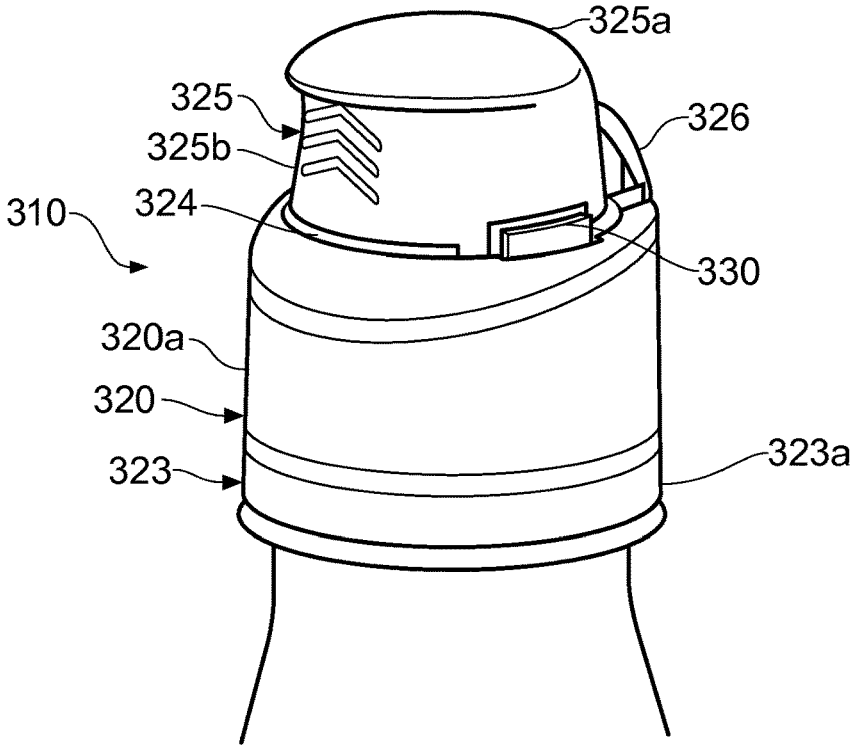
FIG. 47 is a perspective view of the closure of FIG. 44 prior to first opening.
Figure 48:
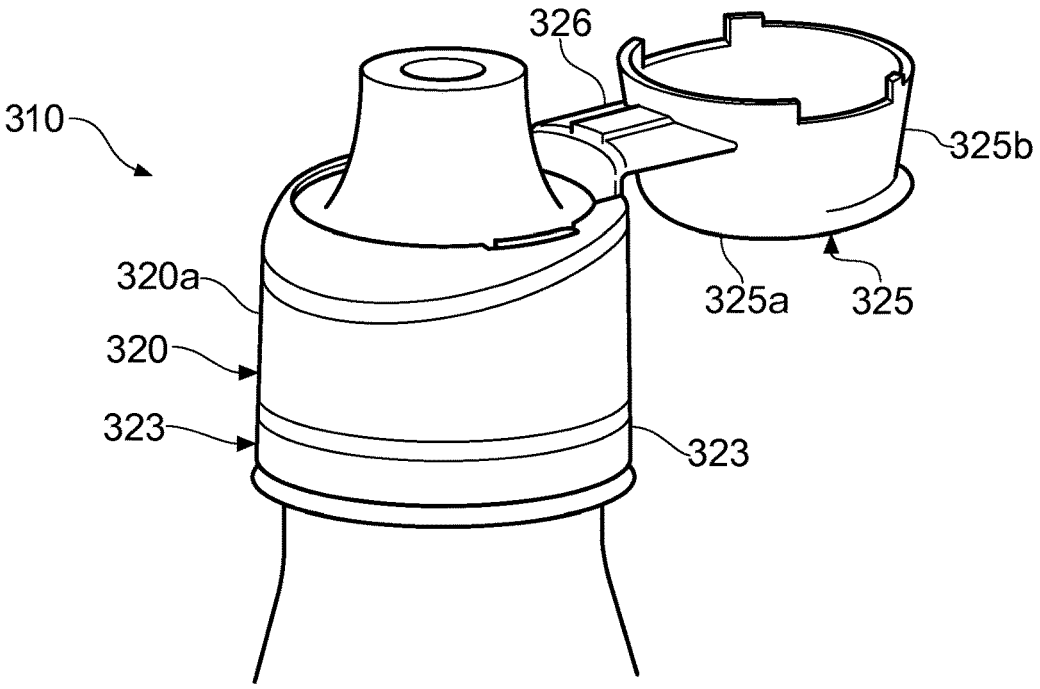
FIG. 48 is a perspective view of the closure of FIG. 47 shown opened.
Figure 49:
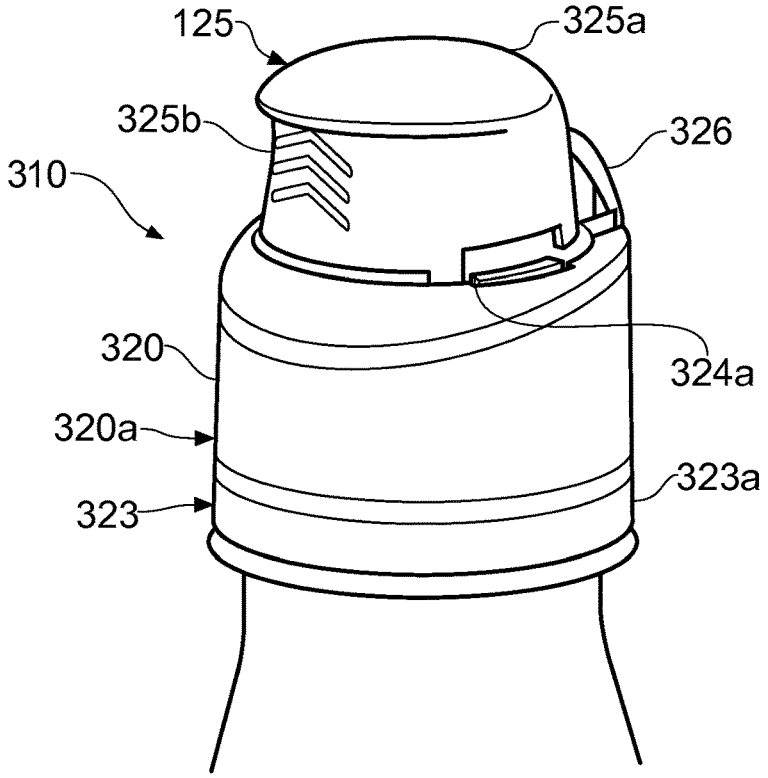
FIG. 49 is a perspective view of the closure of FIG. 48 shown re-closed.
Figure 50:
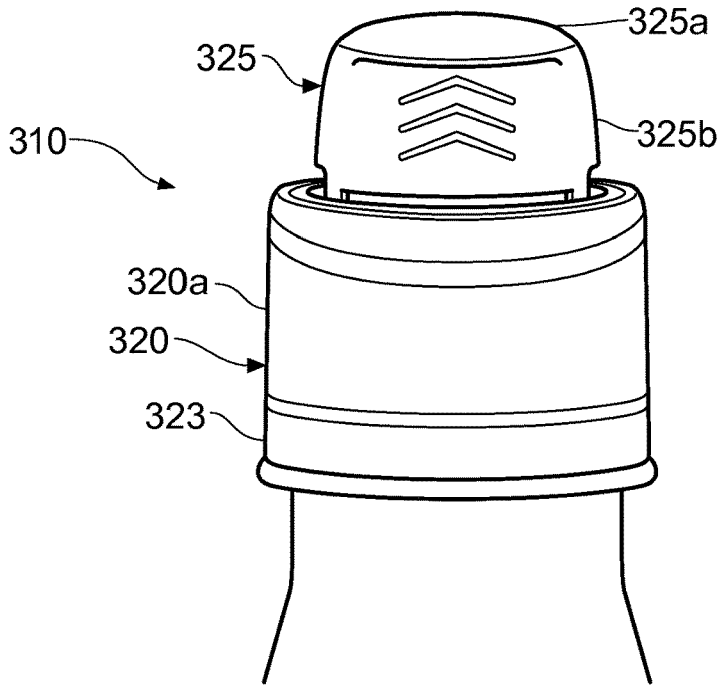
FIG. 50 is a front elevation of the closure shown in FIG. 49.
Figure 51:
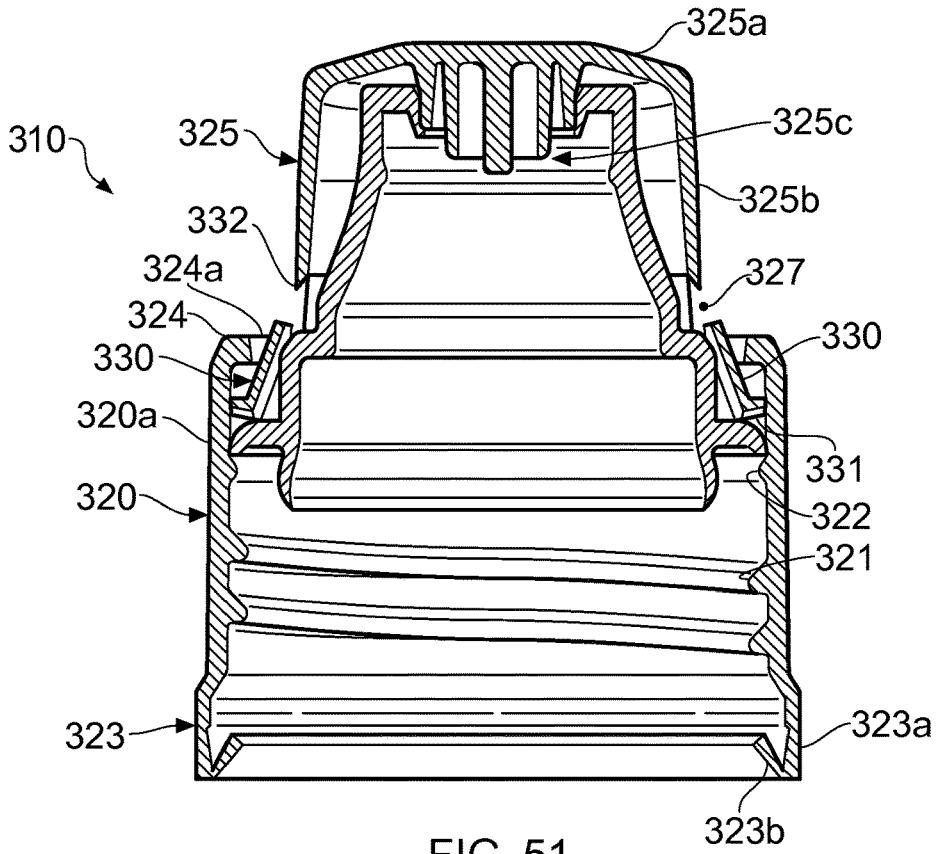
FIG. 51 is a section of the closure shown in FIG. 50.
Figure 52:
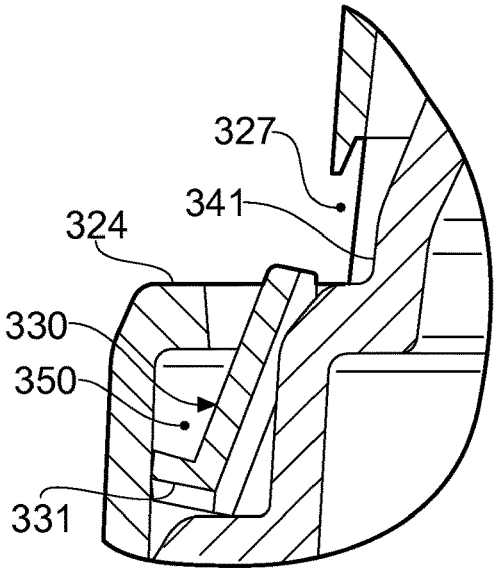
FIG. 52 is a magnified view of the region of the tamper-evident member of the closure shown in FIG. 51.
Figure 53:
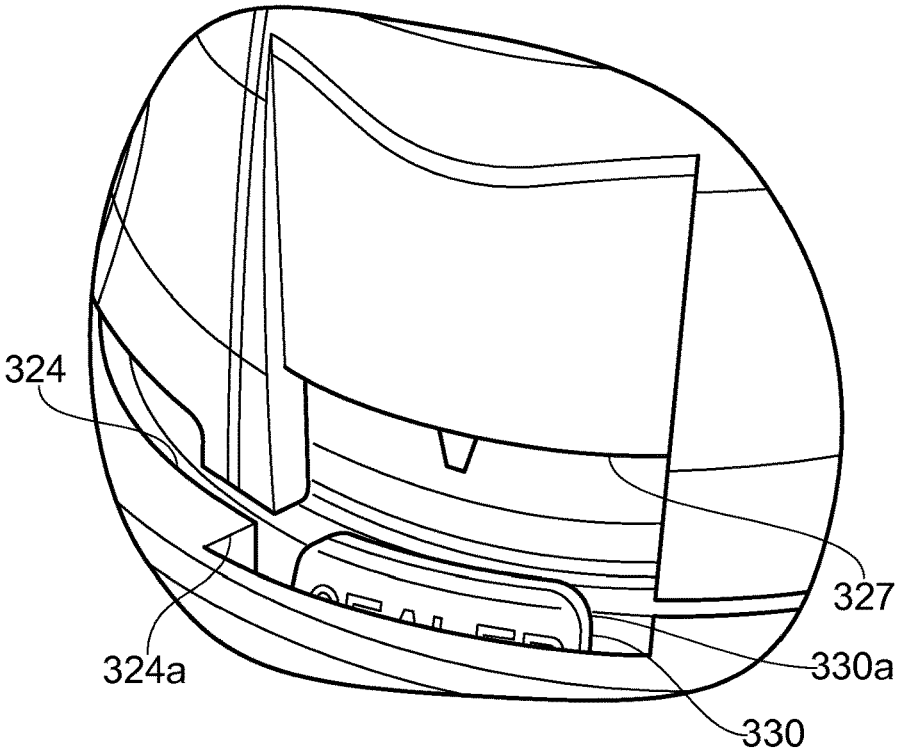
FIG. 53 is a perspective view of the magnified region of FIG. 52.

The closure 310 includes a base 320 and a lid 325 which are connected together by a hinge (see FIGS. 47 to 49). Together the base and lid comprise a closure body.

The base 320 comprises a generally cylindrical skirt 320*a* with internal screw thread formations 321 and a retention bead 322 formed on its interior surface.

At one end of the base skirt 320*a* a tamper-evident drop band 323 is provided. The band 323 comprises an annular strip 323*a* with an upturned annular flap 323*b* at its free edge formed to engage under a retention bead of a container. The band 323*a* is connected to the lower end of the base 320 by frangible bridges 323*c*. At the other end of the skirt 320*a* a flange 324 extends radially inwardly to form a shoulder.

The lid 325 comprises a top plate 325*a* and a side skirt 325*b* which depends from the periphery of the skirt 325*b*. The underside of the top plate 325*a* is formed with a sealing spigot 325*c*. At the open end of the skirt 325*b* two diametrically opposed tamper-evident tabs 330 are provided. The tabs 330 are formed in windows 327 at the lower end of the skirt 320*a* and are frangibly connected to the windows 327 by bridges 332, as best shown in FIG. 46.

The tabs 330 are generally L-shape in section and comprise a main plate 330*a* to which the frangible bridges 332 are centrally connected, and an undercut leg portion 331.

Figure 46:
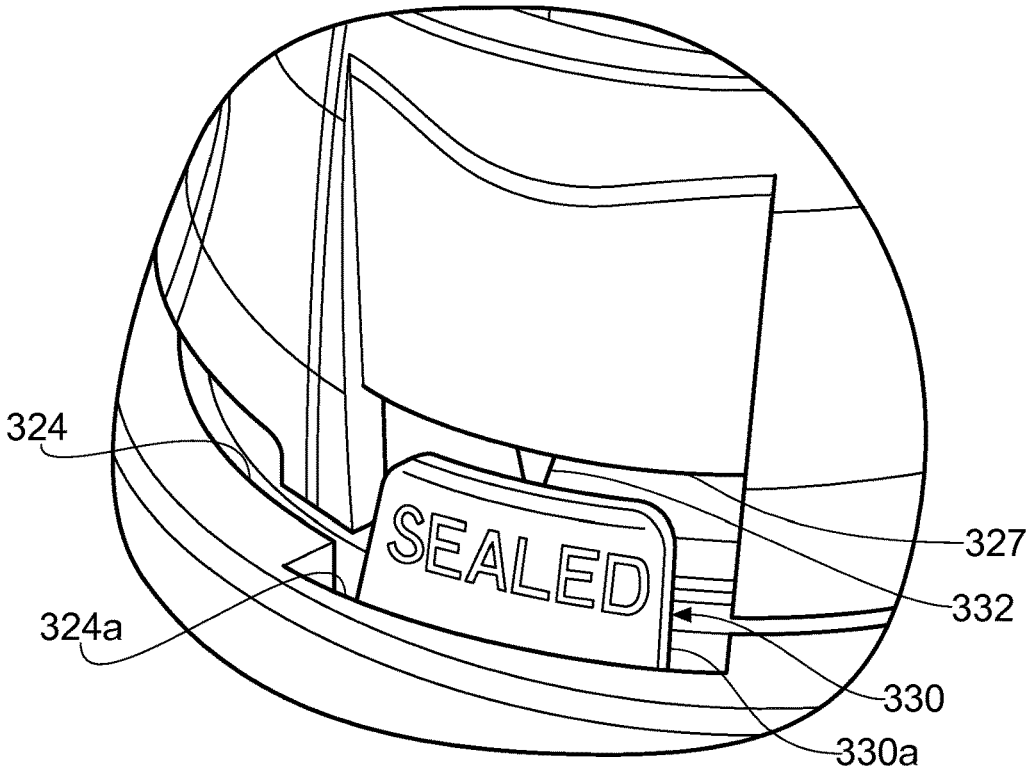
FIG. 46 is a perspective view of the region of the tamper-evident member shown in FIG. 45.

The flange 324 is formed with two diametrically opposed cut-out portions 324*a* which are in register with the tabs 330, as shown best in FIG. 46.

The closure 310 is shown in its as-moulded condition (i.e. it is moulded in the closed position) in which the lid 325 is held on the base 320 by a hinge (see FIGS. 47 and 48). Accordingly, the tabs 330 are effectively suspended from the windows 327 by the bridges 332. The relative dimensions of the tabs 330 and the recesses 324*b* of the flange 324 mean that in the as-moulded condition if the lid 325 was hinged away from the base 320 the tabs 330 would pass through the recesses 324 without breaking off.

The closure 310 further comprises a spout section generally indicated 340. The spout section 340 comprises a body with a frusto-conical nipple 341 which defines an aperture 341*a* and is joined to a base section 342 at a shoulder 342*a*. A retention hook 343 extends transversely from the base 342. A sealing lip 344 depends from the free end of the base 342 and is intended to seal in the bore of a container neck (not shown).

Figure 42:
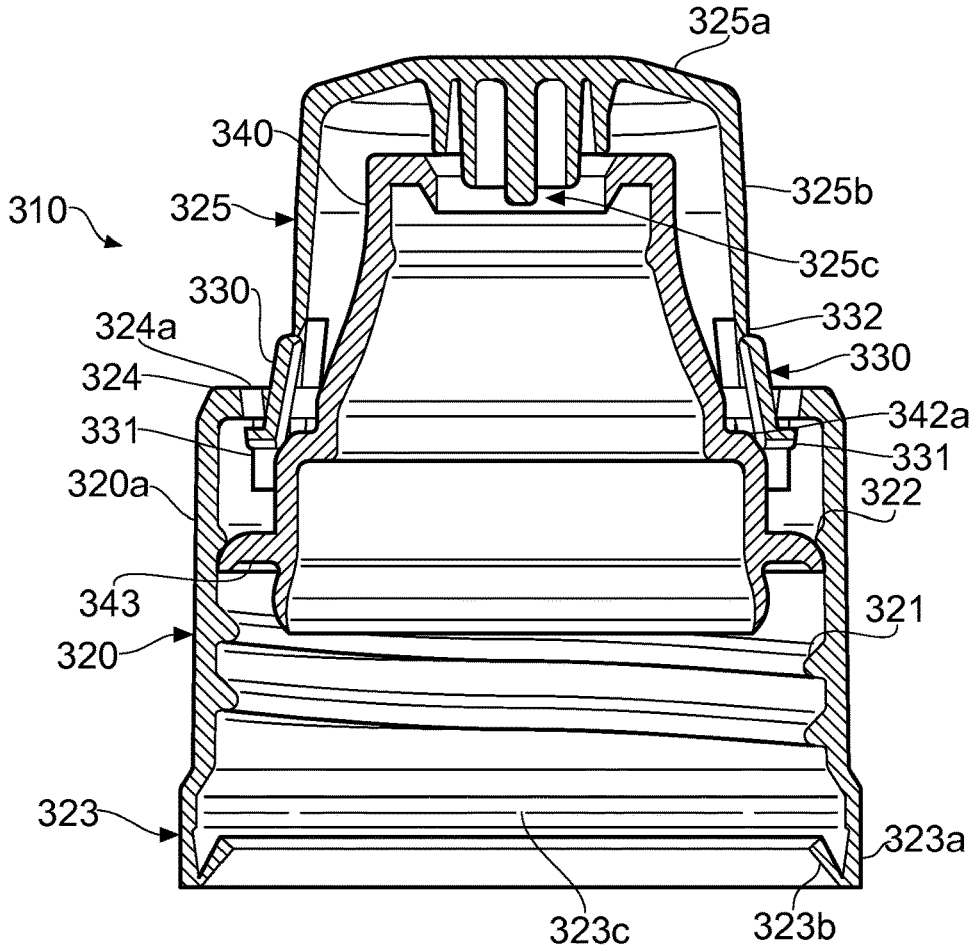
FIG. 42 is a section of the closure of FIG. 41 shown during assembly.
Figure 43:
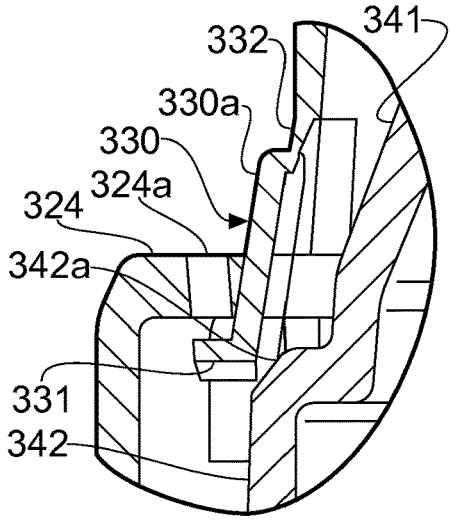
FIG. 43 is a magnified view of the region of a tamper-evident member of the closure shown in FIG. 42.
Figure 44:
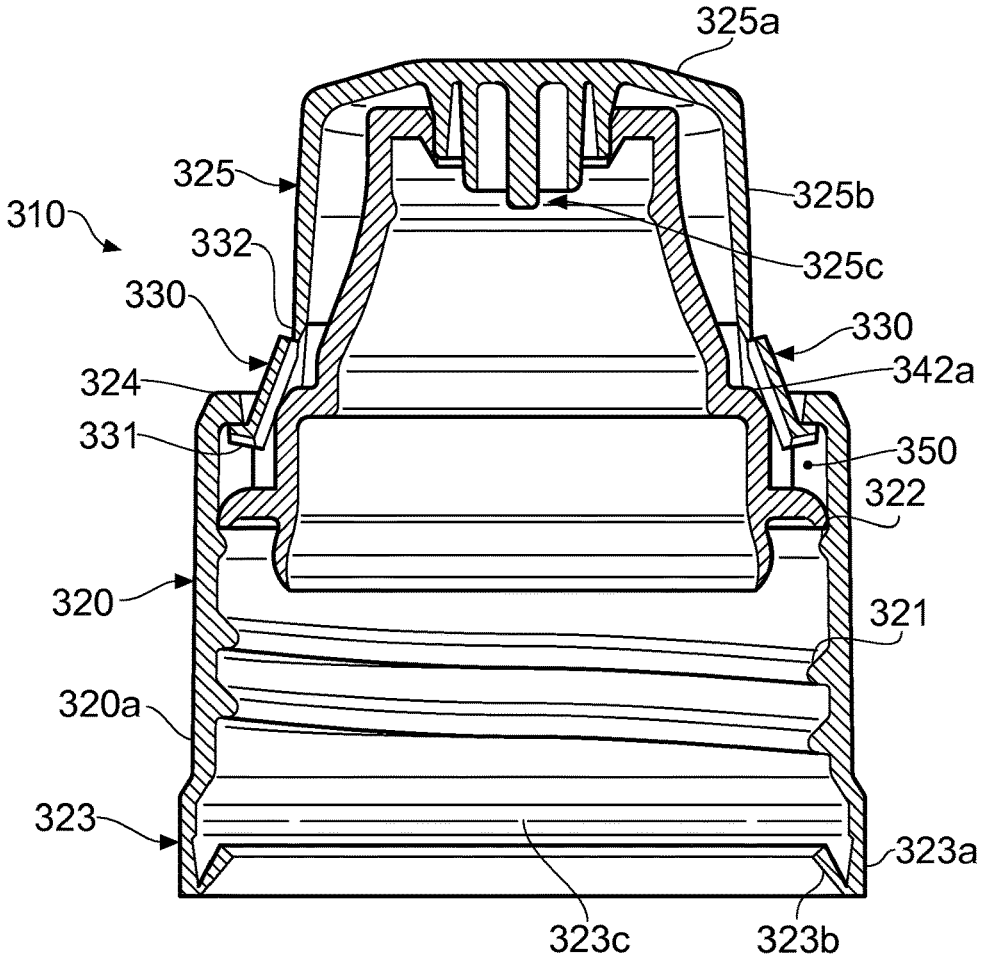
FIG. 44 is a section of the closure of FIG. 41 shown fully assembled.
Figure 45:
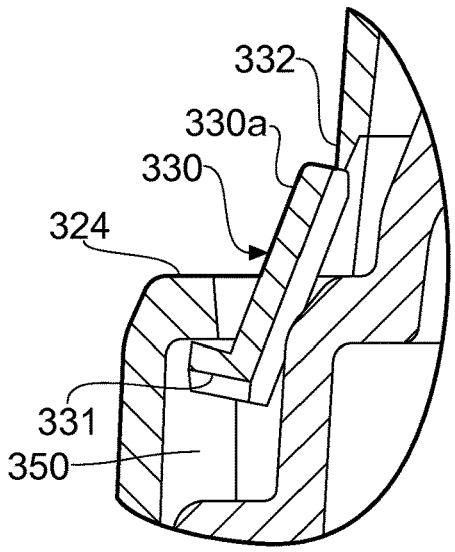
FIG. 45 is a magnified view of the region of the tamper-evident member of the closure shown in FIG. 44.

Referring now to FIGS. 42 and 43 the closure 310 is shown in a partially assembled position.

The spout 340 is introduced into the interior of the closure 310 through the base skirt 320*a* to the position shown in FIG. 42. It will be noted that the upper face of the bead 343 of the spout 340 engages the underside of the bead 322 of the base 320. Further, the spigot 325*c* begins to enter the aperture 341 a of the nipple 341.

It will also be noted that the rounded shoulder 342*a* of the spout 340 engages the tabs 330 at the intersection of the main plates 330*a* and the leg portions 331.

Referring now to FIGS. 44 to 47 the spout 340 is shown maximally inserted into the closure body. The continued insertion of the spout 340 means that the bead 343 snaps over the bead 322 to hold the spout 340 firmly in position. Further, the spigot 325*c* is sealingly engaged in the aperture 341*a*.

The continued insertion of the spout 340 means that the shoulder 342*a* pushes on the tabs 330 to cause them to swing radially outwardly as they pivot about the bridges 332. This means that the leg portions 331 of the tabs 330 engage under the flange 324 at the outside of the recesses 324*a*.

It will be noted that a void 350 is formed between the flange 324 and the annular retention bead 343.

Referring now to FIG. 48 the lid 325 is shown flipped to its open position so that the nipple 341 is exposed through the base 320. The windows 327 in the open end of the lid skirt 325*b* are clearly shown.

It will be noted that the tabs 330 are hidden from view now that the lid 325 has been opened. This is because when the lid 325 is opened the legs 331 of the tabs 330 abut against the flange 324 to prevent the tabs 330 from being lifted with the rest of the lid. Accordingly, as the lid 325 is lifted the bridges 332 break which releases the tabs 330. The tabs 330 drop into the void 350 as shown in FIGS. 49 to 53. The tabs 330 are retained in the void 350 during subsequent opening and closing operations.

It will be noted that because the tabs 330 are no longer in register with the windows 360, the spout nipple 341 is clearly visible through the lid 325. In this embodiment the spout nipple 341 and the lid 325 are formed from different coloured materials so that the spout 340 can be seen clearly through the windows 327 as an indicator that the tabs 330 are no longer present.

Figure 54:
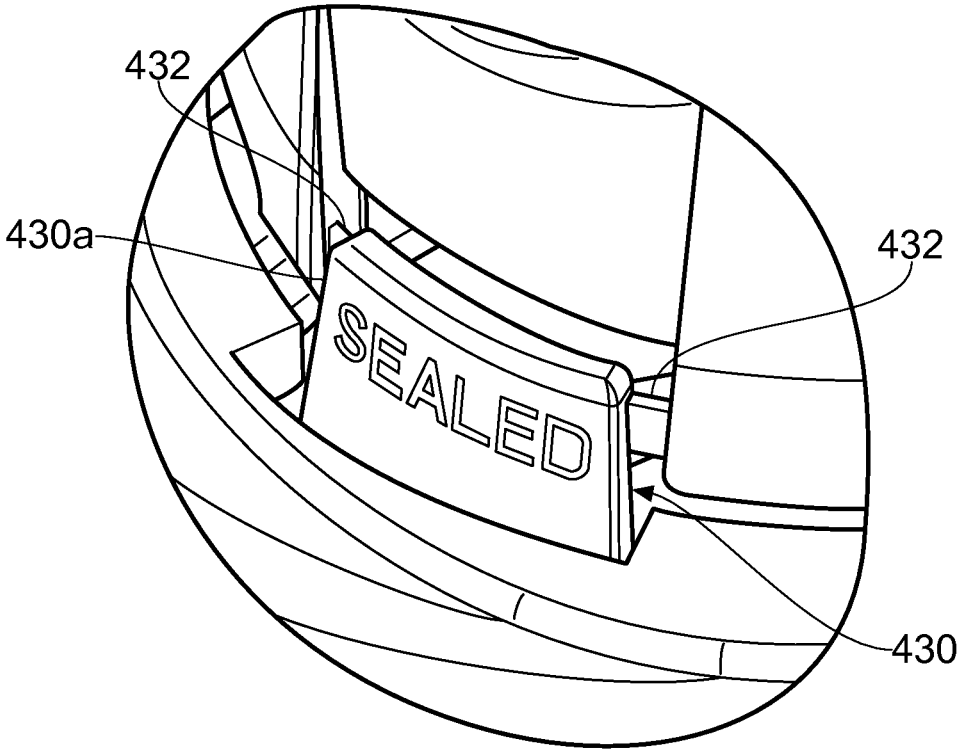
FIG. 54 is a magnified perspective view of the region of a tamper-evident member formed according to a further embodiment.

Referring now to FIG. 54 there is shown a magnified section of the region of a tamper-evident tab 430 formed according to a further embodiment. The tab 430 is very similar to the tab 330 shown in FIG. 46. However, whereas the tab 330 shown in FIG. 46 is retained by a single bridge from above the tab 430 is retained by two flanking lateral bridges 432.

Figure 55:
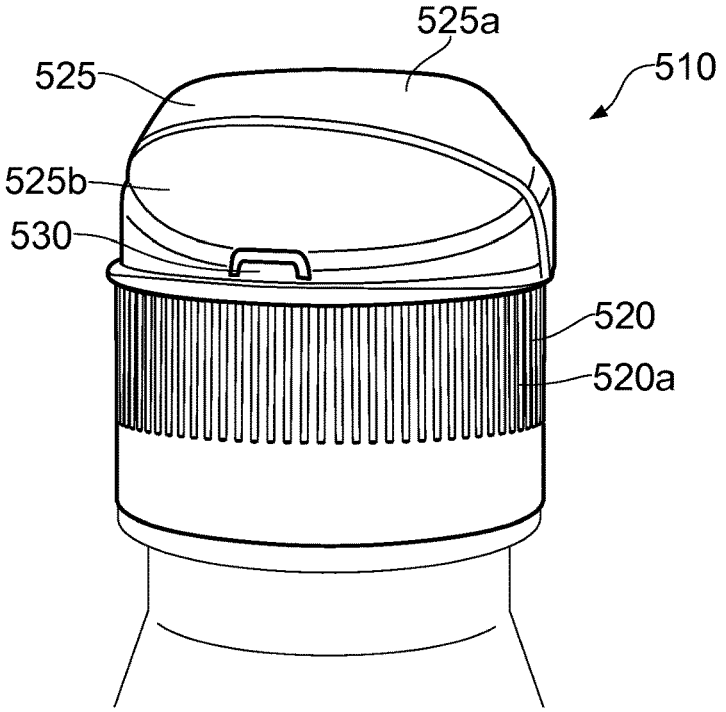
FIG. 55 is a perspective view of another closure, with the lid in the initially closed position, according to a further embodiment.

In FIG. 55, a closure according to a further embodiment is referenced 510. The closure comprises a base 520 having a substantially cylindrical skirt 520*a* and a lid 525 having a top plate 525*a*. The lid 525 also comprises a substantially cylindrical side skirt 525*b*. In this embodiment, the side skirt 525*b* has a portion directly opposite the hinge which is similar to a visor in a motorcycle crash helmet.

Figure 59:
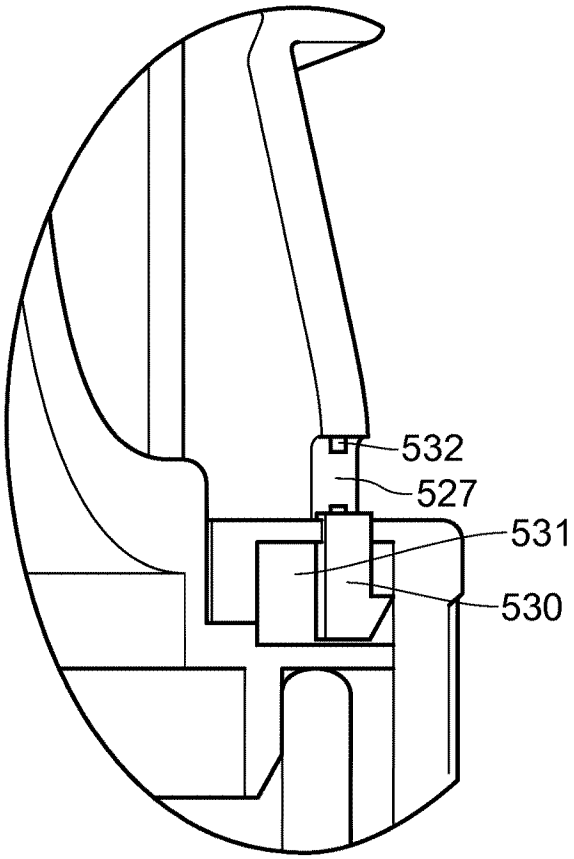
FIG. 59 is a cross-sectional view of part of the closure of FIG. 56.
Figure 58:
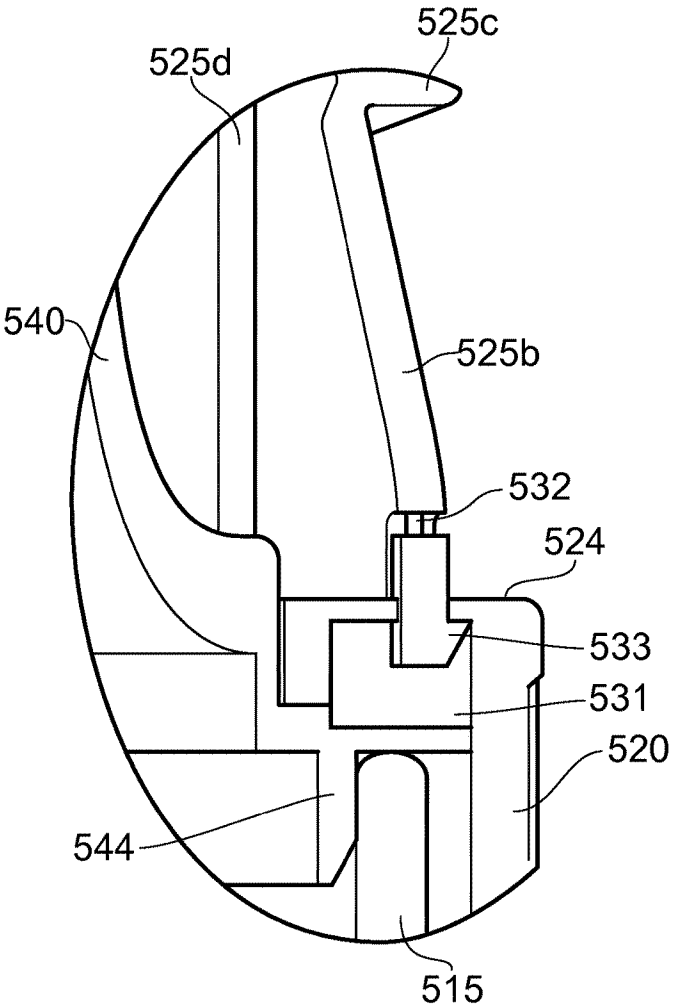
FIG. 58 is a cross-sectional view of part of the closure of FIG. 55.

At the junction between the top of the base 520 and the underside of the lid 525 a tamper-evident member 530 is visible. This tamper-evident member 530 is in the form of a tab and is frangibly connected to the lid 525. With reference to FIGS. 58 and 59, the tamper-evident member 530 has a projection 533 on its lower radially outward side. The lid is moulded in the open position. When the lid is initially closed at least part of the tamper-evident member 530 passes through an opening in the top surface 524 of the base partially into a void or pocket 531 provided in the base 520. The projection 533 engages underneath the top surface 524 of the base 520. The projection is formed such that it allows the tamper-evident member to pass through the opening in the top surface 524 but will not allow it to be removed. Accordingly, when the lid 525 is first opened the frangible bridges 532, which connect the tamper-evident member 530 to the lid 525, break since the projection 533 prevents the tamper-evident member 530 from leaving the void 531 provided underneath the hole in the top surface 524 of the base 520. When this occurs the tamper-evident member moves further into the void or pocket 531.

A cross sectional side view of part of the closure 510 is shown in FIG. 59 in which the closure has been initially opened and then re-closed. Accordingly, the frangible bridges 532 have broken and the tamper-evident member 530 is resident in the void 531 provided under the top surface 524 of the base 520. A gap 527 is left between the underside of the lid 525 and the upper surface 524 of the base through which the dispensing member 540 is visible.

Figure 56:
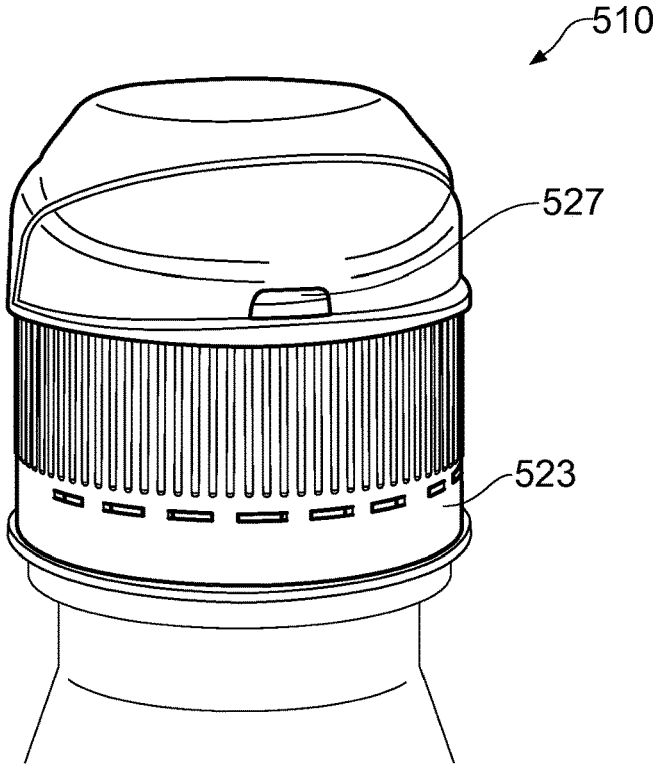
FIG. 56 is a perspective view of the closure of FIG. 55 with the lid in the closed position but having been opened at least once.

FIG. 56 shows a perspective view of the closure 510 after it has been initially opened and re-closed. The gap 527 is visible where the tamper-evident member 530 was previously present. No other parts of the closure lie between the gap 527 and the spout 540 which lies within the closure 510. Accordingly, the spout 540 is visible through the gap 527. If the spout is manufactured from a different material and/or has a different colour from the lid and/or base, and in particular from the tamper-evident member 530, then it would be more clearly visible through the gap 527 and thus provide evidence of the closure having been opened and re-closed in a more obvious manner.

Figure 57:
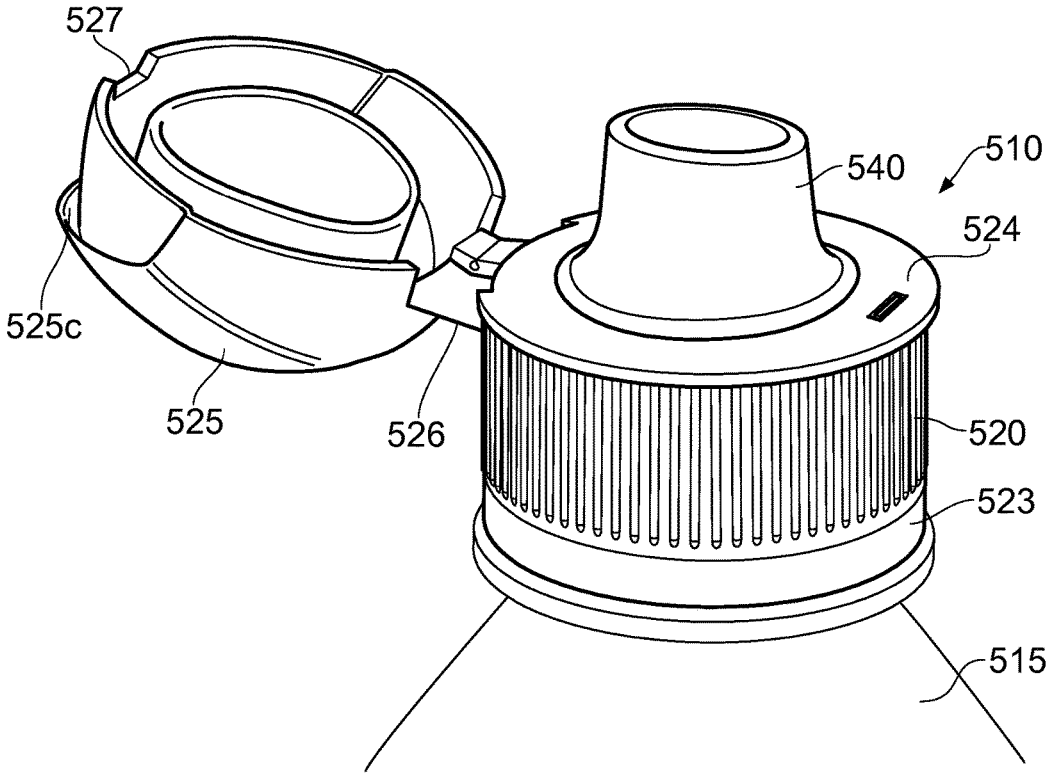
FIG. 57 is a perspective view of the closure of FIGS. 55 and 56 with the lid in the open position.

FIG. 57 shows the closure 510 in the open position. The tamper-evident member 530 is not visible because it has dropped inside the void 531 provided in the upper surface 524 of the base 520. A gripping portion 525*c* is provided at the upper end of the lid 525 directly above the tamper-evident member 530. It is seen that the lid 525 is connected to the base 520 by a hinge 526. The lid and base may be moulded integrally together or may be formed as separate items. The closure 510 may be fitted to a container 515. The closure 510 may include an additional tamper-evident member 523 provided at the lower end of the base 520. This tamper-evident member 523 provides evidence that the closure has been removed from the container 515 and operates in the well-understood manner of tamper-evident drop bands.

Figure 60:
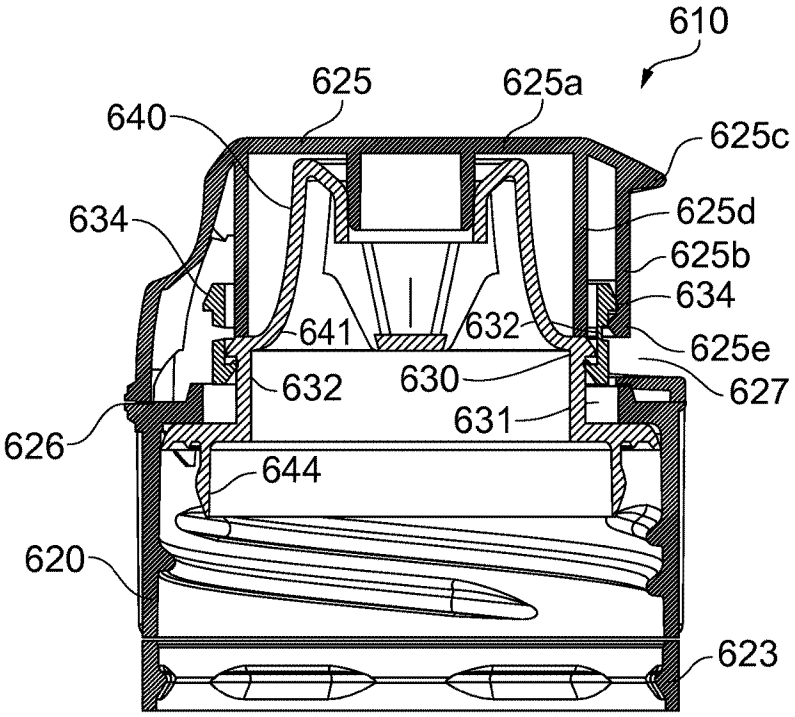
FIG. 60 is a cross-sectional view of part of another closure, with the lid in the initially closed position, according to a further embodiment.

FIGS. 60 to 65 relate to a further embodiment of the closure, generally referenced 610. FIG. 60 is cross sectional view of the closure 610. It is seen that the closure 610 comprises a base 620 and a lid 625. The lid has a top surface 625*a* and a projection 625*c* on one side to aid gripping and opening of the lid 625. Within the closure 610 is a spout or dispensing member 640. This is a separate member which is fitted inside the base 620 and lid 625. The base 620 and lid 625 are pivoted together by the hinge 626. The lid 625 has an annular projection 625*d* which depends from the top surface 625*a* and presses against part of the spout 640 so as to provide a seal. Further, the lid 625 includes an annular projection depending from the underside of top surface 625*a* and which takes the form of a bore seal to seal against the inner surface of the spout 640 to prevent leakage of the contents of the container when the lid is in the closed position.

The spout 640 includes a projection 641 which projects radially outward from the side of the spout 640 at approximately the same axial level, when assembled with the base and/or lid, as the parting plane between the underside of the lid 625 and the upper surface of the base 620. Furthermore, the skirt 625*b* of the lid 625 has a projection 625*e*. This projection projects radially inward at the lower end of the lid 625 in the circumferential region radially opposite the hinge 626. A gap 627 is left between the lower end of the side skirt 625*b* in a region approximately opposite the hinge 626 and the upper surface of the base 620. A void or pocket 631 is provided between the spout 640 and the base 620. A tamper-evident member 630 which takes the form of a separate element having an upper ring 630*a* and a lower ring 630*b* connects together by frangible connections 632 (refer to FIG. 63) is assembled with the closure 610. Upon assembly, the tamper-evident member 630 fits between the base and the lid and radially outward of the spout 640. The tamper-evident member 630 includes an upper projection 634 which projects radially outwardly and a lower projection 633 which projects radially inwardly. When the tamper-evident member 630 is assembled with the closure 610 the upper projection 634 engages with the projection 625*e* provided on the radially inner surface of the side skirt 625*b* of the lid 625. Further, the lower projection 633 engages with the projection 641 provided on the spout 640. In this manner, when the lid is initially closed it cannot be opened without breaking the frangible connections 632. This is because the projections 634, 625*e*, 633, 641 prevent the lid being opened. The projections 634, 633, 625*e*, 641 are all shaped to allow initial installation in that they have angled surfaces on one side so that the corresponding projections may pass over one another during assembly. However, they also include undercuts, on the sides opposite to the sides having the angled surfaces, which engage with corresponding undercuts of the corresponding projections to prevent the projections from passing over one another following installation.

The spout 640 also includes a bore seal 644 which seals against the radially inner surface of an associated container (not shown). Furthermore, the closure 610 includes a tamper-evident member 623 at the lower end of the base 620 which operates in a similar manner to well-known tamper-evident drop members.

Figure 61:
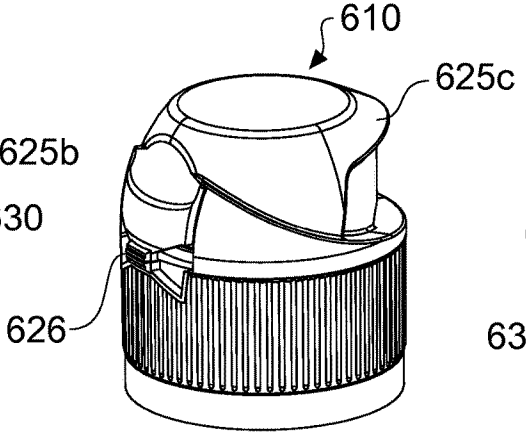
FIG. 61 is a perspective view of the closure of FIG. 60.
Figure 62:
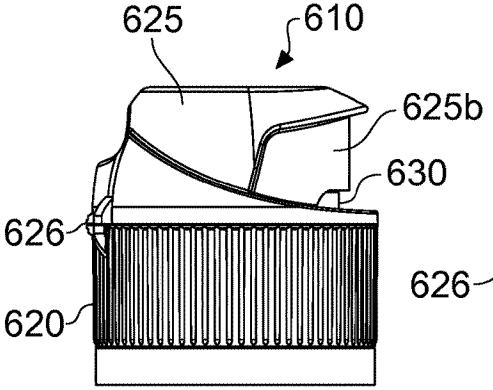
FIG. 62 is a side view of the closure of FIG. 60.
Figure 63:
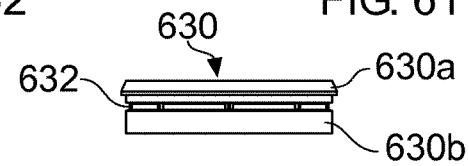
FIG. 63 is a side view of the temper evident member of the closure of FIG. 60.
Figure 65:
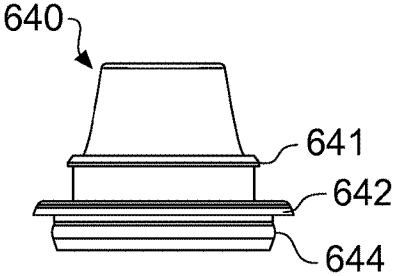
FIG. 65 is a side view of the spout member of the closure of FIG. 60.
Figure 64:
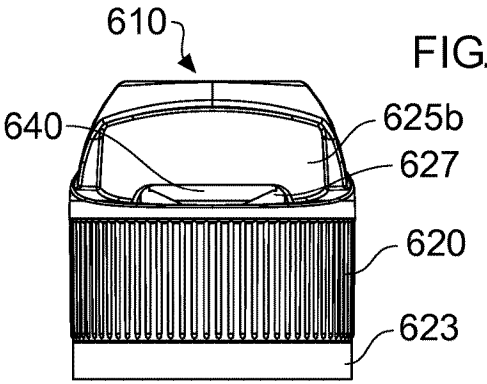
FIG. 64 is a front elevation of the closure of FIG. 60 having been opened and reclosed.
Figure 66:
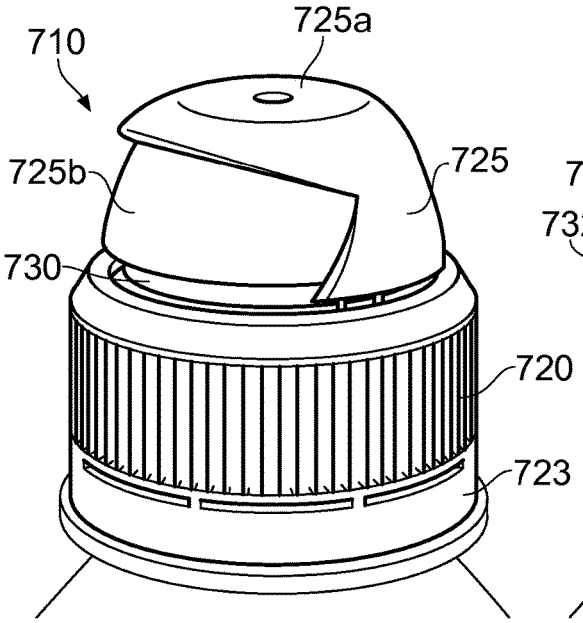
FIG. 66 is a perspective view of another closure, with the lid in the initially closed position, according to a further embodiment.
Figure 67:
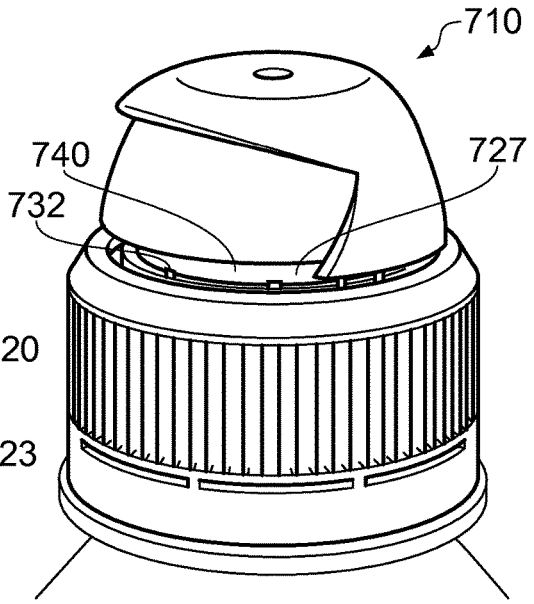
FIG. 67 is a perspective view of the closure of FIG. 66, with the lid in the closed position but having been opened at least once.
Figure 68:
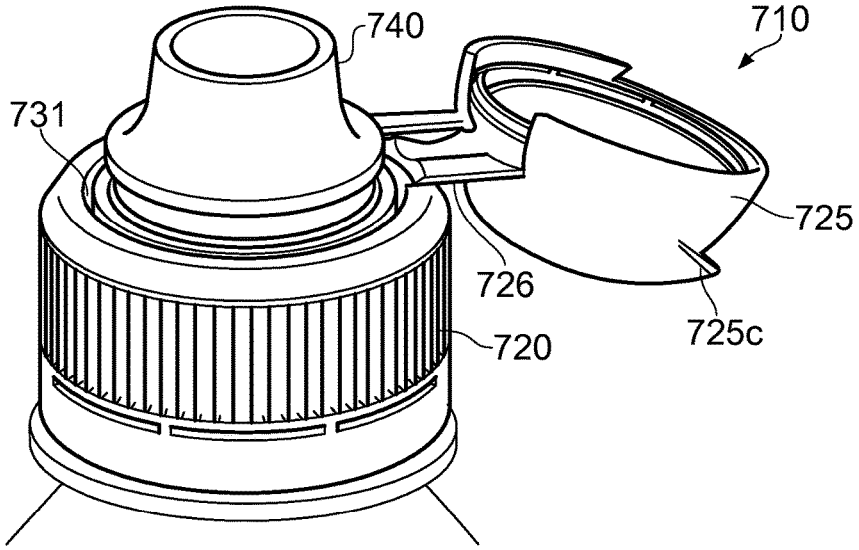
FIG. 68 is a perspective view of the closure of FIG. 66 with the lid in the open position.
Figure 70:
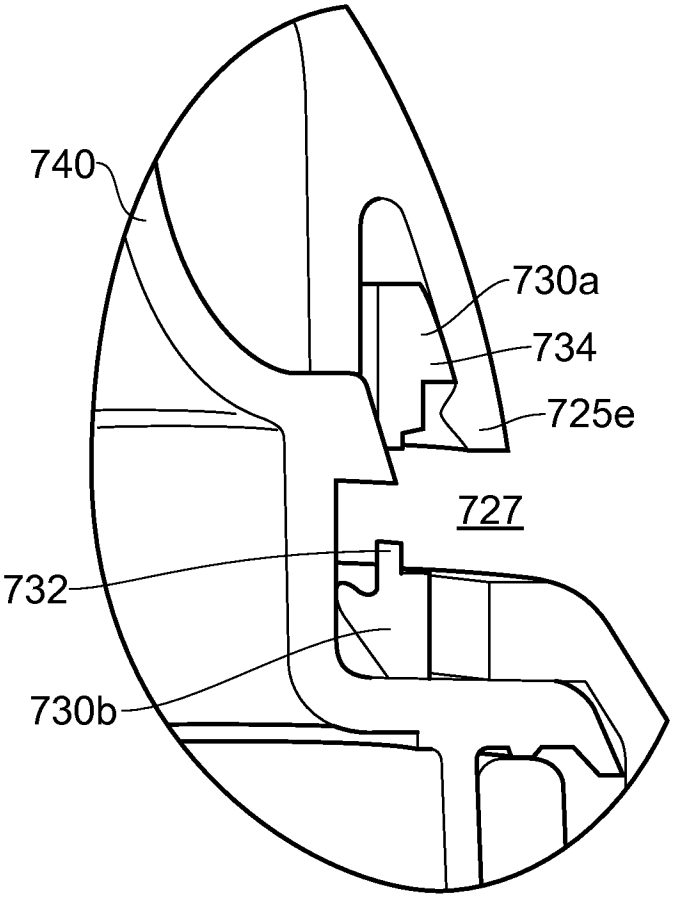
FIG. 70 is a cross-sectional side view of part of the closure of FIG. 67.
Figure 69:
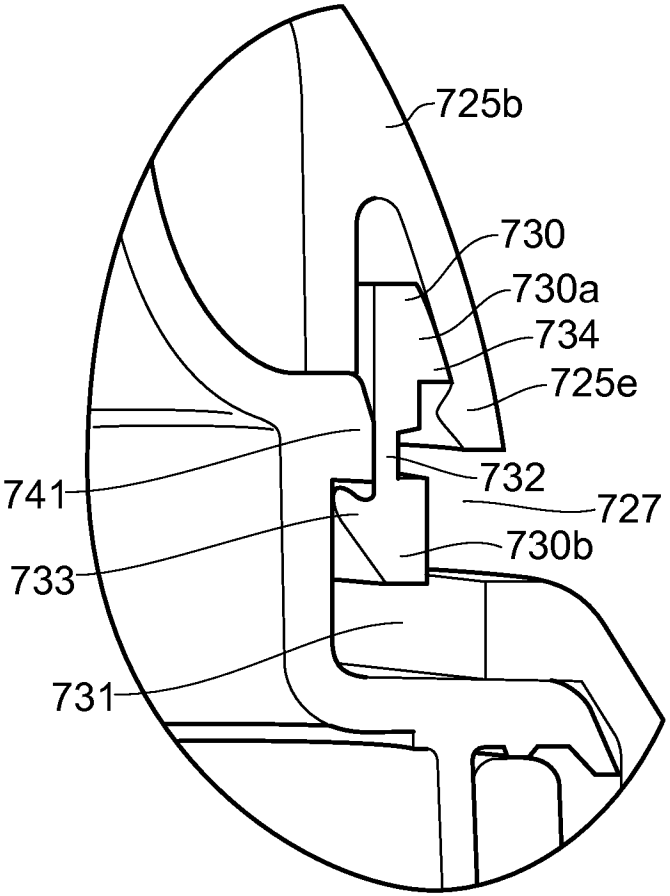
FIG. 69 is a cross-sectional side view of part of the closure of FIG. 66.

In FIG. 61, the hinge 626 is more clearly visible at the "rear" of the closure, radially or circumferentially opposite the gripping projection 625*c*. In FIG. 62, the tamper-evident member 630 is visible between the base 620 and the lid 625. In FIG. 64, the tamper-evident member has dropped into the void 631 as the lid 625 has been initially opened and then re-closed. Accordingly, part of the spout 640 is visible through the gap 627. In FIG. 65 the spout 640 is more clearly shown. The spout includes the annular projection 641, referred to above, for engagement with the tamper-evident member 630. It also includes, at an axially lower position, an annular projection 642 which seals against the inside of the base 620.

FIGS. 66 to 70 relate to a further embodiment of the closure. This embodiment operates in a similar manner to that described above with respect to FIGS. 60 to 65 in that the closure has a separate tamper-evident member 730. In this embodiment the closure 710 is moulded with the lid 725 in the closed position. It may be connected to the base 720 via frangible bridges. The lid 725 of the closure 710 has a top surface 725*a* and a visor 725*b* in a similar manner to that described above. Further, the closure 710 may include a tamper-evident band 723 at the lower end of the base 720 in a similar manner to that described above. When the tamper-evident member 730 has dropped into the void 731 (refer to FIGS. 69 and 70) a gap 727 allows the spout 740 to be visible even when the lid 725 is in the re-closed position. The lid 725 may be connected to the base 720 by a hinge 726.

The tamper-evident member 730 has an upper ring 530*a* and a lower ring 730*b*. The upper ring 730*a* includes a projection 734 on the radially outer surface. The lower ring 730*b* includes a projection 733 on the radially inner surface. The spout 740 includes a projection 741 on its radially outer surface. The visor 725*b* includes a projection 725*e* on the radially inner surface at its lower end. When the tamper-evident band 730 is assembled with the closure the projections 734 and 725*e* engage with one another and the projections 741 and 733 engage with one another. The projections are all formed with angled surfaces on one side to allow the projections to pass over one another during assembly. They also include undercut surfaces, on the sides opposite the angled surfaces, which abut one another when the lid is initially opened such that the frangible connections 732 break and the lower ring 730*b* drops into the void 731 provided in the base 720.

With regard to the use of the relative terms such as "upper" and "lower" throughout the specification, these relate to the orientation of the closures shown in the figures and are not to be interpreted in any way to limit the invention. The term "axial" relates to the vertical (as shown in the figures) axis through the dispensing orifice of the closure and the term "radial" correspond to this axis.

Although several different embodiments are described in this specification many of the features present in each closure are similar and/or are identical. For instance, each closure may be retained on an associated container by means of snap-beads and/or screw threads. Further, the shape and appearance of the dispensing member or spout is similar in each closure having a "nipple" and means of engagement with the base. Accordingly, not all of the various features in each embodiment have been fully described.

A drainage system suitable for use with the closure of, for example, FIGS. 1 to 12 is now described in more detail in relation to a different closure.

Figure 71:
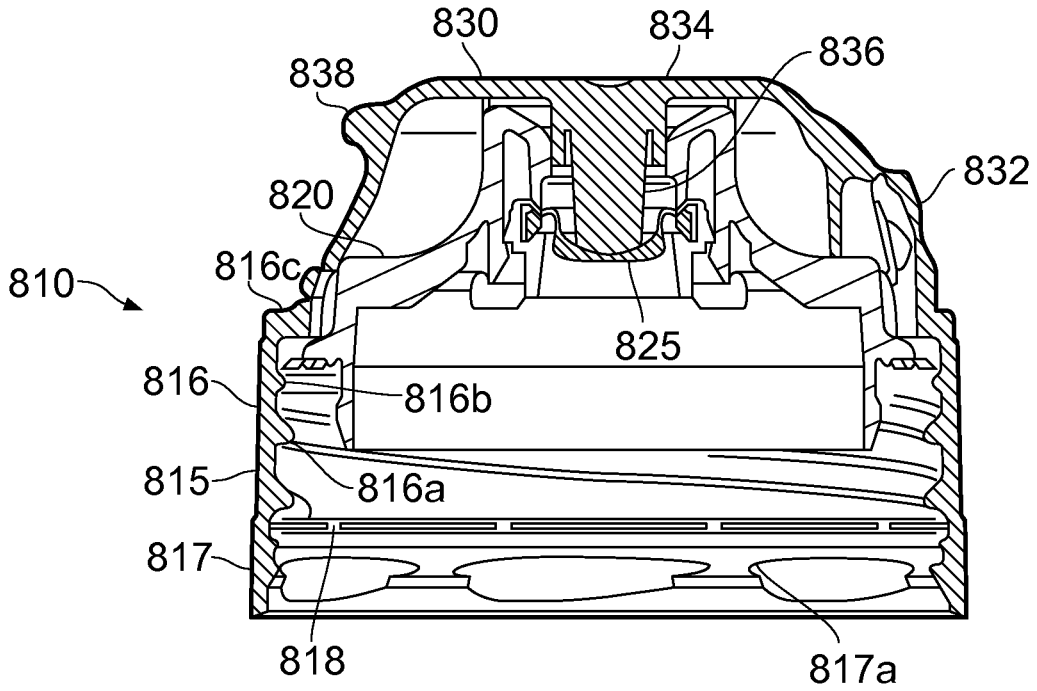
FIG. 71 is a section of a closure formed according to a further aspect of the present invention.
Figure 72:
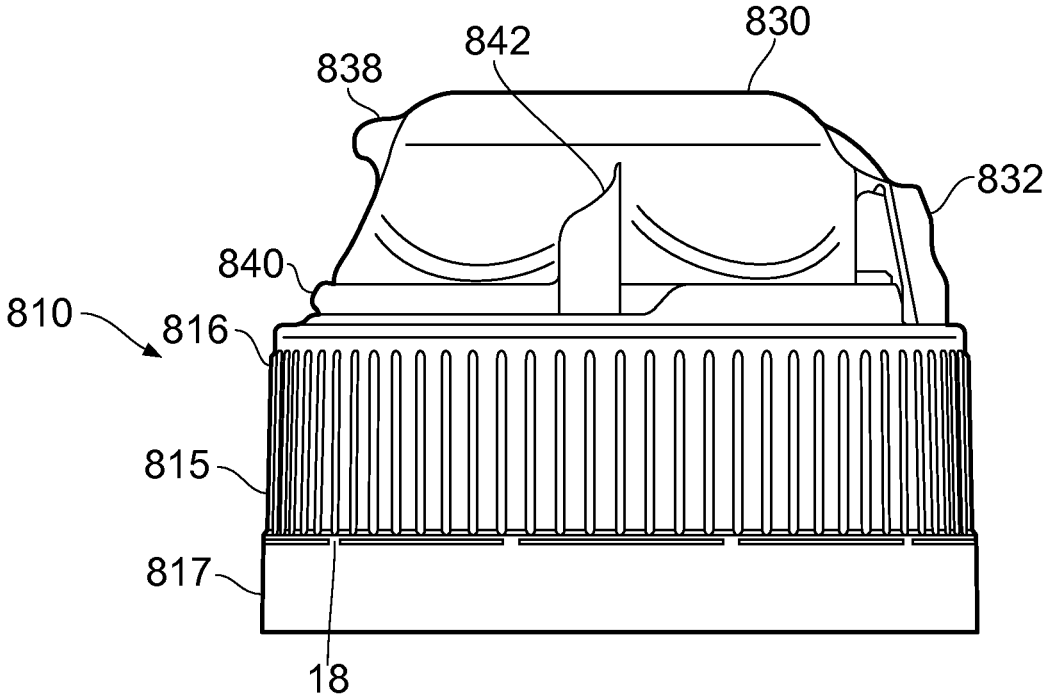
FIG. 72 is a side elevation of the closure of FIG. 71.
Figure 73A:
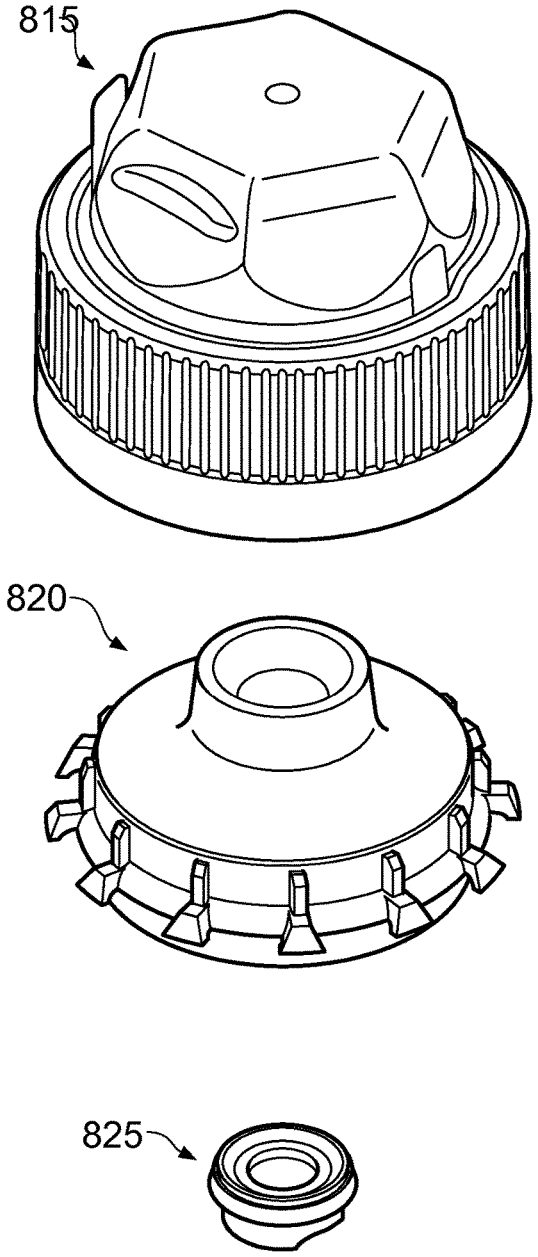
FIG. 73A is an exploded perspective view of the components making up the closure of FIGS. 71 and 72.
Figure 73B:
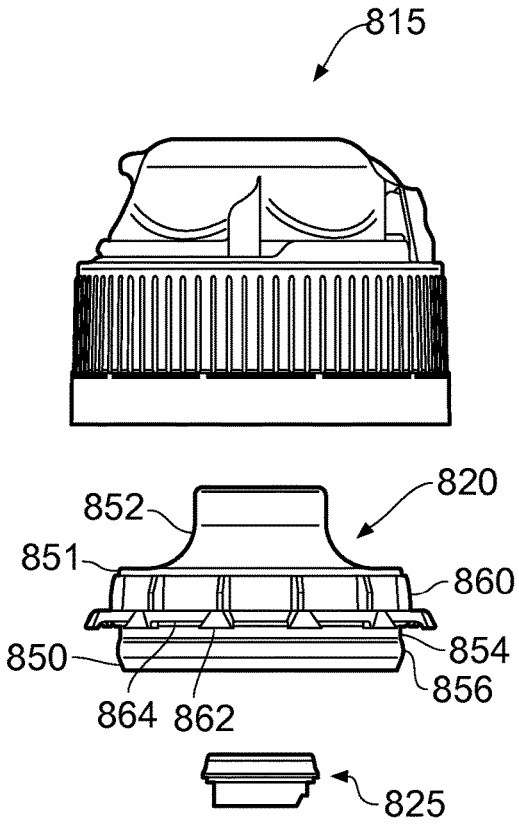
FIG. 73B is a side elevation of the view of FIG. 73A.

Referring first to FIGS. 71 to 73 there is shown a closure generally indicated 810. The closure 810 comprises a body 815, a spout insert 820 and a self-closing valve assembly 825.

The body 815 comprises a generally cylindrical side wall 816 having at one end a tamper-evident annular ring 817 connected thereto by a plurality of frangible bridges 818.

The side wall 816 terminates at its end opposite the band 817 with an annular shoulder 816*c* which extends radially inwards. A generally turret-like lid 830 is connected to the free end of the shoulder 816*c* via a hinge 832.

The interior of the side wall 816 comprises internal screw thread formations 816*a* for engaging corresponding external screw thread formations on a container neck. The interior of the side wall 816 further comprises an annular retention bead 816*b*.

The interior of the band 817 comprises a plurality of upturned flaps 817*a* for engagement under a locking bead on a container neck so that if the closure is unscrewed the band will remain on a container neck.

The lid 830 comprises a generally hexagonal top plate 834 from which depends a spigot 836. Opposite the hinge 832 the lid 830 includes a small peak 838 used to lift the lid and flip it open with respect to the base 815.

A tamper-evident strip 840 is frangibly connected between the lid 830 and the base 815. The strip 840 terminates with a tab 842 at either end to allow it to be torn away prior to first opening of the lid.

Figure 74:
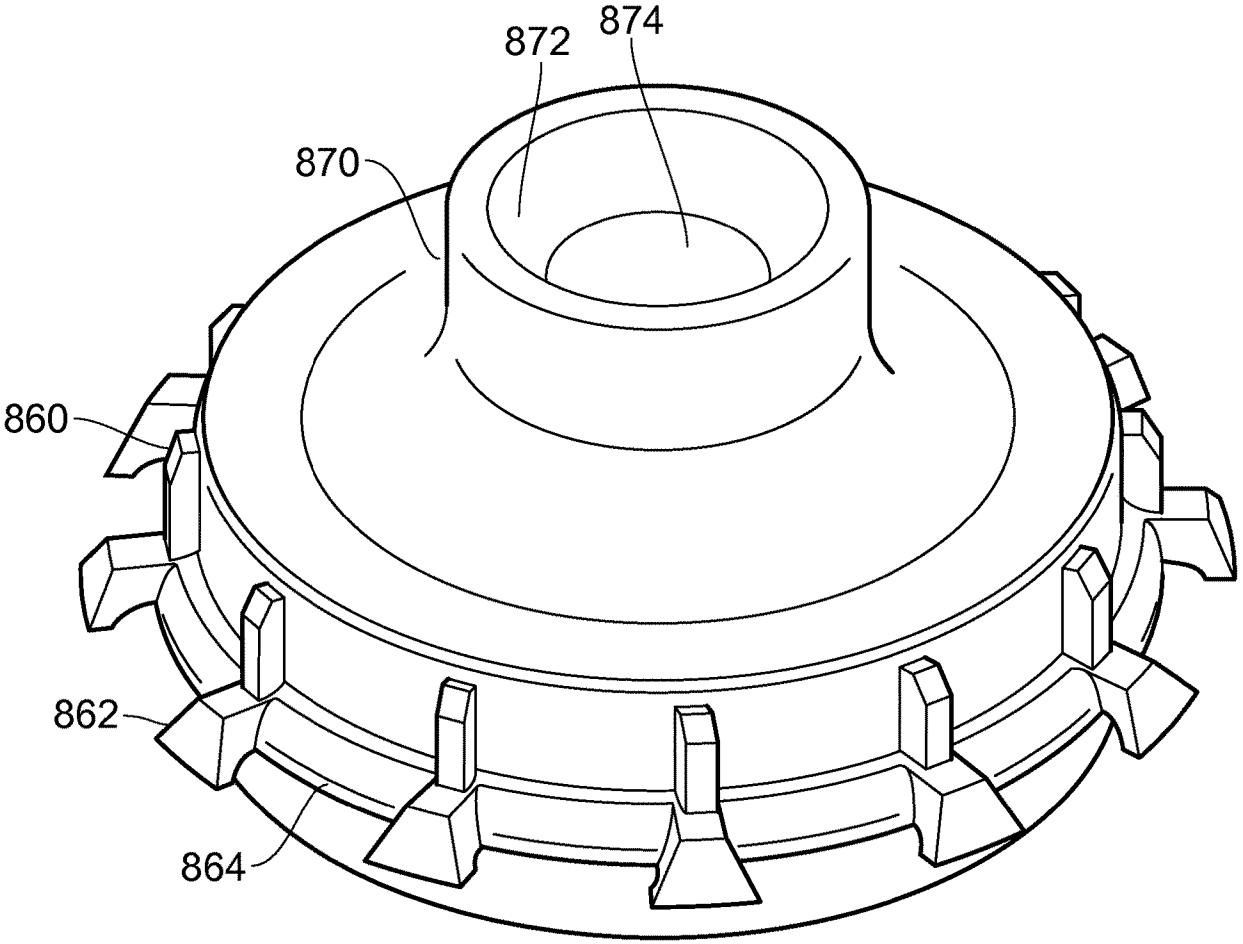
FIG. 74 is a perspective view of a spout insert forming part of the closure of FIGS. 71 to 73.

Referring now also to FIG. 74, the spout 820 comprises a generally cylindrical lower portion 850, a generally cylindrical central portion 851 and a generally frusto conical upper portion 852.

Figure 75:
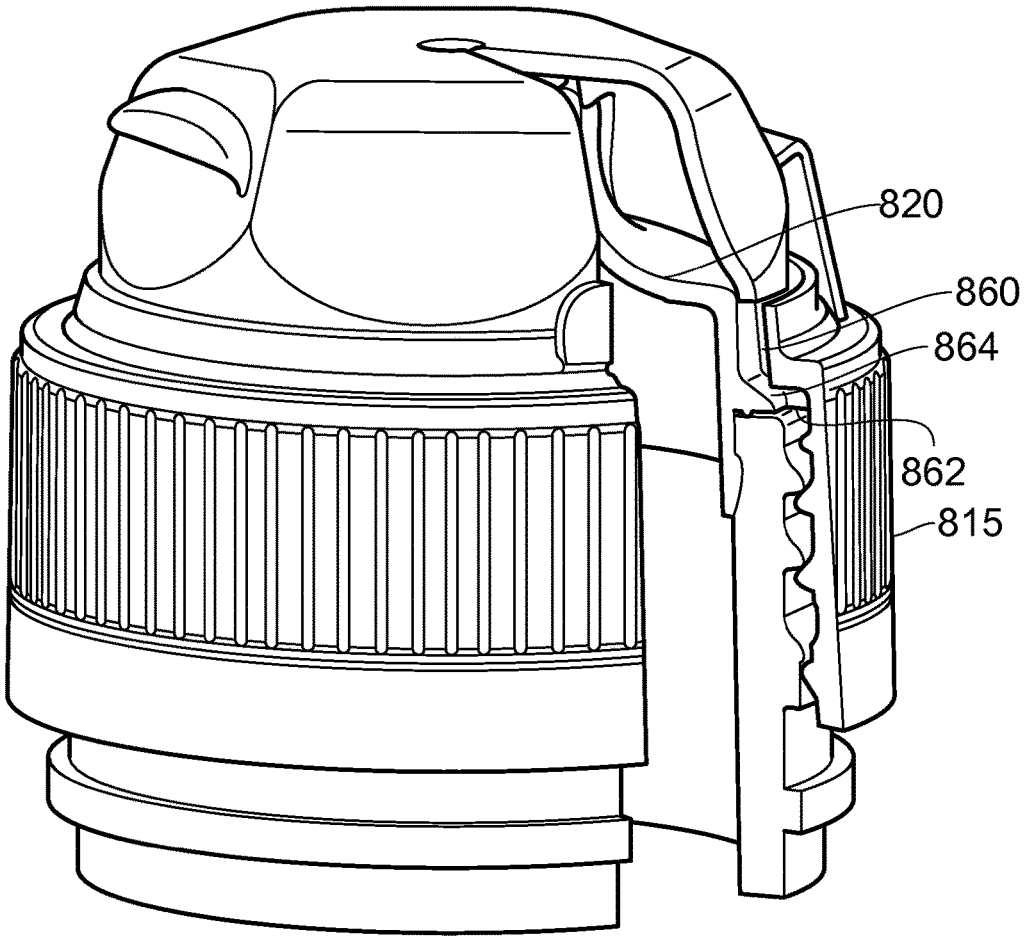
FIG. 75 is a perspective view of the closure of FIGS. 71 to 74 shown with a cut-out section illustrating the internal structure.
Figure 76:
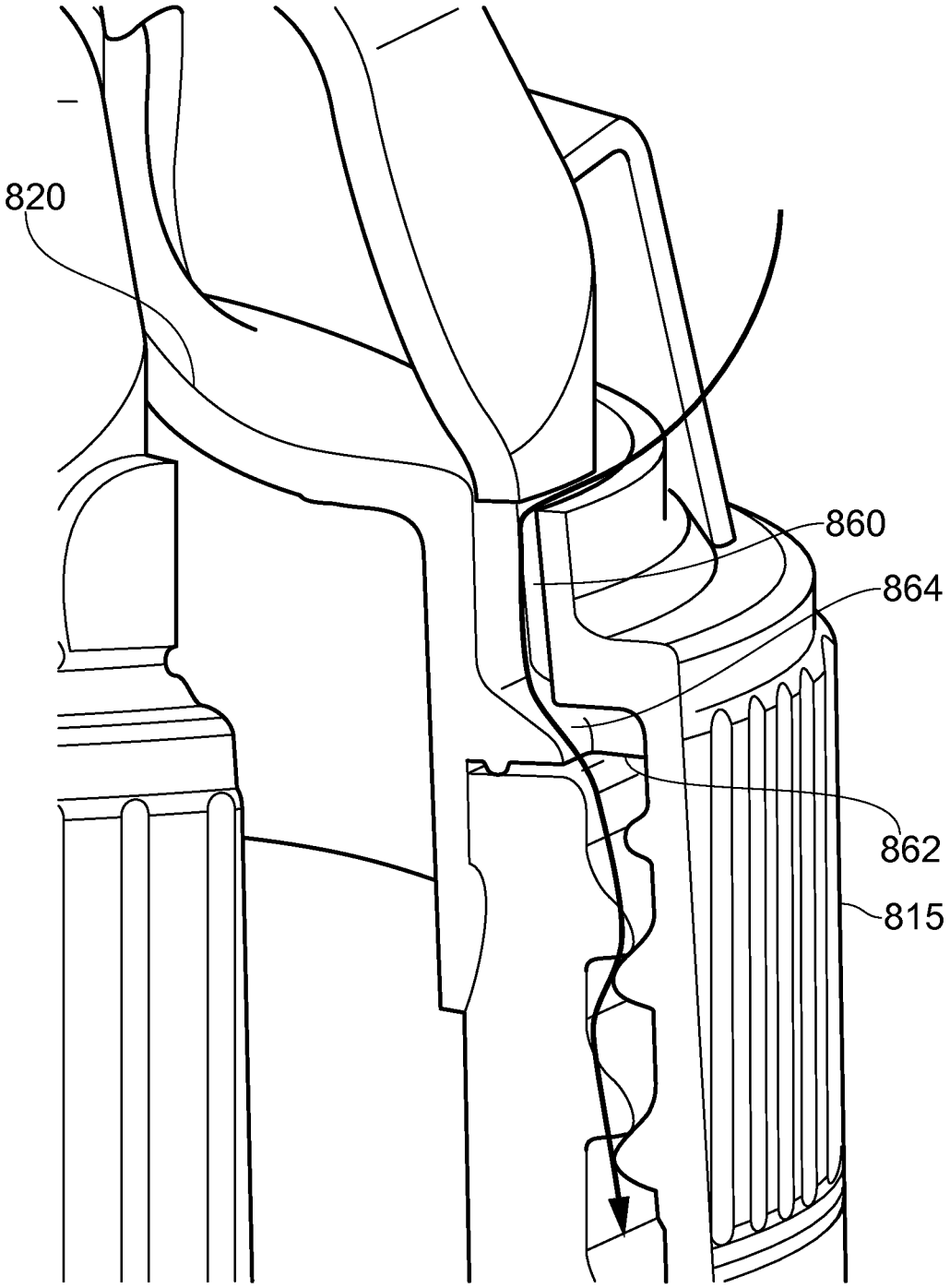
FIG. 76 is a magnified view of the cut-out section of FIG. 75.

The lower portion 850 comprises an annular sealing part 854 having an external sealing bead 856. In use, the sealing part 854 enters a container neck such that the sealing bead 856 seals against its inner surface (as shown in FIGS. 75 and 76).

The central retention portion 851 comprises an annular base 858 from which project a plurality of spaced axial ribs 860 which are used to secure the insert 820 in the body 815.

The base 858 further includes a plurality of radially outwardly extending retention spokes 862 positioned at the bottom of each rib 860. Between each spoke 862 is an inclined ledge 864 which extends radially outwardly approximately the same extent as the ribs 860. The spokes 862 are generally L-shape with the shorter leg projecting away from the upper portion 852.

As shown in best in FIG. 71, the upper portion 852 comprises a curved, generally frusto conical outer surface defining a spout. At the end of the spout side wall opposite the central portion 851 is a cylindrical terminal portion 870. An annular orifice wall 872 extends inwards from the free end of the portion 870 and defines an orifice 874. An annular retention bead 876 depends internally from the base of the terminal portion.

The self-closing valve assembly 825 comprises a body 826 and a valve 827. This structure is itself known from the Applicant's International Patent Application No PCT/EP2005/053917. The valve body 825 includes a retention bead 828 which clips over the spout retention bead. The valve assembly 825 is received between the retention bead 876 and the annular wall 872 as shown best in FIG. 71.

Referring now also to FIGS. 75 and 76, the spout 820 is received into the body 815. The retention spokes 862 engage over the retention bead 816*b* and the ribs 860 fit tightly within the orifice defined by the shoulder 816*c* so that the spout is held firmly in position. The ribs 860 also fit tightly within the lid 830 to hold it in the closed position. The spigot 836 enters the orifice 874 and abuts against the valve 827 to prevent it from opening with the lid closed.

As will be appreciated best from FIGS. 74 to 76, with the insert 820 in position slots are formed between the spokes 862 and ledges 864 of the central portion 851 and the side wall 816. Furthermore, a passage between the lid 830 and the base 858 is established by the ribs 860.

As illustrated in FIG. 76, when fluid is sprayed at the closure 810, it may enter the interior of the closure via the hinge line interface between the lid 830 and the base 815. If this happens, the fluid can pass between the ribs 860 and down over the ledges 864 before passing through the slots and then between the closure and container screw threads and out at the bottom of the side wall 816. This means that there is an unobstructed drainage path for fluid to follow if it enters the closure. It may be necessary to force fluid through the drainage path, for example by blowing air at the closure.

Figure 77:
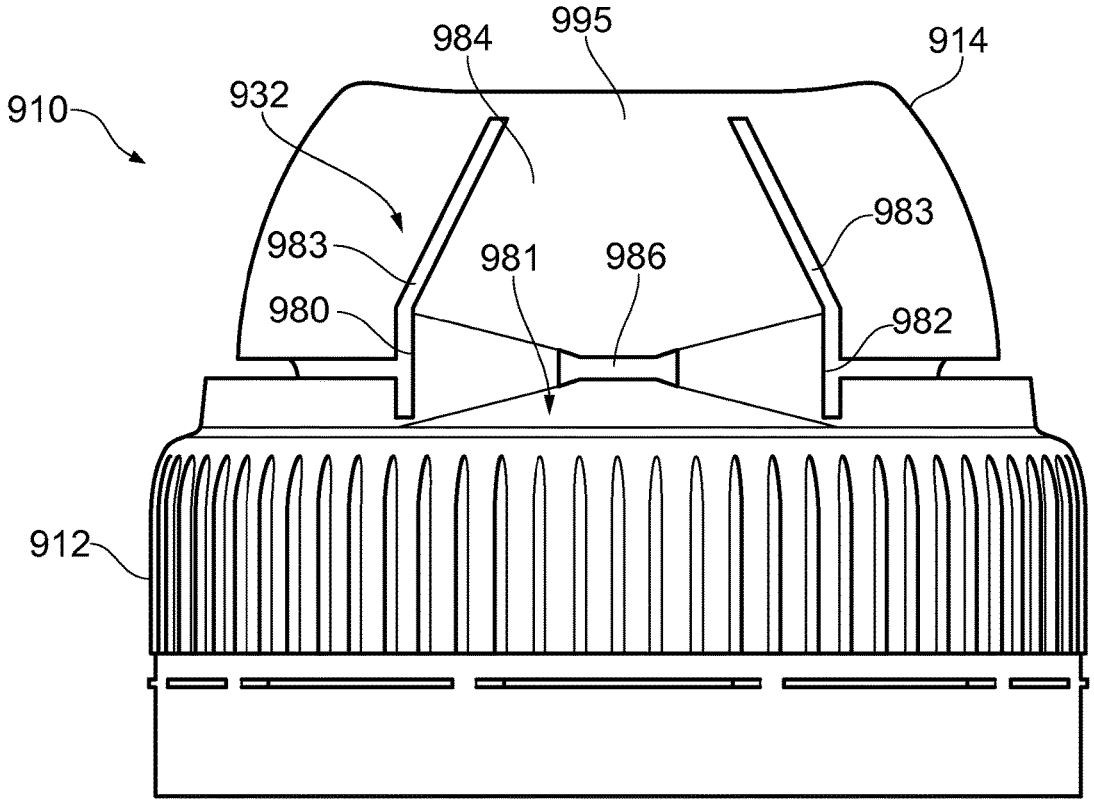
FIG. 77 is a rear elevation of a closure formed according to a further aspect.

Referring now to FIG. 77 there is shown a closure 910 formed according to a further aspect. The closure 910 shares many features in common with the closure 10 (FIGS. 1 to 12) and the closure 110 (FIGS. 13 to 36), incorporating a double hinge arrangement 932 in a flip-top dispensing closure with a double-ring tamper-evident system 902, 903.

The hinge 932 has a main hinge comprising a "butterfly hinge" 981 with pair of spaced trapezoidal links 980, 982 which link the base to the base of a generally truncated triangular hinge panel 984. The links 980, 982 are spaced by a dumb-bell shape gap 986.

At the opposite, narrower end of the panel an auxiliary hinge 995 is provided. The hinge 995 is a living hinge located in the region of the intersection between the lid sidewall and the top plate. The hinge panel 984 effectively forms part of the lid sidewall, although it, and the links 980, 982, is separated from the sidewall (other than at the auxiliary hinge line) by gaps 983 to allow the required hinging movement illustrated.

Figure 79:
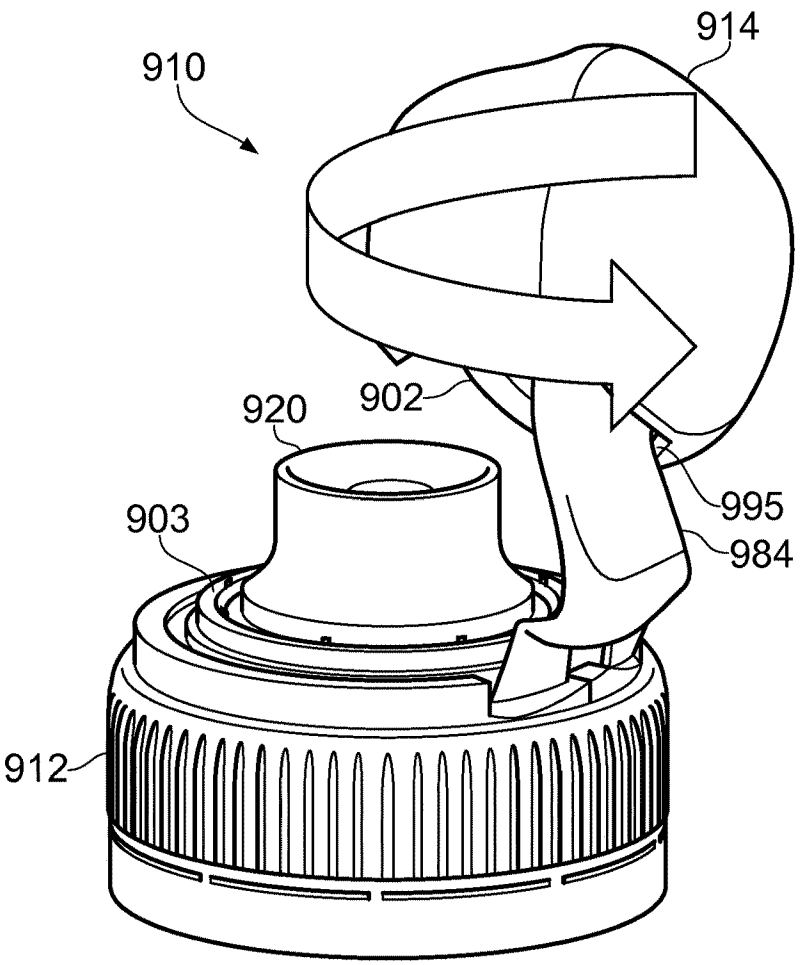
FIGS. 78 and 79 are perspective side views of the closure of FIG. 77 shown in an open position, with a hinge arrangement being twisted.
Figure 78:
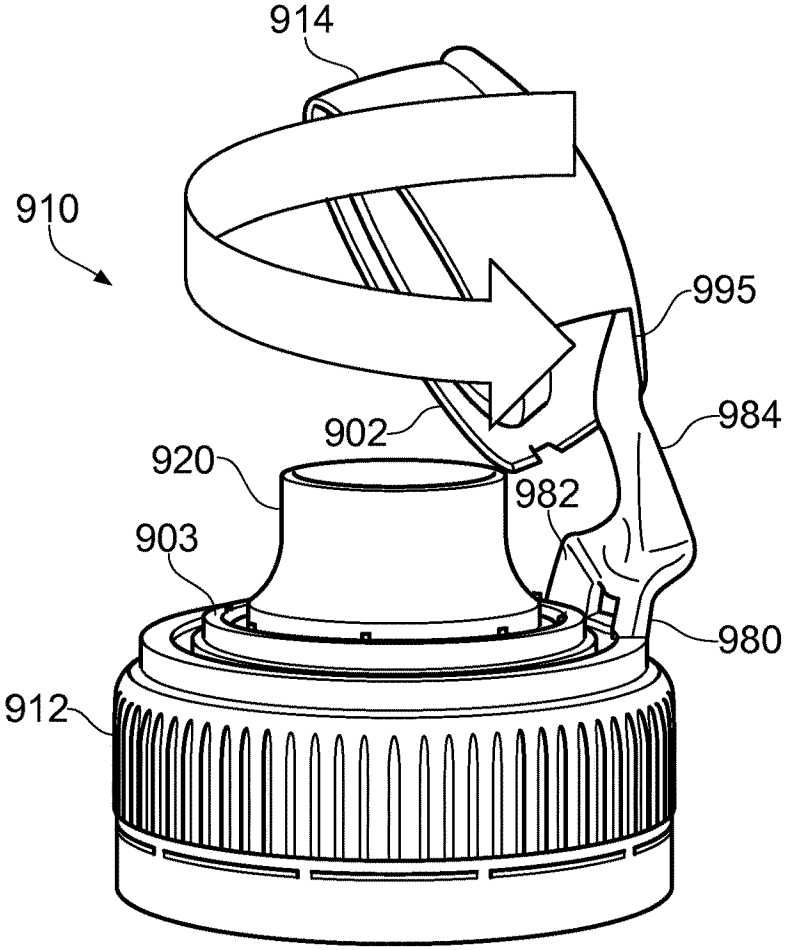
Figure 80:
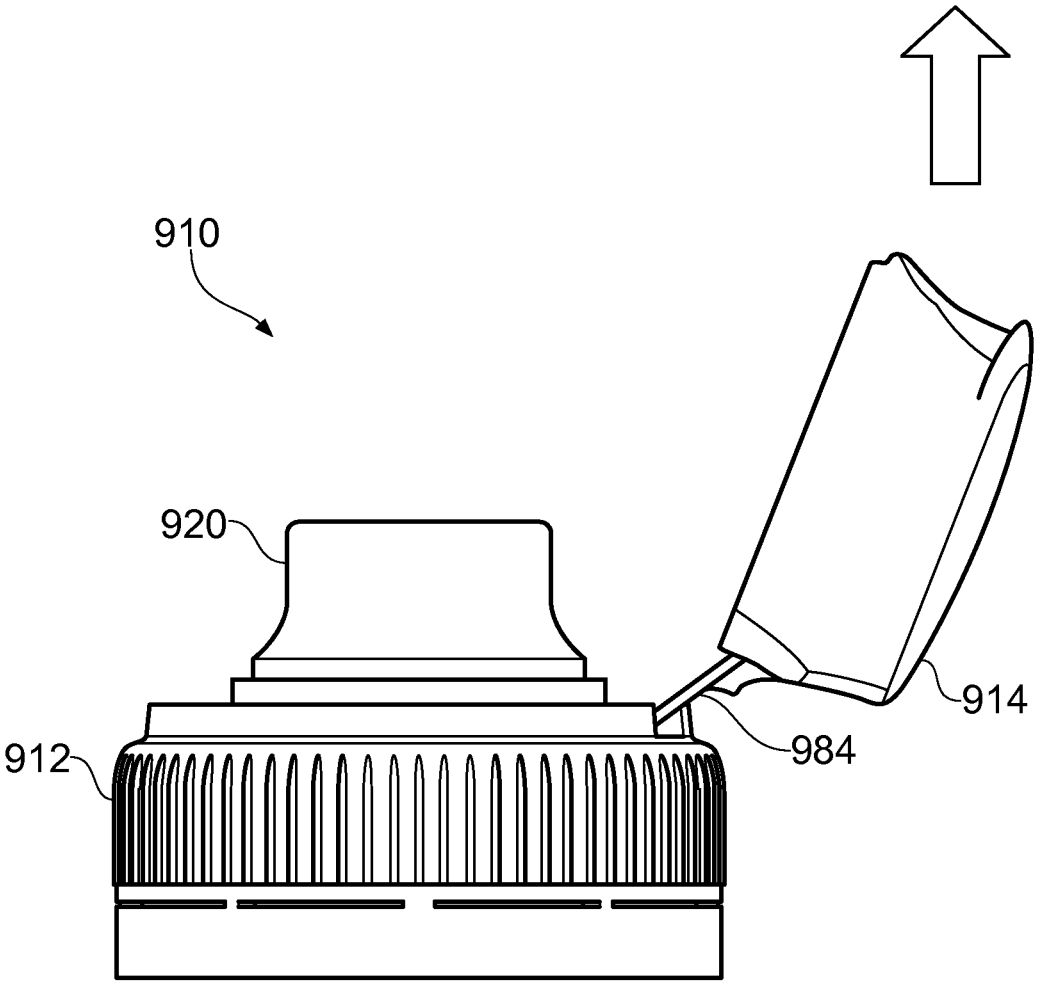
FIG. 80 is a side elevation of the closure of FIG. 77 shown in an open position and with its lid being pulled upwards.

It will be noted that the width of the main hinge is greater than the auxiliary hinge. This gives the hinge arrangement increased resistance damage from twisting (see FIGS. 78 and 79) and pulling (see FIG. 80). In other words, the hinge arrangement protects the main hinge from breakage under loading. The main hinge is not damaged or stressed even if the lid is pulled or twisted. In this embodiment the hinge can be twisted up to 180 degrees without breaking. This is important, for example, to prevent breakage of the hinge during use. This hinge arrangement could be used with any of the aspects or embodiments described herein.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A closure, comprising:

a base;

a lid; and a hinge arrangement joining the base and the lid so that the lid is movable between a closed position and an open position, the hinge arrangement comprising a main hinge, an auxiliary hinge, and a hinge panel which links the hinges, the main hinge being connected to the base and the hinge panel, and the auxiliary hinge being connected to the lid and the hinge panel, wherein a lateral extent of the main hinge is greater than a lateral extent of the auxiliary hinge, whereby to provide resistance to damage from twisting and pulling in use, the hinge panel is a generally truncated triangular hinge panel positioned between the main hinge and the auxiliary hinge, the lid comprises a top plate and a side wall, and the auxiliary hinge is located in a region of an intersection between the top plate and the side wall.

2. The closure as claimed in claim 1, wherein the main hinge is a butterfly hinge.

3. The closure as claimed in claim 2, wherein the main hinge comprises a pair of spaced trapezoidal links which link the base to the hinge panel.

4. The closure as claimed m claim 3, wherein the trapezoidal links are spaced apart from each other.

5. The closure as claimed in claim 1, wherein the auxiliary hinge is a living hinge.

6. The closure as claimed in claim 1, wherein the main hinge and the auxiliary hinge operate independently.

7. The closure as claimed in claim 1, wherein the main hinge and/or the auxiliary hinge is linear.

8. The closure as claimed in claim 1, wherein the lid moves through at least 180° between the closed and open positions.

9. The closure as claimed in claim 1, further comprising a tamper-evident member which is visible prior to first opening of the closure in use, wherein upon first opening of the closure the tamper-evident member becomes at least partly hidden from view, whereby to indicate the closure has been opened at least once.

10. The closure as claimed in claim 9, wherein the tamper-evident member includes two rings, and at least one frangible connection connecting the two rings together.

11. The closure as claimed in claim 10, further comprising a spout, wherein the tamper-evident member masks at least part of the spout, the lid and the spout or the base include projections which engage with corresponding projections on the tamper-evident member such that on first opening of the closure the tamper-evident member is pulled apart so that one ring is pulled by the lid and the other ring is pulled by the base or the spout, the at least one frangible connection breaks such that the tamper-evident member splits into two parts, a lower of the rings falls into a pocket or void provided in the base so as to become at least partly hidden from view and/or to at least partly reveal at least part of the spout.

12. The closure as claimed in claim 1, wherein the lid is configured to be twisted up to 180 degrees without breaking the hinge arrangement.

13. The closure as claimed in claim 1, wherein the hinge panel forms part of the side wall of the lid and is separated therefrom to allow hinging movement.

14. The closure as claimed in claim 1, further comprising a spout.

15. The closure as claimed in claim 14, wherein the spout forms part of the base, or the spout is formed separately from the base and the lid.

16. The closure as claimed in claim 1, wherein the main hinge is located at a first end of the generally truncated triangular hinge panel, and wherein the auxiliary hinge is located at a second end of the generally truncated triangular hinge panel, the second end being opposite the first end, and the second end being narrower than the first end.

17. A closure, comprising:

a base;

a lid;

a dispensing spout; and a hinge arrangement joining the base and the lid so that the lid is movable between a closed position and an open position, the hinge arrangement comprising a main hinge, an auxiliary hinge, and a hinge panel, the hinge panel having a wider end and a narrower end, the main hinge being connected to the base and to the wider end of the hinge panel, the auxiliary hinge being connected to the lid and to the narrower end of the hinge panel, wherein the lid comprises a top plate and a side wall, and the auxiliary hinge is located in a region of an intersection between the top plate and the side wall.

18. A flip-top dispensing closure, comprising:

a base;

a lid;

a spout; and a double hinge arrangement joining the base and the lid so that the lid is movable between a closed position and an open position, the double hinge arrangement comprising:

a first hinge connected to the base, a second hinge connected to the lid, wherein the first hinge is wider than the second hinge, and a generally truncated triangular hinge panel positioned between the first hinge and the second hinge, the generally truncated triangular hinge panel connecting the first hinge to the second hinge, wherein the lid comprises a top plate and a side wall, and the auxiliary hinge is located in a region of an intersection between the top plate and the side wall.

19. The closure as claimed in claim 18, wherein the spout is formed separately from the base and the lid, and the closure further comprises a tamper-evident member for indicating whether the lid has been opened.

* * * * *